US011930884B2

(12) United States Patent
Cross

(10) Patent No.: US 11,930,884 B2
(45) Date of Patent: Mar. 19, 2024

(54) SOLE STRUCTURE OF AN ARTICLE OF FOOTWEAR

(71) Applicant: NIKE, Inc., Beaverton, OR (US)

(72) Inventor: Tory M. Cross, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/214,887

(22) Filed: Mar. 28, 2021

(65) Prior Publication Data

US 2021/0298417 A1 Sep. 30, 2021

Related U.S. Application Data

(60) Provisional application No. 63/001,370, filed on Mar. 29, 2020.

(51) Int. Cl.
*A43B 13/18* (2006.01)
*A43B 13/14* (2006.01)

(52) U.S. Cl.
CPC ..... *A43B 13/188* (2013.01); *A43B 13/141* (2013.01); *A43B 13/186* (2013.01)

(58) Field of Classification Search
CPC ..... A43B 13/127; A43B 13/188; A43B 13/12; A43B 13/186; A43B 13/026; A43B 13/16;

(Continued)

(56) References Cited

U.S. PATENT DOCUMENTS 1,659,339 A 2/1928 Franz
1,701,611 A 2/1929 Glidden (Continued)

FOREIGN PATENT DOCUMENTS

DE 1881914 U 10/1963
DE 8305716 U1 6/1983

(Continued)

OTHER PUBLICATIONS

International Search Report and Written Opinion for Application No. PCT/US2021/024544 dated Jul. 13, 2021.

(Continued)

*Primary Examiner* — Sharon M Prange
*Assistant Examiner* — Grady Alexander Nunnery
(74) *Attorney, Agent, or Firm* — Honigman LLP; Matthew H. Szalach; Jonathan P. O'Brien

(57) ABSTRACT

A sole structure for an article of footwear includes a first cushioning element, a second cushioning element, and a panel disposed within a joint formed between the first cushioning element and the second cushioning element. The first cushioning element includes a first surface and a second surface formed on an opposite side from the first surface. The second cushioning element includes a third surface and a fourth surface formed on an opposite side from the third surface. The third surface of the second cushioning element is joined to the second surface of the first cushioning element to form a joint between the first cushioning element and the second cushioning element, where the fabric panel is interposed between the first cushioning element and the second cushioning element within the joint. The panel may be a fabric panel, and more particularly, may include a mesh textile material.

19 Claims, 51 Drawing Sheets

(58) Field of Classification Search
CPC ... A43B 13/125; A43B 13/122; A43B 13/148; A43B 7/32; A43B 9/06; A43B 17/023; A43B 9/02; A43B 13/141
USPC ..... 36/31
See application file for complete search history.

(56) References Cited

U.S. PATENT DOCUMENTS

| | | | | |
|---|---|---|---|---|
| 1,704,187 | A | 3/1929 | Glidden | |
| 2,333,303 | A | 11/1943 | Enos | |
| 2,669,036 | A | 2/1954 | Israel | |
| 3,345,664 | A | 10/1967 | Ludwig | |
| 3,812,604 | A | 5/1974 | Sato | |
| 3,878,626 | A | 4/1975 | Isman | |
| 3,925,914 | A | 12/1975 | Marcoux | |
| 4,005,532 | A | 2/1977 | Giese | |
| 4,073,072 | A | 2/1978 | Gross | |
| 4,241,523 | A | 12/1980 | Daswick | |
| 4,561,195 | A | 12/1985 | Onoda | |
| 4,608,768 | A | 9/1986 | Cavanagh | |
| 4,653,206 | A | 3/1987 | Tanel | |
| 4,798,010 | A | 1/1989 | Sugiyama | |
| 4,896,440 | A | 1/1990 | Salaverria | |
| 5,022,168 | A | 6/1991 | Jeppson, III | |
| 5,025,573 | A | 6/1991 | Giese et al. | |
| 5,075,984 | A * | 12/1991 | Shiew | A43C 15/09 36/114 |
| 5,561,920 | A | 10/1996 | Graham | |
| 5,572,805 | A | 11/1996 | Glese | |
| 5,575,089 | A | 11/1996 | Giese | |
| 5,664,343 | A | 9/1997 | Byrne | |
| 5,720,118 | A | 2/1998 | Mayer | |
| 5,926,974 | A * | 7/1999 | Friton | A43B 13/20 36/31 |
| 5,930,916 | A | 8/1999 | Connor | |
| 6,021,585 | A | 2/2000 | Cole | |
| 6,154,983 | A | 12/2000 | Austin | |
| 6,167,639 | B1 | 1/2001 | Ventura | |
| 6,205,683 | B1 | 3/2001 | Clark | |
| 6,389,713 | B1 | 5/2002 | Kita | |
| 6,401,366 | B2 * | 6/2002 | Foxen | A43B 7/1495 36/102 |
| 7,197,840 | B2 | 4/2007 | Nakano | |
| 7,401,421 | B2 | 7/2008 | Brennan | |
| 7,627,963 | B2 | 12/2009 | Kilgore | |
| 7,814,686 | B2 | 10/2010 | Becker | |
| 9,794,958 | B2 | 10/2017 | Farnshaw et al. | |
| 10,342,292 | B2 | 7/2019 | Del Biondi | |
| 10,448,703 | B2 | 10/2019 | Schiller | |
| 10,674,791 | B2 | 6/2020 | Bruce | |
| 2001/0007177 | A1 | 7/2001 | Brown | |
| 2002/0162246 | A1 | 11/2002 | Mayer et al. | |
| 2003/0093920 | A1 | 5/2003 | Greene et al. | |
| 2005/0229431 | A1 | 10/2005 | Gerlin | |
| 2007/0186446 | A1 | 8/2007 | Lafortune | |
| 2007/0240331 | A1 | 10/2007 | Borel | |
| 2008/0098616 | A1 | 5/2008 | Leedy | |
| 2009/0172971 | A1 | 7/2009 | Peikert | |
| 2010/0287795 | A1 | 11/2010 | Van Niekerk | |
| 2011/0016748 | A1 | 1/2011 | Soler | |
| 2011/0146104 | A1 | 6/2011 | Lafortune | |
| 2011/0225852 | A1 * | 9/2011 | Mahoney | A43B 13/12 36/30 R |
| 2012/0030972 | A1 | 2/2012 | Arnone et al. | |
| 2013/0167402 | A1 * | 7/2013 | Christensen | A43B 13/184 36/29 |
| 2014/0013617 | A1 | 1/2014 | Montross et al. | |
| 2014/0283412 | A1 | 9/2014 | Elder et al. | |
| 2015/0068063 | A1 | 3/2015 | Farris | |
| 2015/0250259 | A1 | 9/2015 | Attey | |
| 2015/0289591 | A1 | 10/2015 | Jones | |
| 2016/0095384 | A1 | 4/2016 | Kraft | |
| 2016/0166007 | A1 | 6/2016 | Bruce | |
| 2016/0219973 | A1 | 8/2016 | Cheney | |
| 2016/0353834 | A1 | 12/2016 | Luedecke | |
| 2017/0119094 | A1 * | 5/2017 | Vontorcik, Jr. | A43B 13/186 |
| 2017/0238652 | A1 | 8/2017 | Langvin | |
| 2017/0267850 | A1 * | 9/2017 | Baghdadi | A43B 13/125 |
| 2018/0116336 | A1 * | 5/2018 | Dallas | A43B 13/188 |
| 2018/0213884 | A1 | 8/2018 | Kim | |
| 2018/0352895 | A1 | 12/2018 | Chang | |
| 2019/0125028 | A1 * | 5/2019 | Bartel | A43B 13/026 |
| 2020/0046068 | A1 | 2/2020 | Choi | |
| 2020/0253326 | A1 | 8/2020 | Choi et al. | |

FOREIGN PATENT DOCUMENTS

| | | | |
|---|---|---|---|
| DE | 102010046278 | A1 | 2/2011 |
| DE | 102012110573 | A1 | 5/2014 |
| EP | 0130816 | A2 | 1/1985 |
| EP | 0922400 | A1 | 6/1999 |
| EP | 2975962 | A2 | 1/2016 |
| EP | 3001924 | A1 | 4/2016 |
| EP | 30011924 | A1 | 4/2016 |
| EP | 2975962 | B1 | 5/2018 |
| GB | 1433481 | A | 4/1976 |
| KR | 1433481 | A | 4/1976 |
| KR | 20070093375 | A | 9/2007 |
| KR | 101638304 | B1 | 7/2016 |
| WO | WO-2016165734 | A1 | 10/2016 |
| WO | WO-2017058419 | A1 | 4/2017 |
| WO | WO-2018175734 | A1 | 9/2018 |
| WO | WO-2019046438 | A1 | 3/2019 |

OTHER PUBLICATIONS

European Patent Office as ISA, International Search Report and Written Opinion for PCT Application No. PCT/US2018/048562, dated Feb. 13, 2019.
European Patent Office as IPEA, Written Opinion of the International Preliminary Examining Authority for PCT Application No. PCT/US2018/048562, dated Jul. 18, 2019.
European Office Action, Application No. 18 811 090.2, dated Jun. 7, 2021.
European Patent Office, Communication Pursuant to Article 94(3) EPC dated Oct. 20, 2021 for application No. 18811089.4.
USPTO, Final Office Action for U.S. Appl. No. 16/642,991, dated Oct. 6, 2022.
European Patent Office as IPEA, International Preliminary Report of Patentability for PCT Application No. PCT/US2018/048553, dated Jul. 23, 2019.
European Patent Office as ISA, International Search Report and Written Opinion for PCT Application No. PCT/US2018/048553, dated Feb. 13, 2019.
European Patent Office, Communication pursuant to Article 94(3) EPC for App. No. 18 811 089.4, dated Jun. 7, 2021.
International Search Report for PCT/US2019/045757 dated Nov. 19, 2019.
European Patent Office as ISA, International Search Report and Written Opinion for PCT Application No. PCT/US2020/025594, dated Jun. 23, 2020.
USPTO, Final Office Action for U.S. Appl. No. 16/833,617, dated Sep. 26, 2022.
USPTO, Non-Final Office Action for U.S. Appl. No. 16/833,617, dated Feb. 8, 2022.
USPTO, Non-Final Office Action for U.S. Appl. No. 16/833,617, dated Dec. 21, 2022.

* cited by examiner

SOLE STRUCTURE OF AN ARTICLE OF FOOTWEAR

CROSS REFERENCE TO RELATED APPLICATION

This non-provisional U.S. patent application claims priority under 35 U.S.C. § 119(e) to U.S. Provisional Patent Application Ser. No. 63/001,370, filed Mar. 29, 2020, the disclosure of which is hereby incorporated by reference in its entirety.

FIELD

The present disclosure relates generally to an article of footwear and more particularly to a sole structure for an article of footwear.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a stacked arrangement of a midsole and an outsole extending between a ground surface and the upper. The outsole provides abrasion-resistance and traction with the ground surface and may be formed from rubber or other materials that impart durability and wear-resistance, as well as enhancing traction with the ground surface. The midsole is disposed between the outsole and the upper. While existing sole structures perform adequately for their intended purpose, improvements to sole structures are continuously being sought in order to advance the arts.

DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
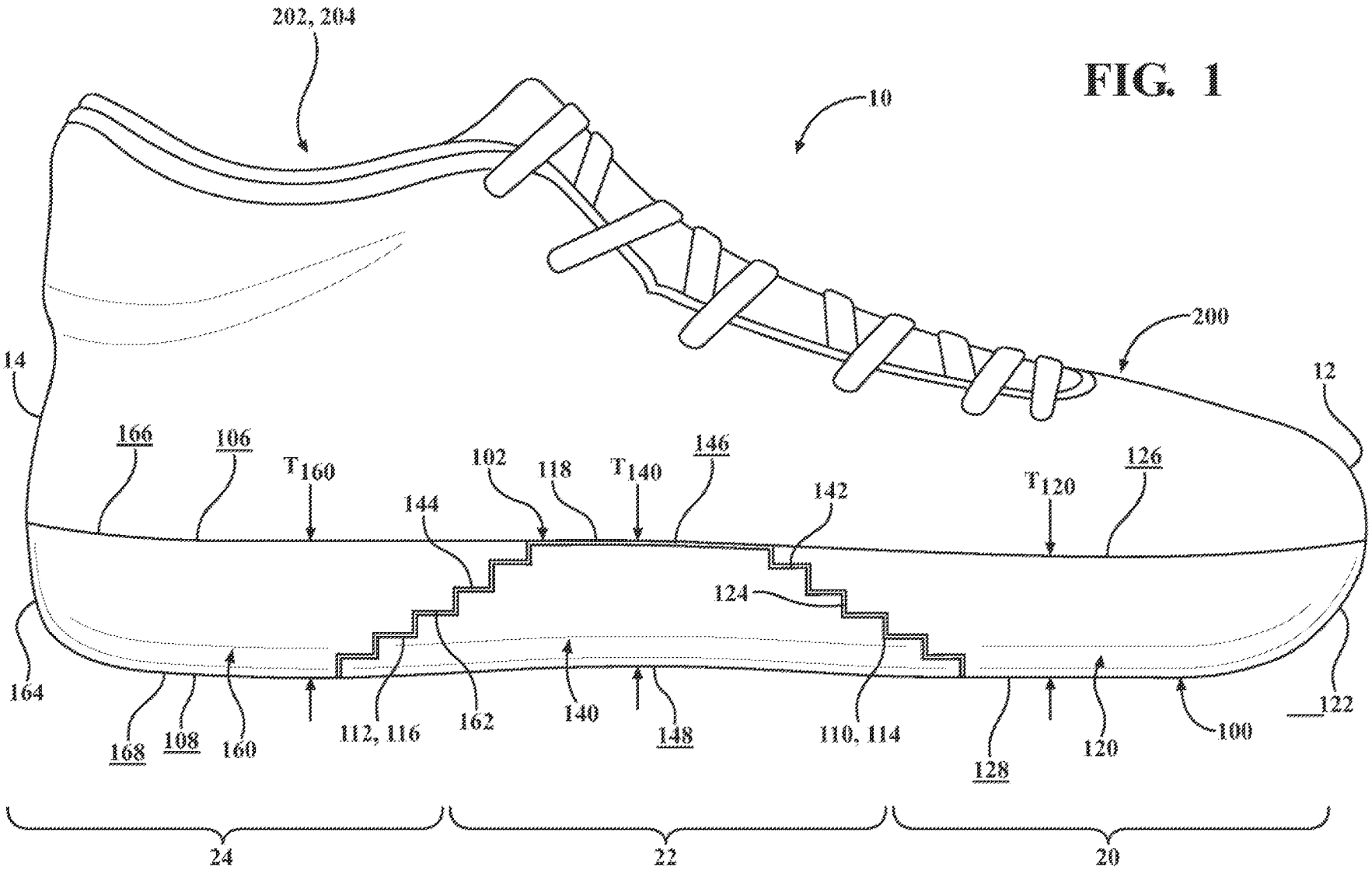
FIGS. 1 and 2 are views of one example of an article of footwear including a sole structure in accordance with the principles of the present disclosure.

The present disclosure is directed to sole structures, articles of footwear including the sole structures, methods of manufacturing the sole structures, sole structures manufactured using the methods, methods of manufacturing articles of footwear including the sole structures, and articles of footwear manufactured using the methods. These sole structures provide cushioning as well as lateral stability for articles of footwear. The sole structure includes a cushioning member including a first cushioning element having a first surface and a second surface formed on an opposite side from the first surface, and extending from a first end to a second end. The cushioning member also includes a second cushioning element having a third surface and a fourth surface formed on an opposite side from the third surface, and extending from a third end to a fourth end. A joint is formed between the first cushioning element and the second cushioning element by joining at least one of the third end and the third surface of the second cushioning element to at least one of the second end and the second surface of the first cushioning element, respectively. A fabric panel is disposed within the joint between the first cushioning element and the second cushioning element. The panel can comprise a film or sheet of material, or can comprise textile, such as a knitted textile, a woven textile, a braided textile, a crocheted textile, or a non-woven textile. As the properties of the panel affect the lateral stability of sole structure, in a manufacturing setting, the properties of the sole structure can be easily varied by varying the type of panel used in the sole structure.

Example embodiments will now be described more fully with reference to the accompanying drawings. Example embodiments are provided so that this disclosure will be thorough, and will fully convey the scope of those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of modified features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or sheet is referred to as being "on," "engaged to," "connected to," or "coupled to" another element or sheet, it may be directly on, engaged, connected or coupled to the other element or sheet, or intervening elements or sheets may be present. In contrast, when an element is referred to as being "directly on," "directly engaged to," "directly connected to," or "directly coupled to" another element or sheet, there may be no intervening elements or sheets present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, sheets and/or sections, these elements, components, regions, sheets and/or sections should not be limited by these terms. These terms may be only used to distinguish one element, component, region, sheet or section from another region, sheet or section. Terms such as "first," "second," and other numerical terms when used herein do not imply a sequence or order unless clearly indicated by the context. Thus, a first element, component, region, sheet or section discussed below could be termed a second element, component, region, sheet or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
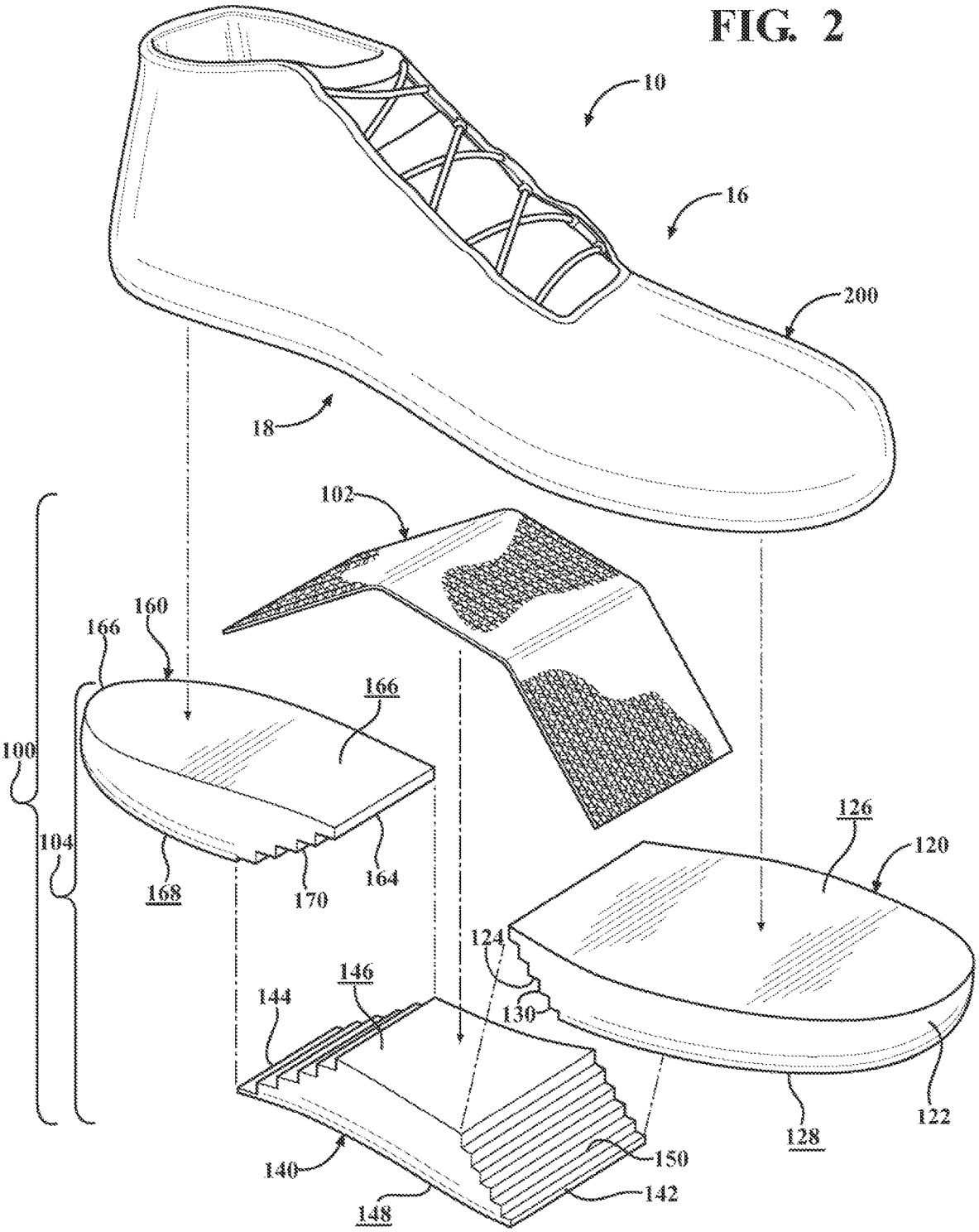

With reference to FIGS. 1 and 2, a first example of an article of footwear 10 constructed according to the principles of the present disclosure is shown. The article of footwear 10 includes a sole structure 100 and an upper 200 attached to the sole structure 100. The footwear 10 may include an anterior end 12 associated with a forward-most point of the footwear 10, and a posterior end 14 corresponding to a rearward-most point of the footwear 10. A longitudinal axis of the footwear 10 extends along a length of the footwear 10 from the anterior end 12 to the posterior end 14, and generally divides the footwear 10 into a lateral side 16 and a medial side 18, respectively corresponding with opposite sides of the footwear 10 and extending from the anterior end 12 to the posterior end 14.

The article of footwear 10 may be divided into one or more regions along the longitudinal axis. The regions may include a forefoot region 20, a mid-foot region 22, and a heel region 24. The forefoot region 20 may correspond with toes and joints connecting metatarsal bones with phalanx bones of a foot. The mid-foot region 22 may correspond with an arch area of the foot, and the heel region 24 may correspond with rear regions of the foot, including a calcaneus bone.

The upper 200 may be described as including a plurality of components that cooperate to define an interior void 202 and an ankle opening 204, which receive and secure a foot for support on the sole structure 100.

Referring now to FIG. 2, the sole structure 100 of the present disclosure includes a fabric panel 102 partially encapsulated within a cushioning member 104. As discussed below, the cushioning member 104 includes a plurality of cushioning elements 120, 140, 160 joined together with each other at respective joints 110, 112. The cushioning elements 120, 140, 160 cooperate with each other to form a footbed 106 extending along an entire length of the sole structure 100 on the top side, and a ground-engaging surface 108 extending along the length of the sole structure 100 on the bottom side. The portions of the fabric panel 102 may be disposed between adjacent ones of the cushioning elements 120, 140, 160 within the joints 110, 112.

As best shown in FIG. 1, the cushioning member 104 includes a first cushioning element 120, a second cushioning element 140, and a third cushioning element 160. In the example of FIG. 1, the first cushioning element 120 is generally disposed within the forefoot region 20 of the sole structure 100, the second cushioning element 140 is generally disposed within the mid-foot region 22 of the sole structure 100, and the third cushioning element 160 is generally disposed within the heel region 24 of the sole structure 100.

Referring to FIG. 2, the first cushioning element 120 extends from a first end 122 at the anterior end 12 of the article of footwear 10 to a second end 124 at the mid-foot region 22. The first cushioning element 120 includes a top surface 126 forming a portion of the footbed 106 in the forefoot region 20 and a bottom surface 128 formed on an opposite side of the first cushioning element 120 from the top surface 126 and forming a first portion of the ground-engaging surface 108 in the forefoot region 20.

A thickness $T_{120}$ of the first cushioning element 120, measured in the direction from the top surface 126 to the bottom surface 128, tapers at the second end 124. In the illustrated example, the thickness $T_{120}$ of the first cushioning element 120 tapers in a first direction at the second end 124. Here, the second end 124 of the first cushioning element 120 extends in a direction from the bottom surface 128 towards the top surface 126 and towards the posterior end 14 of the sole structure 100. Accordingly, the second end 124 is formed at an oblique angle relative to the top surface 126 and the bottom surface 128.

In the illustrated example, the second end 124 includes a plurality of steps 130 arranged in series along the second end 124 from the bottom surface 128 to the top surface 126. Each of the steps 130 extends continuously across a width of the first cushioning element 120, from the lateral side 16 to the medial side 18. Accordingly, the thickness $T_{120}$ of the first cushioning element 120 tapers incrementally at the second end 124. While the illustrated steps 130 are shown has being square steps 130 each including a vertical face and a horizontal face, in other examples the steps 130 may be angled steps having faces oriented at oblique angles. Optionally, the edges or vertices of the steps 130 may be radiused to form convex or concave curvatures along the widths of the steps 130.

Referring still to FIG. 2, the second cushioning element 140 extends from a first end 142 adjacent to the forefoot region 20 to a second end 144 adjacent to the heel region 24. Like the first cushioning element 120, the second cushioning element 140 includes a top surface 146 and a bottom surface 148 forming respective portions of the footbed 106 and ground-engaging surface 108 in the mid-foot region 22. A thickness $T_{140}$ of the second cushioning element 140, measured in the direction from the top surface 146 to the bottom surface 148, tapers at each of the first end 142 and the second end 144.

In the illustrated example, the thickness $T_{140}$ of the second cushioning element 140 tapers in the first direction at the first end 142, such that the first end 142 of the second cushioning element 140 is complementary to (i.e., aligns against) the tapered second end 124 of the first cushioning element 120. Here, the first end 142 of the second cushioning element 140 extends in the direction from the bottom surface 148 towards the top surface 146 and towards the posterior end 14 of the sole structure 100. Accordingly, the first end 142 is formed at an oblique angle relative to the top surface 146 and the bottom surface 148.

The thickness $T_{140}$ of the second cushioning element 140 tapers in a second direction at the second end 144. Here, the second end 144 of the second cushioning element 140 extends in the direction from the top surface 146 to the bottom surface 148 and towards the posterior end 14 of the sole structure 100. Accordingly, the second end 144 angles in an opposite direction than the first end 142, such that the first end 142 and the second end 144 converge with each other in the direction from the bottom surface 148 to the top surface 146.

Each of the first end 142 and the second end 144 of the second cushioning element 140 includes a plurality of steps 150 arranged in series from the top surface 146 to the bottom surface 148. The steps 150 of the first end 142 are configured to mate with the steps 130 formed on the second end 124 of the first cushioning element 120 when first end 142 of the second cushioning element 140 is joined to the second end 124 of the first cushioning element 120.

Referring still to FIG. 2, the third cushioning element 160 extends from a first end 162 adjacent at the mid-foot region 22 to a second end 164 at the posterior end 14. Like the first cushioning element 120, the third cushioning element 160 includes a top surface 166 and a bottom surface 168 forming respective portions of the footbed 106 and the ground-engaging surface 108 in the heel region 24. A thickness $T_{160}$ of the third cushioning element 160, measured in the direction from the top surface 166 to the bottom surface 168, tapers at the first end 162.

In the illustrated example, the thickness $T_{160}$ of the third cushioning element 160 tapers in the second direction at the first end 162, such that the first end 162 of the third cushioning element 160 is complementary to (i.e., aligns against) the tapered second end 144 of the second cushioning element 140. Here, the first end 162 of the third cushioning element 160 extends in the direction from the top surface 166 towards the bottom surface 168 and towards the posterior end 14 of the sole structure 100. Accordingly, the first end 162 is formed at an oblique angle relative to the top surface 166 and the bottom surface 168.

The first end 162 of the third cushioning element 160 includes a plurality of steps 170 arranged in series from the top surface 146 to the bottom surface 148. The steps 170 of the third cushioning element 160 are configured to engage or mate with the steps 150 formed on the second end 144 of the second cushioning element 140 when first end 162 of the third cushioning element 160 is joined to the second end 144 of the second cushioning element 140.

As provided above, when the sole structure 100 is assembled, the second end 124 of the first cushioning element 120 and the first end 142 of the second cushioning element 140 are joined together and cooperate to form the first joint 110 of the cushioning member 104 between the forefoot region 20 and the mid-foot region 22. Similarly, the second end 144 of the second cushioning element 140 and the first end 162 of the third cushioning element 160 are joined together and cooperate to form the second joint 112 of the cushioning member 104 between the mid-foot region 22 and the heel region 24.

As best shown in FIG. 1, the fabric panel 102 includes a first portion 114 disposed within the first joint 110, a second portion 116 disposed within the second joint 112, and a third portion 118 extending along the top surface 146 of the second cushioning element 140 and connecting the first portion 114 and the second portion 116.

Figure 3:
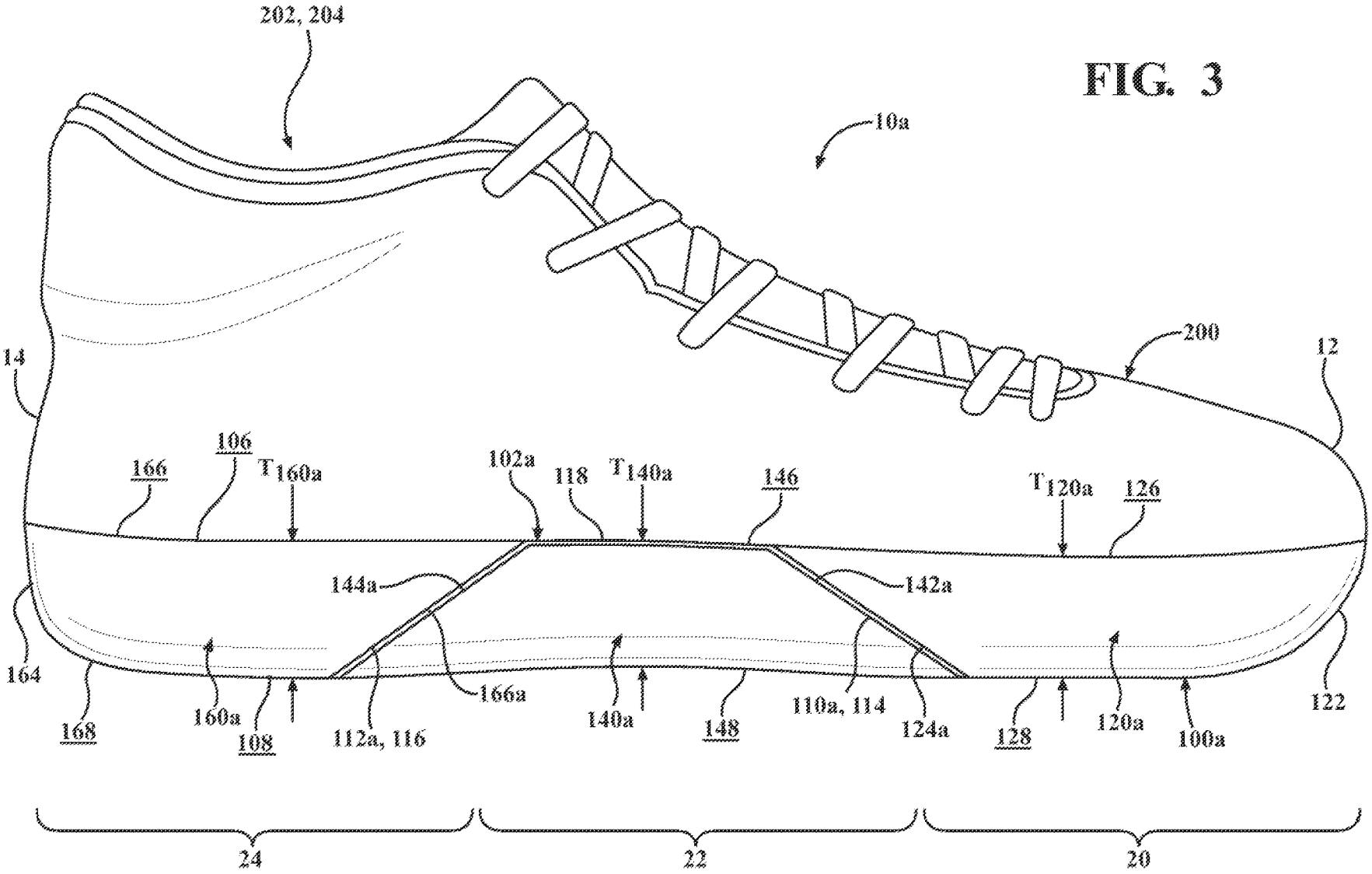
FIGS. 3 and 4 are views of another example of an article of footwear including a sole structure in accordance with the principles of the present disclosure.
Figure 4:
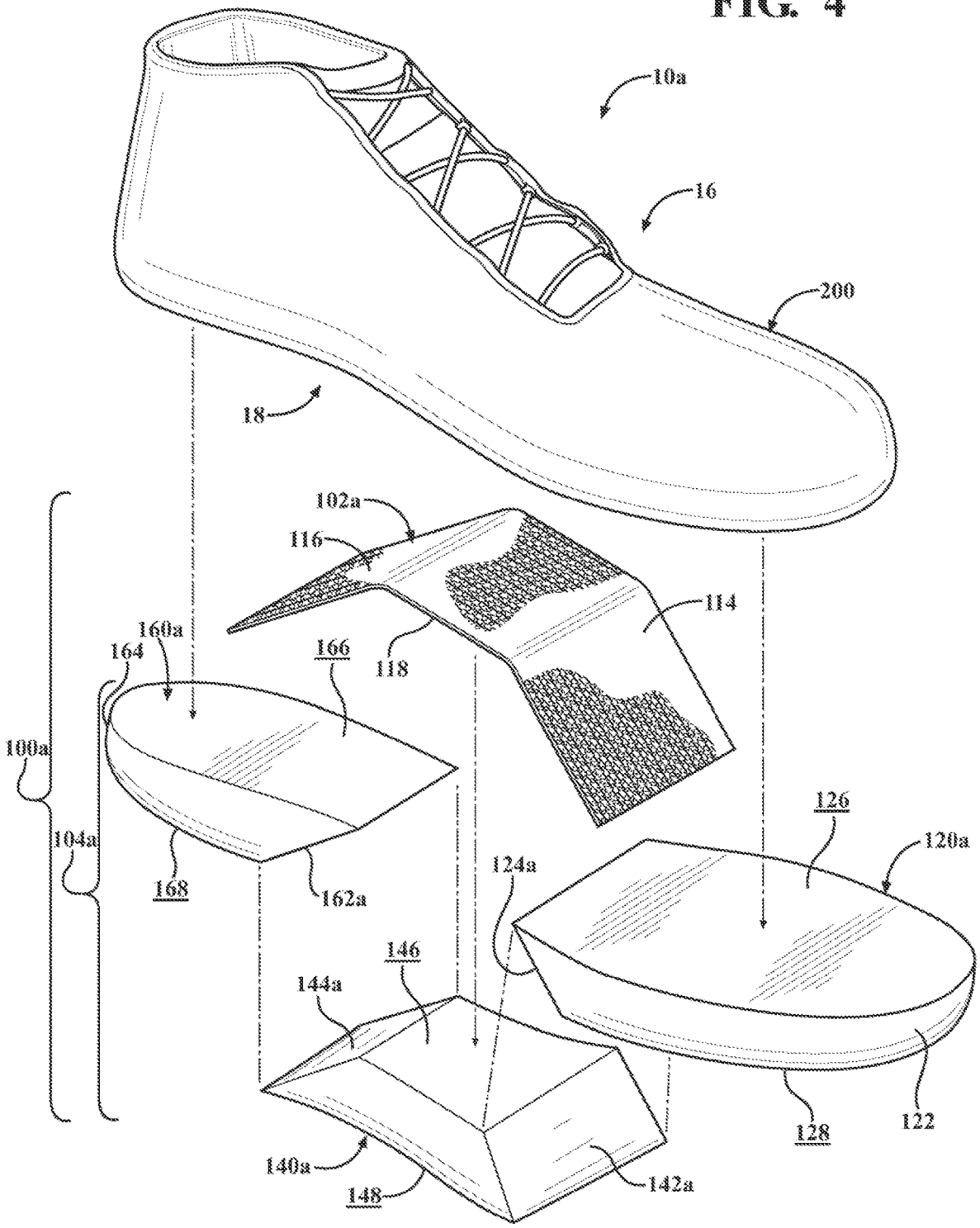

With particular reference to FIGS. 3 and 4, an article of footwear **10*a* is provided and includes a sole structure 100*a* and the upper 200 attached to the sole structure 100*a*. In view of the substantial similarity in structure and function of the components associated with the article of footwear 10 with respect to the article of footwear 10*a***, like reference numerals are used hereinafter and in the drawings to identify like components, while like reference numerals containing letter extensions are used to identify those components that have been modified.

In the example of FIGS. 3 and 4, the sole structure 100*a* includes the fabric panel 102*a* and a cushioning member 104*a*. Here, the cushioning member 104*a* includes a first cushioning element 120*a*, a second cushioning element 140*a*, and a third cushioning element 160*a* that are substantially similar to the cushioning elements 120, 140, 160 described above with respect to the article of footwear 10. Accordingly, the cushioning elements 120*a*, 140*a*, 160*a* include ends 124*a*, 142*a*, 144*a*, 162*a* that taper in the same directions as the ends 124, 142, 144, 162 of the cushioning elements 120, 140, 160 discussed above. However, the tapered ends 124*a*, 142*a*, 144*a*, 162*a* of the cushioning elements 120*a*, 140*a*, 160*a* are formed as planar surfaces and do not include the steps. Accordingly, joints 110*a*, 112*a* formed between the ends 124*a*, 142*a*, 144*a*, 162*a* are straight, and extend constantly and continuously from the footbed 106 to the ground-engaging surface 108.

Figure 5:
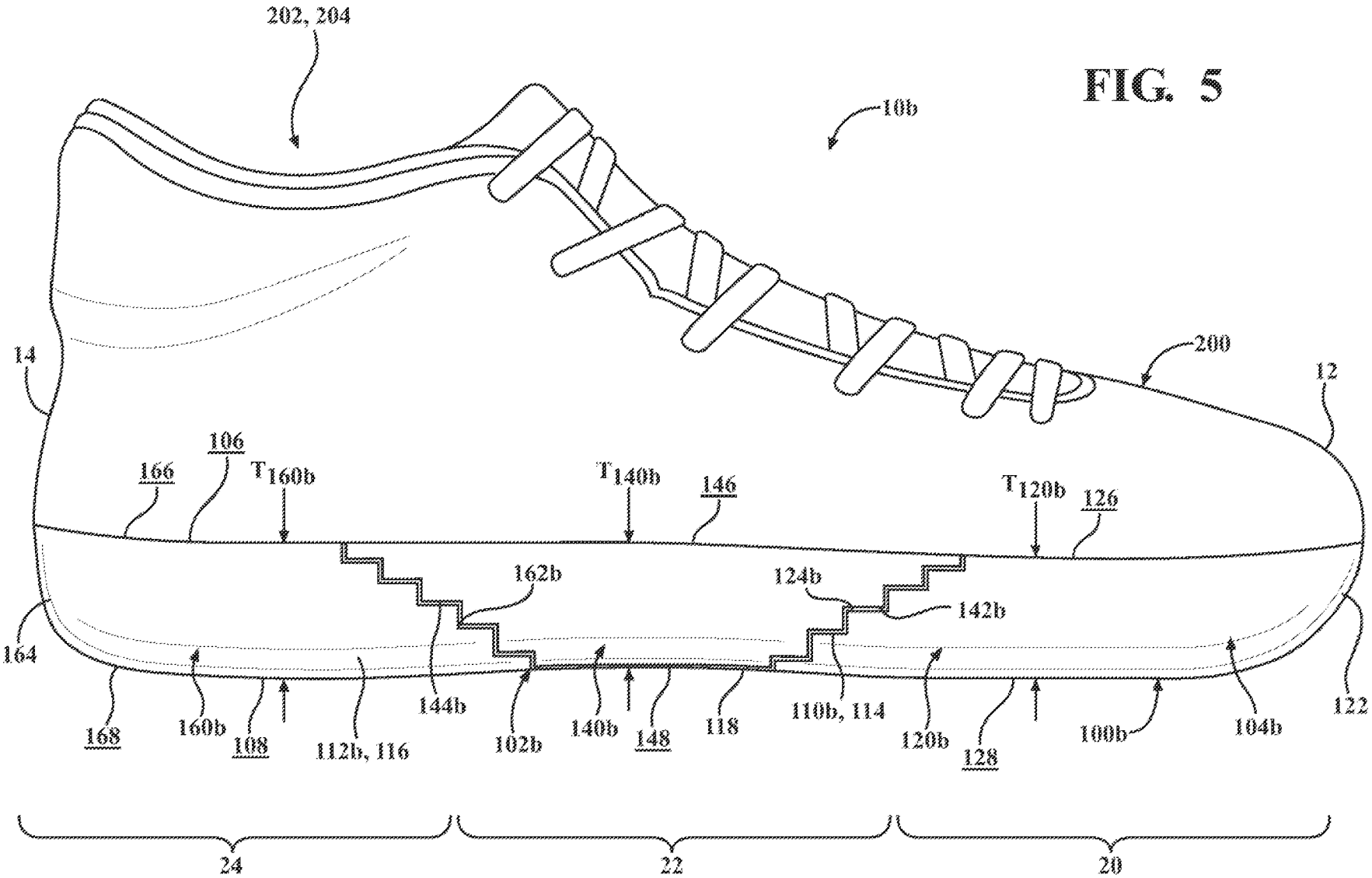
FIGS. 5 and 6 are views of an example of an article of footwear including a sole structure in accordance with the principles of the present disclosure.
Figure 6:
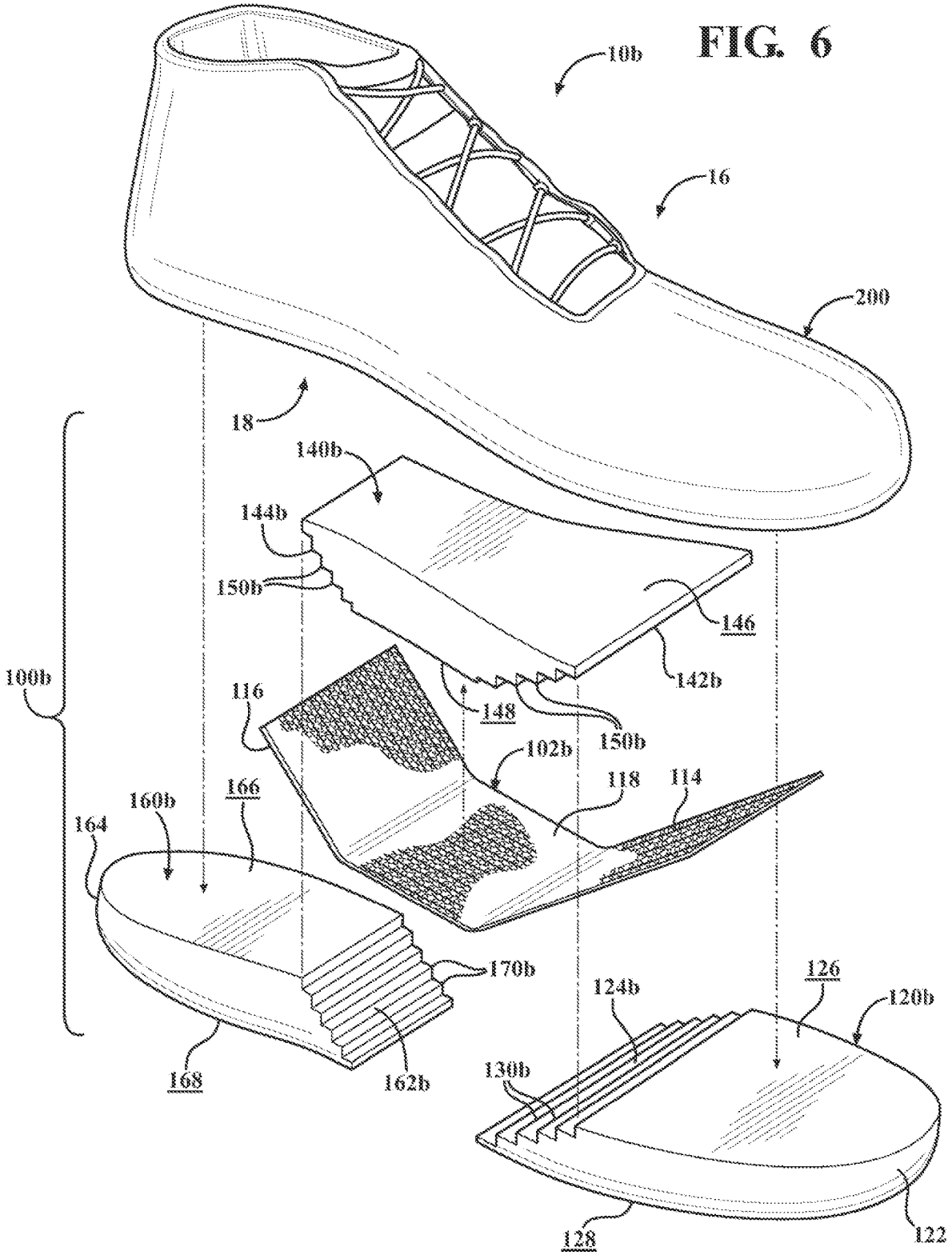

With particular reference to FIGS. 5 and 6, an article of footwear 10*b* is provided and includes a sole structure 100*b* and the upper 200 attached to the sole structure 100*b*. In view of the substantial similarity in structure and function of the components associated with the article of footwear 10 with respect to the article of footwear 10*b*, like reference numerals are used hereinafter and in the drawings to identify like components, while like reference numerals containing letter extensions are used to identify those components that have been modified.

In the example of FIGS. 5 and 6, the sole structure 100*b* includes the fabric panel 102*b* and a cushioning member 104*b*. Here, the cushioning member 104*b* includes a first cushioning element 120*b*, a second cushioning element 140*b*, and a third cushioning element 160*b*. Like the cushioning elements 120, 140, 160 of FIGS. 1 and 2, the cushioning elements 120*b*, 140*b*, 160*b* have tapered thicknesses $T_{120b}$, $T_{140b}$, $T_{160b}$ at ends 124*b*, 142*b*, 144*b*, 162*b*. Further, the tapered ends 124*b*, 142*b*, 144*b*, 162*b* of the cushioning elements 120*b*, 140*b*, 160*b* oppose each other and are joined together form respective joints 110*b*, 112*b* within the cushioning member 104*b*. The tapered ends 124*b*, 142*b*, 144*b*, 162*b* of the cushioning elements 120*b*, 140*b*, 160*b* each include a plurality of steps 130*b*, 150*b*, 170*b* arranged in series along the direction from the footbed 106 to the ground-engaging surface 108.

The cushioning elements 120*b*, 140*b*, 160*b* of the cushioning member 104*b* differ from the previously-discussed cushioning elements 120, 140, 160 in that the tapered ends 124*b*, 142*b*, 144*b*, 162*b* extend in opposite directions from the ends 124, 142, 144, 162. For example, each of the second end 124*b* of the first cushioning element 120*b* and the first end 142*b* of the second cushioning element 140*b* tapers in the second direction. In other words, each end 124*b*, 142*b* extends from the respective top surface 126, 146 to the bottom surface 128, 148 and towards the posterior end 14. Conversely, the ends 144*b*, 162*b* forming the second joint 112*b* taper in the first direction. Namely, each end 144*b*, 162*b* extends from the bottom surface 148, 168 to the top surface 146, 166 and towards the posterior end 14.

Figure 7:
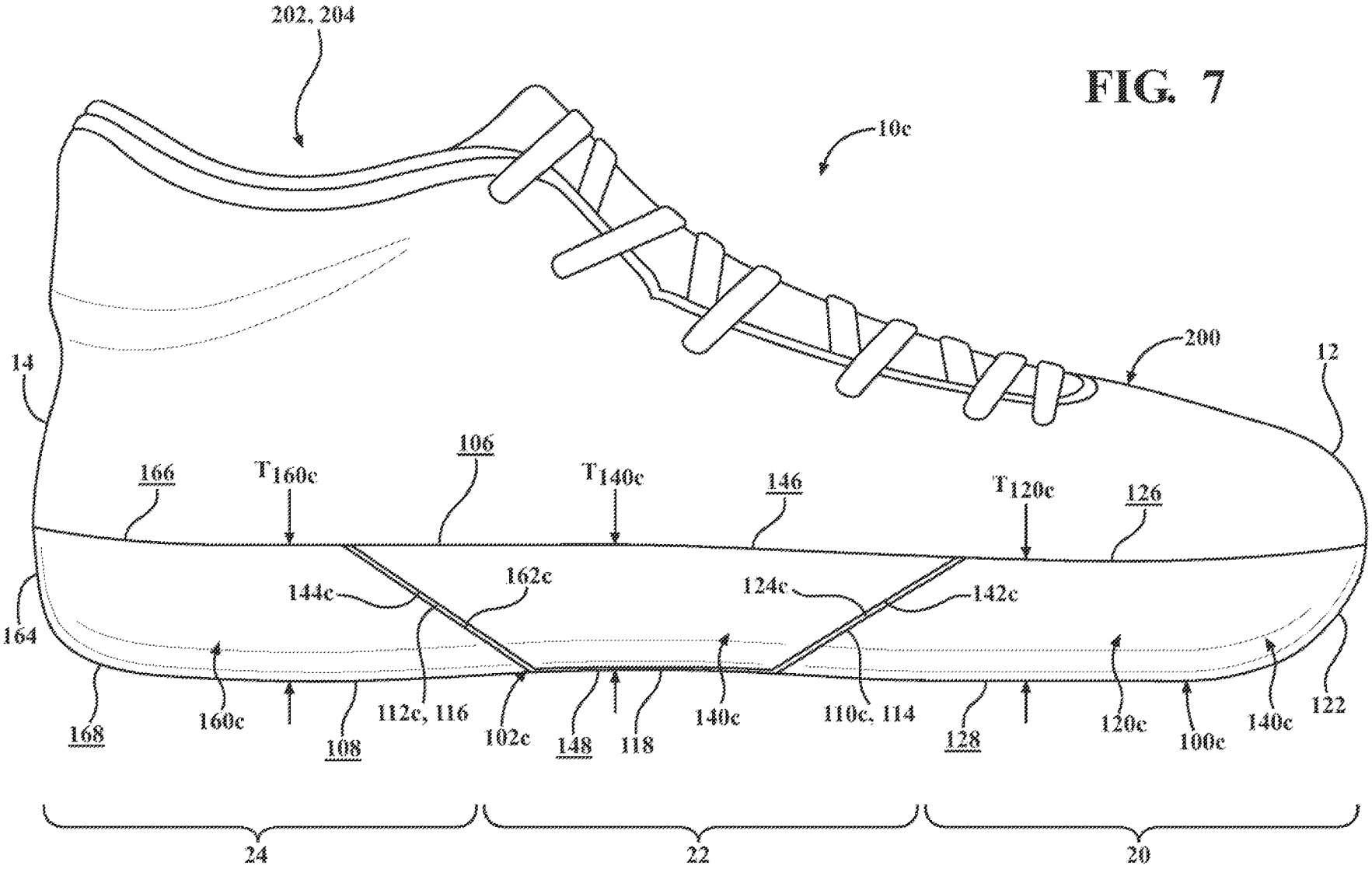
FIGS. 7 and 8 are views of one example of an article of footwear including a sole structure in accordance with the principles of the present disclosure.
Figure 8:
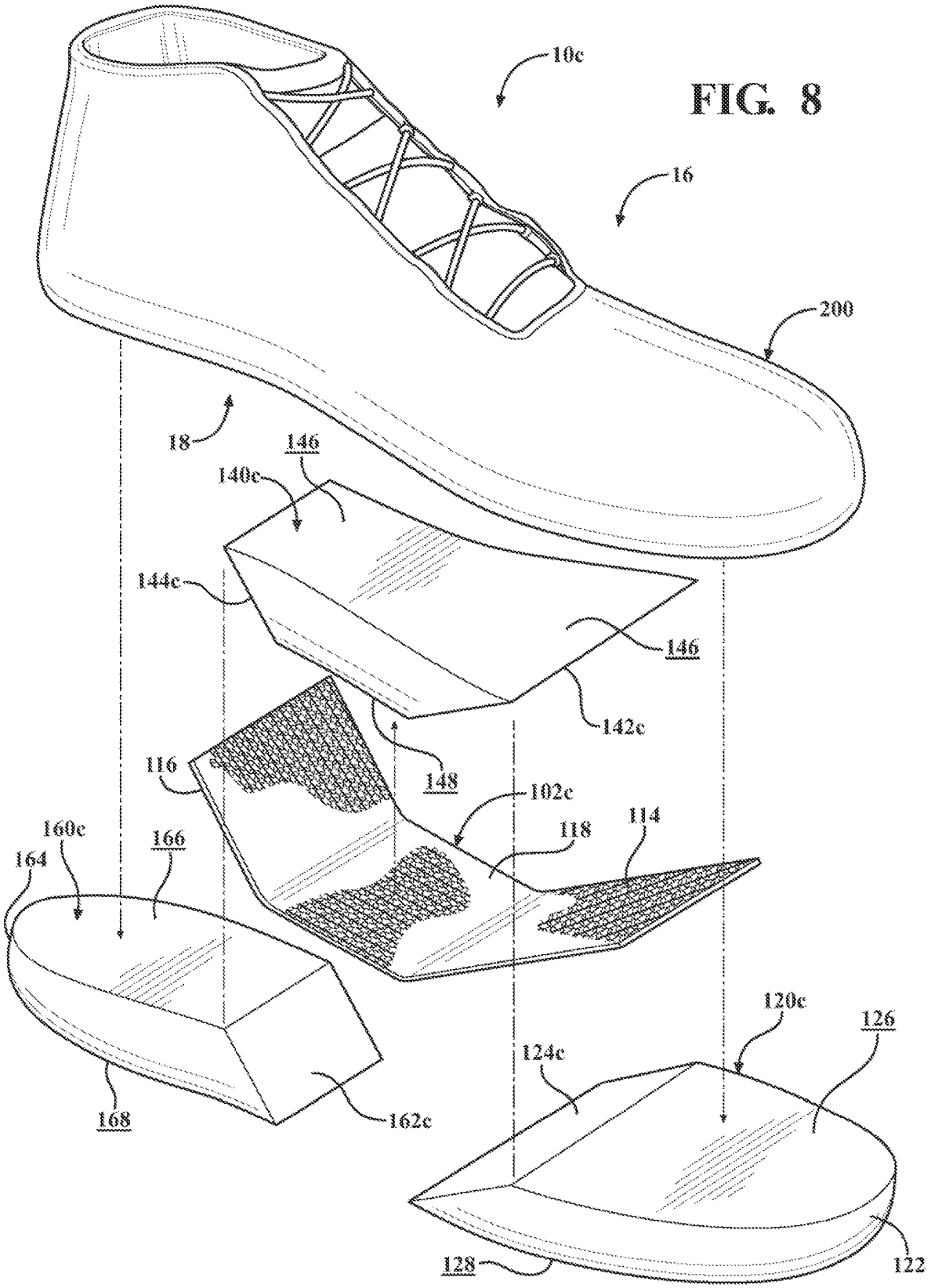

With particular reference to FIGS. 7 and 8, an article of footwear 10*c* is provided and includes a sole structure 100*c* and the upper 200 attached to the sole structure 100*c*. In view of the substantial similarity in structure and function of the components associated with the article of footwear 10 with respect to the article of footwear 10*c*, like reference numerals are used hereinafter and in the drawings to identify like components, while like reference numerals containing letter extensions are used to identify those components that have been modified.

In the example of FIGS. 7 and 8, the sole structure 100*c* includes the fabric panel 102*c* and a cushioning member 104*c*. Here, the cushioning member 104*c* includes a first cushioning element 120*c*, a second cushioning element 140*c*, and a third cushioning element 160*c* that are substantially similar to the cushioning elements 120*b*, 140*b*, 160*b* described above with respect to the article of footwear 10*b*. Accordingly, the cushioning elements 120*c*, 140*c*, 160*c* include ends 124*c*, 142*c*, 144*c*, 162*c* that taper in the same directions as the ends 124*b*, 142*b*, 144*b*, 162*b* of the cushioning elements 120*b*, 140*b*, 160*b* discussed above. However, the tapered ends 124*c*, 142*c*, 144*c*, 162*c* of the cushioning elements 120*c*, 140*c*, 160*c* are formed as planar surfaces and do not include the steps. Accordingly, joints 110*c*, 112*c* formed between the ends 124*c*, 142*c*, 144*c*, 162*c* extend constantly and continuously from the footbed 106 to the ground-engaging surface 108.

Figure 9:
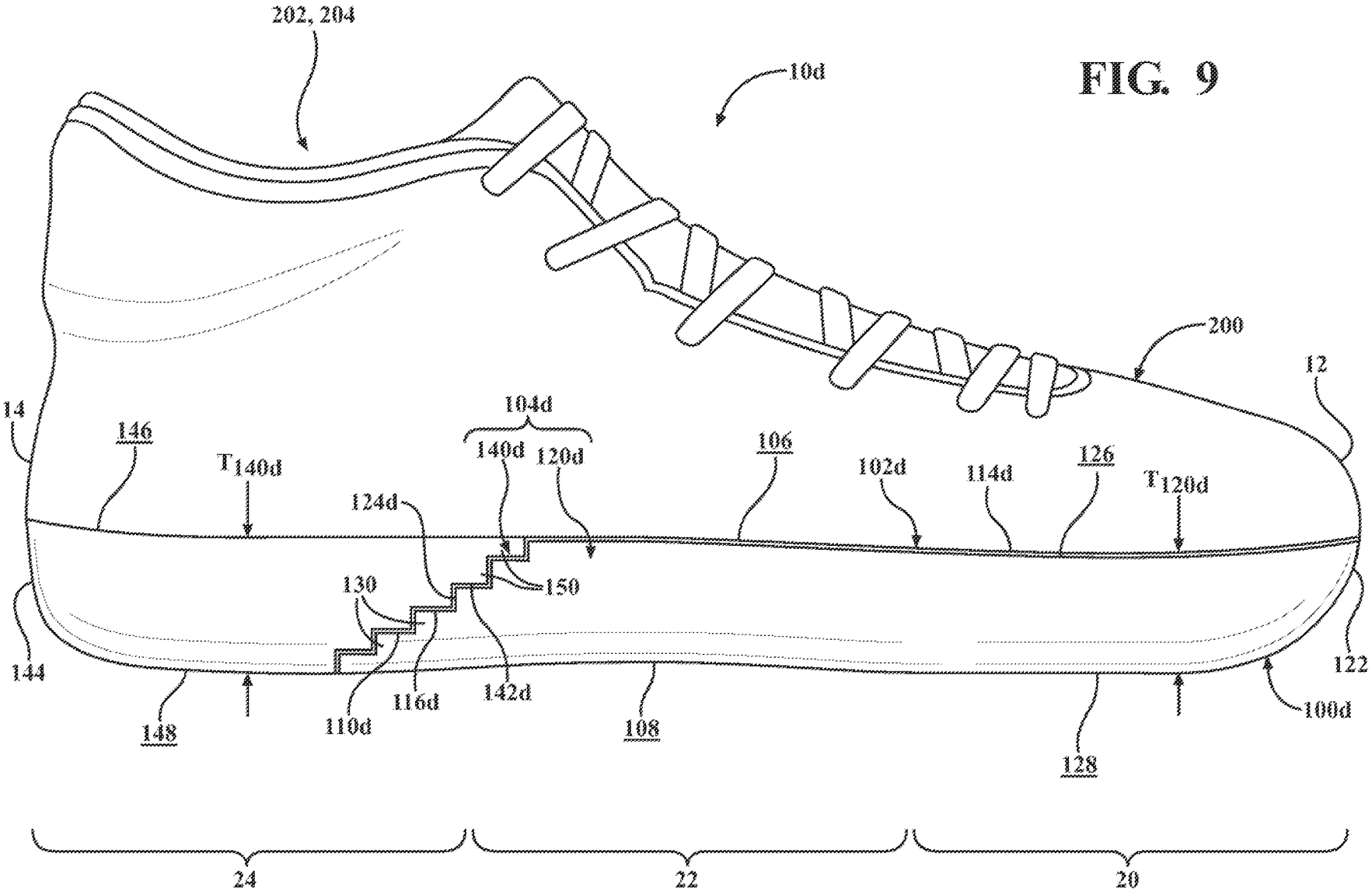
FIGS. 9 and 10 are views of another example of an article of footwear including a sole structure in accordance with the principles of the present disclosure.
Figure 10:
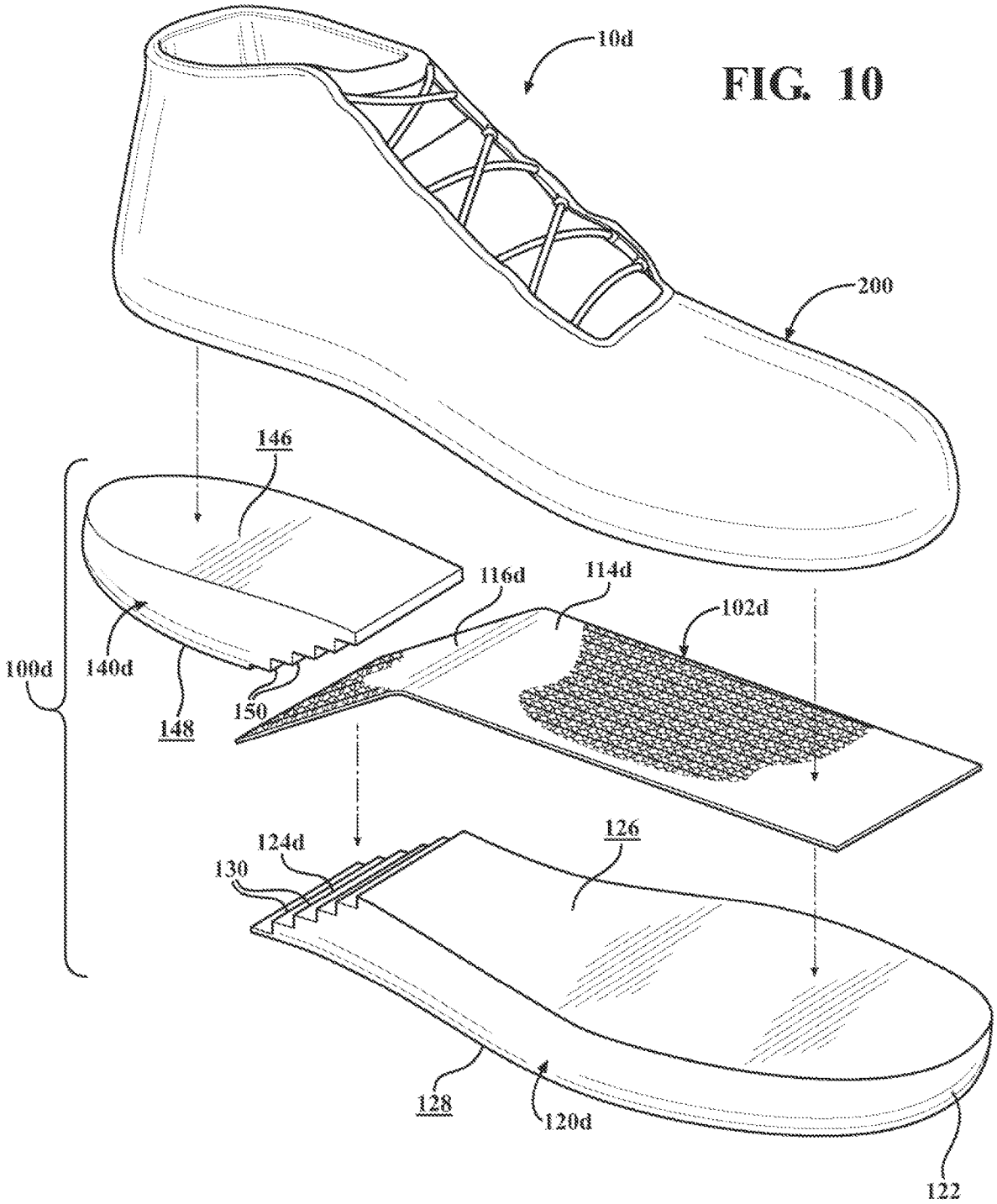

With particular reference to FIGS. 9 and 10, an article of footwear 10*d* is provided and includes a sole structure 100*d* and the upper 200 attached to the sole structure 100*d*. In view of the substantial similarity in structure and function of the components associated with the article of footwear 10 with respect to the article of footwear 10*d*, like reference numerals are used hereinafter and in the drawings to identify like components while like reference numerals containing letter extensions are used to identify those components that have been modified.

In the example of FIGS. 9 and 10, the cushioning member 104*d* includes a first cushioning element 120*d* and a second cushioning element 140*d* cooperating to form a single joint 110*d* between the mid-foot region 22 and the heel region 24. Here, the first cushioning element 120*d* extends from the first end 122 at the anterior end 12 to a second end 124*d* disposed between the mid-foot region 22 and the heel region 24. The second cushioning element 140*d* extends from a first end 142*d* joined to the second end 124*d* of the first cushioning element 120*d* between the mid-foot region 22 and the heel region 24, to a second end 144 at the posterior end 14.

A thickness $T_{120d}$ of the first cushioning element 120*d* tapers at the second end 124*d*. In the illustrated example, the thickness $T_{120d}$ of the first cushioning element 120*d* tapers in the second direction at the second end 124*d*. Here, the second end 124*d* of the first cushioning element 120*d* extends in a direction from the top surface 126 towards the bottom surface 128 and towards the posterior end 14 of the sole structure 100*d*. Accordingly, the second end 124*d* is formed at an oblique angle relative to the top surface 126 and the bottom surface 128.

The thickness $T_{140a}$ of the second cushioning element 140*d* tapers in the second direction at the first end 142*d*, such that the first end 142*d* of the second cushioning element 140*d* is complementary to (i.e., aligns against) the tapered second end 124*d* of the first cushioning element 120*d*. Here, the first end 142*d* of the second cushioning element 140*d* extends in the direction from the top surface 146 to the bottom surface 148 and towards the posterior end 14 of the sole structure 100*d*. Accordingly, the first end 142*d* is formed at an oblique angle relative to the top surface 146 and the bottom surface 148.

As shown in FIG. 9, when the sole structure 100*d* is assembled, a first portion 114*d* of the fabric panel 102*d* extends along the top surface 126 of the first cushioning element 120*d* from the first end 122 to the second end 124*d*, while a second portion 116*d* of the fabric panel 102*d* is interposed between the second end 124*d* of the first cushioning element 120*d* and the first end 142*d* of the second cushioning element 140*d* to form the joint 110*d* of the cushioning member 104*d*. Here, the ends 124*d*, 142*d* of the cushioning elements 120*d*, 140*d* each include respective pluralities of the steps 130, 150 arranged in series along the direction from the top surface 126, 146 to the bottom surface 128, 148. Accordingly, the cushioning member 104*d* is formed with a stepped joint 110*d* extending from the footbed 106 to the ground-engaging surface 108 when the cushioning elements 120*d*, 140*d* and the fabric panel 102*d* are assembled.

Figure 11:
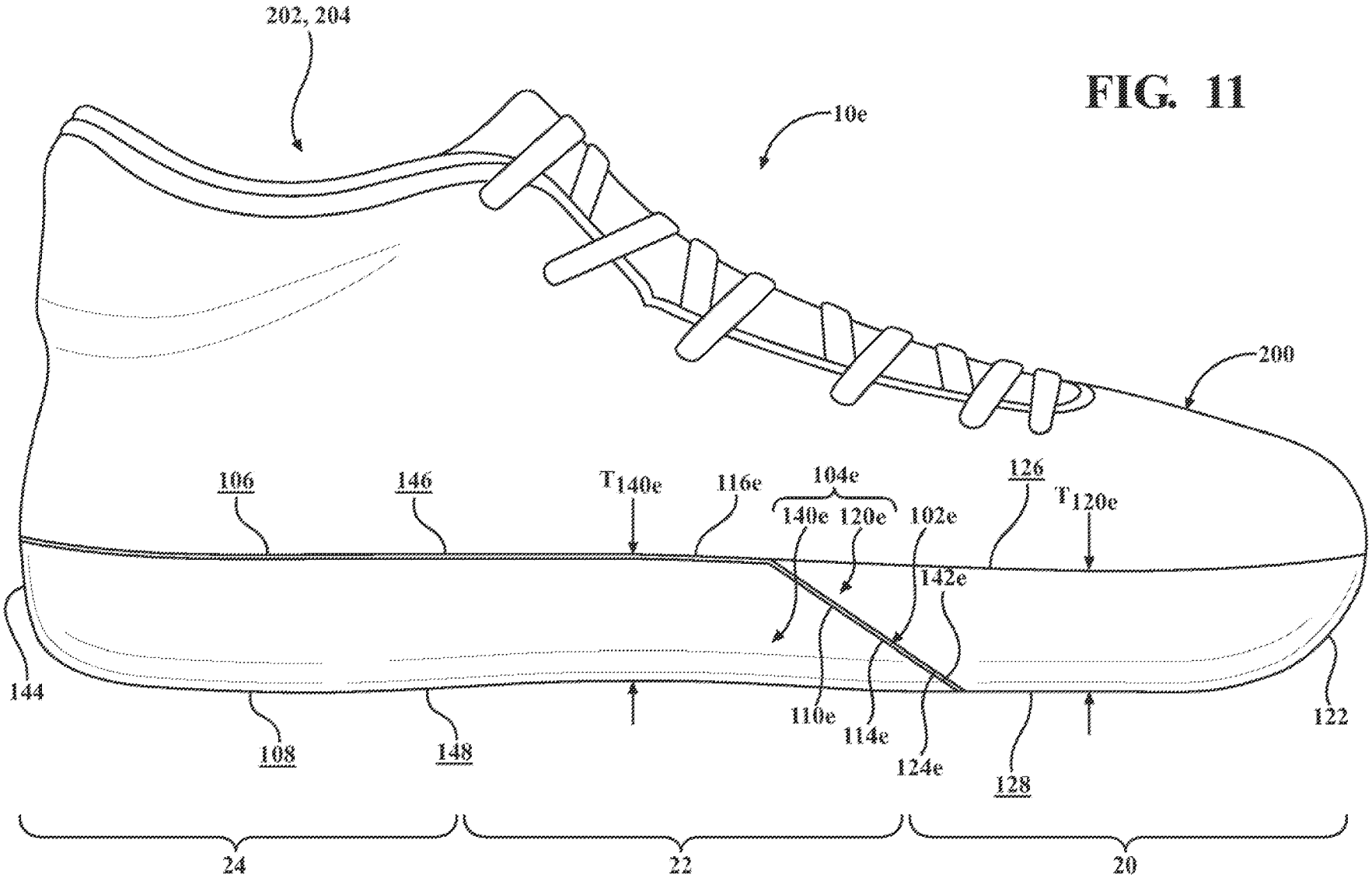
FIGS. 11 and 12 are views of yet another example of an article of footwear including a sole structure in accordance with the principles of the present disclosure.
Figure 12:
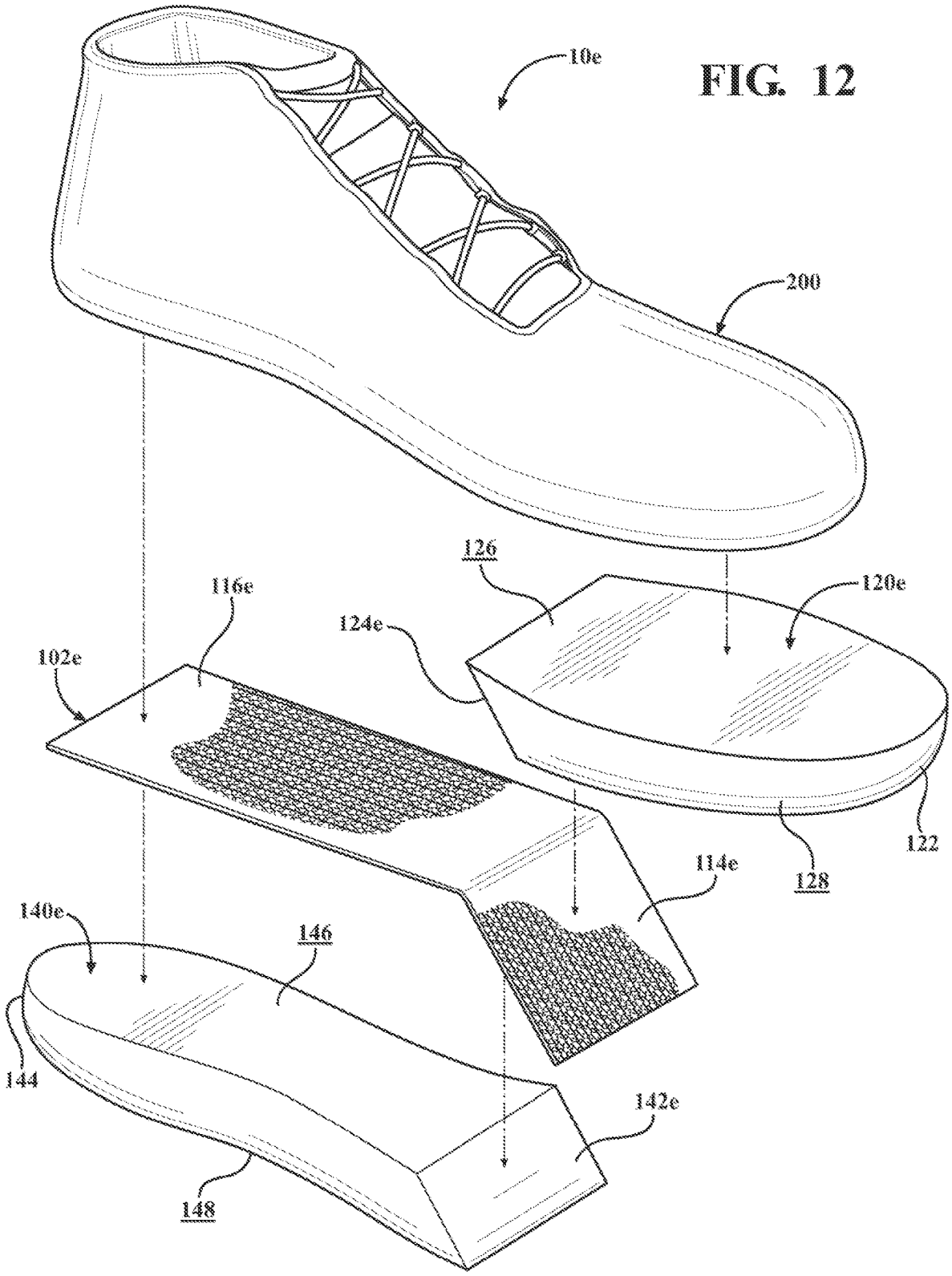

With particular reference to FIGS. 11 and 12, an article of footwear 10*e* is provided and includes a sole structure 100*e* and the upper 200 attached to the sole structure 100*e*. In view of the substantial similarity in structure and function of the components associated with the article of footwear 10 with respect to the article of footwear 10*e*, like reference numerals are used hereinafter and in the drawings to identify like components, while like reference numerals containing letter extensions are used to identify those components that have been modified.

In the example of FIGS. 11 and 12, the sole structure 100*e* includes a fabric panel 102*e* and a cushioning member 104*e*. The cushioning member 104*e* includes a first cushioning element 120*e* and a second cushioning element 140*e* cooperating to form a single joint 110*e* between the forefoot region 20 and the mid-foot region 22. Here, the first cushioning element 120*e* extends from the first end 122 at the anterior end 12 to a second end 124*e* disposed between the forefoot region 20 and the mid-foot region 22. The second cushioning element 140*e* extends from a first end 142*e* joined to the second end 124*e* of the first cushioning element 120*e* between the forefoot region 20 and the mid-foot region 22, to a second end 144 at the posterior end 14.

A thickness $T_{120e}$ of the first cushioning element 120*e* tapers at the second end 124*e*. In the illustrated example, the thickness $T_{120e}$ of the first cushioning element 120*e* tapers in the first direction at the second end 124*e*. Here, the second end 124*e* of the first cushioning element 120*e* extends in a direction from the bottom surface 128 towards the top surface 126 and towards the posterior end 14 of the sole structure 100*e*. Accordingly, the second end 124*e* is formed at an oblique angle relative to the top surface 126 and the bottom surface 128.

The thickness $T_{140e}$ of the second cushioning element 140*e* tapers in the first direction at the first end 142*e*, such that the first end 142*e* of the second cushioning element 140*d* is complementary to (i.e., aligns against) the tapered second end 124*e* of the first cushioning element 120*e*. Here, the first end 142*e* of the second cushioning element 140*e* extends in the direction from the bottom surface 148 to the top surface 146 and towards the posterior end 14 of the sole structure 100*e*. Accordingly, the first end 142*e* is formed at an oblique angle relative to the top surface 146 and the bottom surface 148.

As shown in FIG. 11, when the sole structure 100*e* is assembled, a first portion 114*e* of the fabric panel 102*e* is interposed between the second end 124*e* of the first cushioning element 120*e* and the first end 142*e* of the second cushioning element 140*e* to form the joint 110*e* of the cushioning member 104*e*, while a second portion 116*e* of the fabric panel 102*e* extends along the top surface 146 of the second cushioning element 140*e* from the first end 142*e* to the second end 144. Here, the ends 124*e*, 142*e* of the cushioning elements 120*e*, 140*e* are formed as planar surfaces. Accordingly, the cushioning member 104*e* is formed with a straight joint 110*e* extending from the footbed 106 to the ground-engaging surface 108 when the cushioning elements 120*e*, 140*e* and the fabric panel 102*e* are assembled.

Figure 13:
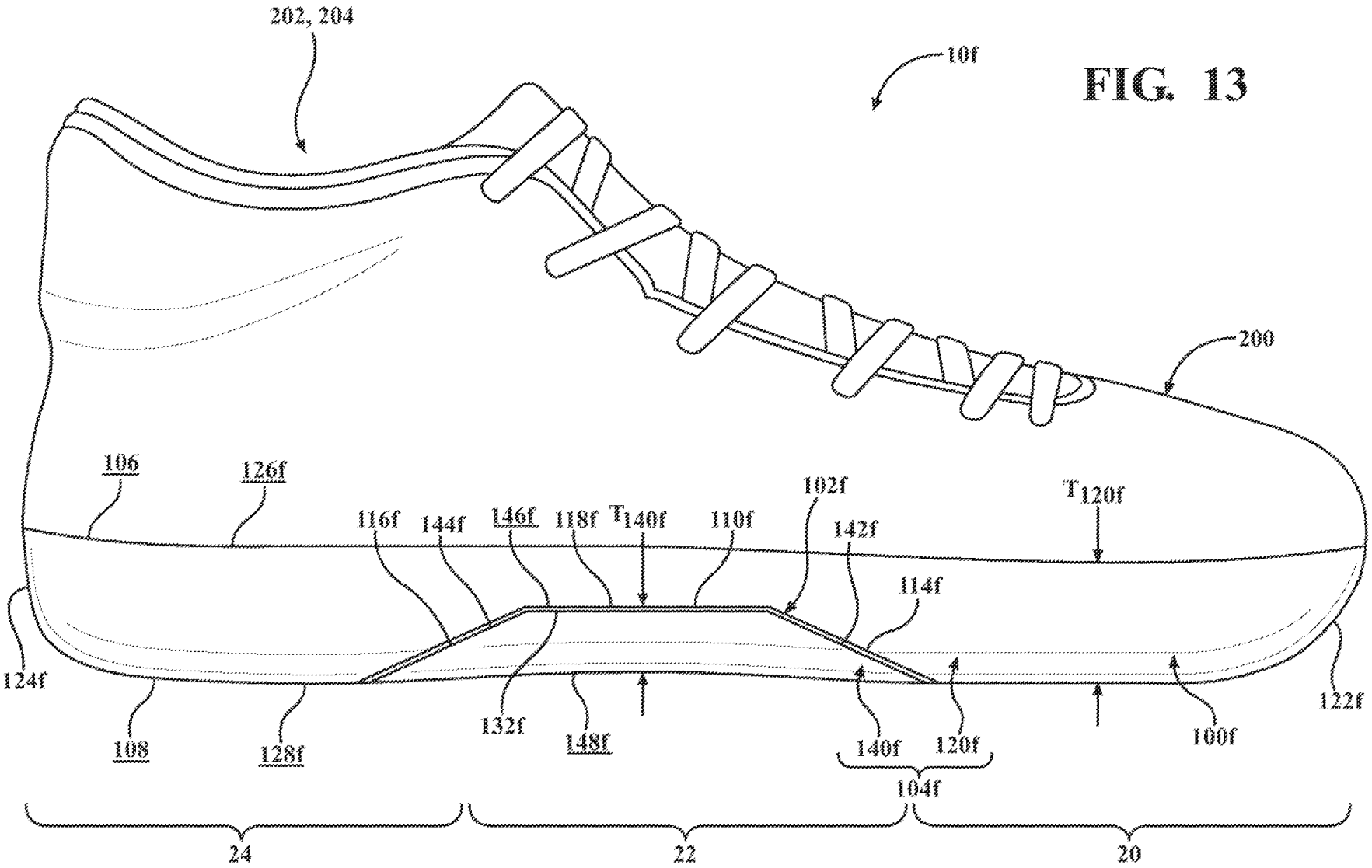
FIGS. 13 and 14 are views of an example of an article of footwear including a sole structure in accordance with the principles of the present disclosure.
Figure 14:
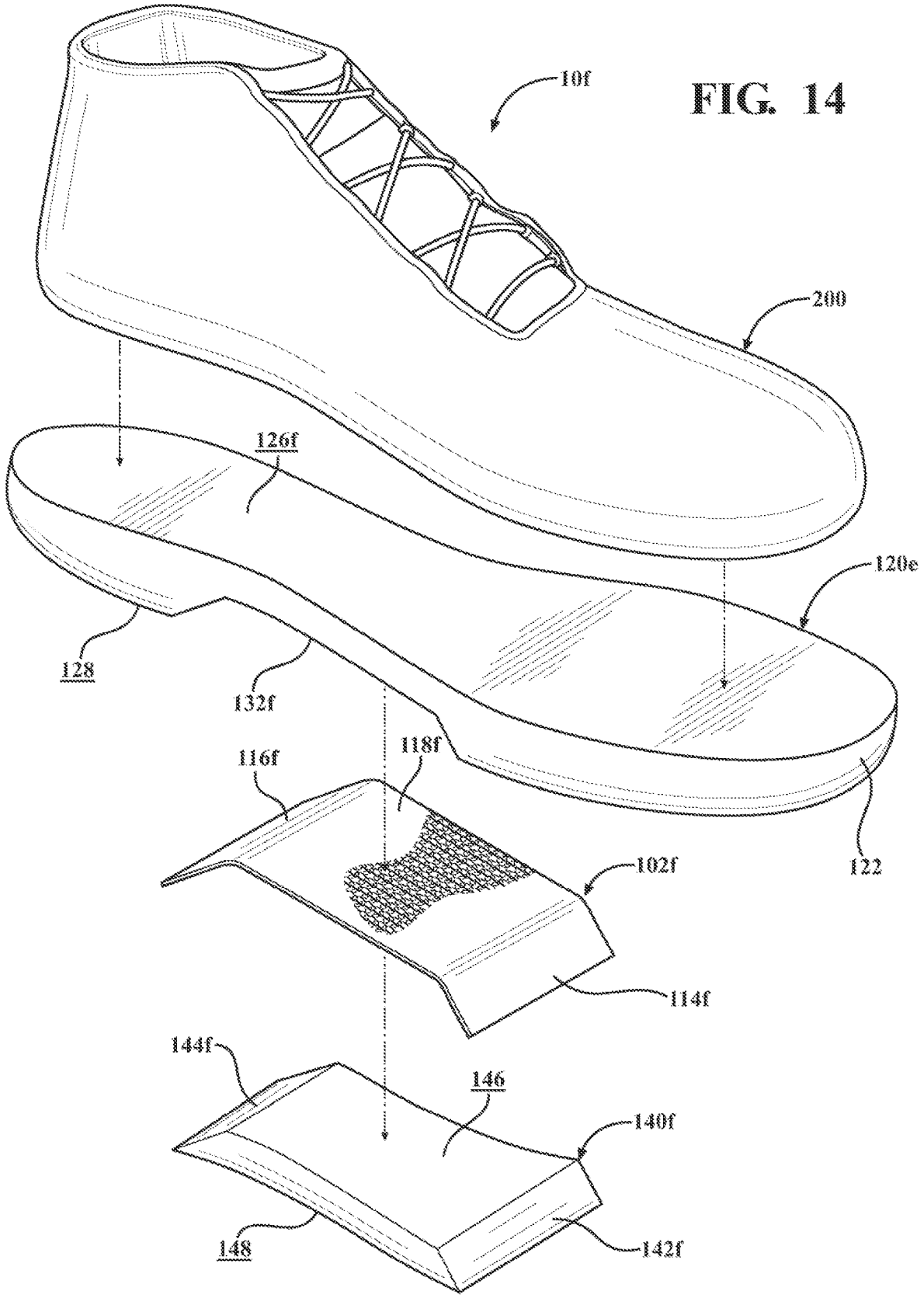

With particular reference to FIGS. 13 and 14, an article of footwear 10*f* is provided and includes a sole structure 100*f* and the upper 200 attached to the sole structure 100*f*. In view of the substantial similarity in structure and function of the components associated with the article of footwear 10 with respect to the article of footwear 10*f*, like reference numerals are used hereinafter and in the drawings to identify like components, while like reference numerals containing letter extensions are used to identify those components that have been modified.

In the example of FIGS. 13 and 14, the sole structure 100*f* includes a fabric panel 102*f* and a cushioning member 104*f*. The cushioning member 104*f* includes a first cushioning element 120*f* and a second cushioning element 140*f* received within a lower portion of the first cushioning element 120*f*. As explained below, the first cushioning element 120*f* and the second cushioning element 140*f* cooperate with the fabric panel 102*f* to form a joint 110*f* in an intermediate portion of the cushioning member 104*f*.

As shown in FIGS. 13 and 14, the first cushioning element 120*f* extends continuously along the entire length of the sole structure 100*f* from a first end 122*f* at the anterior end 12 to a second end 124*f* at the posterior end 14. Here, the top surface 126*f* of the first cushioning element 120*f* is continuous and uninterrupted from the first end 122*f* to the second end 124 and defines the footbed 106 of the cushioning member 104*f*. However, the bottom surface 128*f* of the first cushioning element 120*f* includes a receptacle 132*f* configured to receive the second cushioning element 140*f* therein. As shown, the receptacle 132*f* extends continuously through a width of the first cushioning element 120*f*, from the lateral side 16 to the medial side 18. Here, the receptacle 132 has a plurality of sides defining a polygonal cross section corresponding to a shape of the second cushioning element 140*f*, as discussed below.

The second cushioning element 140*f* extends from a first end 142*f* to a second end 144*f*, and includes a top surface 146*f* and a bottom surface 148*f* formed on an opposite side from the top surface 146*f*. As shown, the top surface 146*f* and the bottom surface 148*f* are substantially parallel to each other. A thickness $T_{140f}$ of the second cushioning element 140*f* is measured along a direction from the top surface 146*f* to the bottom surface 148*f*, and tapers at each of the first end 142*f* and the second end 144*f*. The first end 142*f* of the second cushioning element 140*f* tapers in the first direction such that the first end 142*f* extends from the bottom surface 148*f* to the top surface 146*f* and towards the posterior end 14. The second end 144*f* of the second cushioning element 140*f* tapers in the second direction such that the second end 144*f* extends from the top surface 146*f* to the bottom surface 148*f* and towards the posterior end 14. Accordingly, the second cushioning element 140*f* has a trapezoidal cross section extending across a width of the sole structure 100*f*.

As set forth above, the second cushioning element 140*f* is configured to be received within the receptacle 132*f* formed in the bottom portion of the first cushioning element 120*f*. As shown, the receptacle 132*f* and the second cushioning element 140*f* are disposed within the mid-foot region such that the first end 142*f* of the second cushioning element 140*f* is disposed adjacent to the forefoot region 20 and the second end 144*f* of the second cushioning element 140*f* is disposed adjacent to the heel region 24.

The receptacle 132*f* is partially formed through the thickness $T_{120f}$ of the first cushioning element 120*f* from the bottom surface 128*f*. Similarly, the maximum thickness $T_{140f}$ of the second cushioning element 140*f*, measured from the top surface 146*f* to the bottom surface 148*f*, is less than the maximum thickness $T_{120f}$ of the first cushioning element 120*f*. Accordingly, when the second cushioning element 140*f* is disposed within the receptacle 132*f*, the top surface 146*f* of the second cushioning element is positioned between the top surface 126*f* and the bottom surface 128*f* of the first cushioning element 120*f*, while the bottom surface 148*f* of the second cushioning element 140*f* is flush with the bottom surface 128*f* of the first cushioning element 120*f*. As such, the bottom surfaces 128*f*, 148*f* cooperate to form the ground-engaging surface 108 of the sole structure 100*f*.

When the sole structure 100*f* is assembled, the fabric panel 102*f* is interposed between the second cushioning element 140*f* and the receptacle 132*f* to form a first joint 110*f* of the sole structure 100*f*. Particularly, the fabric panel 102*f* includes a first portion 114*f* disposed between the first end 142*f* of the second cushioning element 144*f* and a first side of the receptacle 132*f*, a second portion 116*f* disposed between the second end 144 of the second cushioning element 144*f* and a second side of the receptacle 132*f*, and a third portion 118*f* connecting the first portion 114*f* and the second portion 116*f* and disposed between the top surface 146*f* of the second cushioning element 140*f* and a third side of the receptacle 132.

Figure 15:
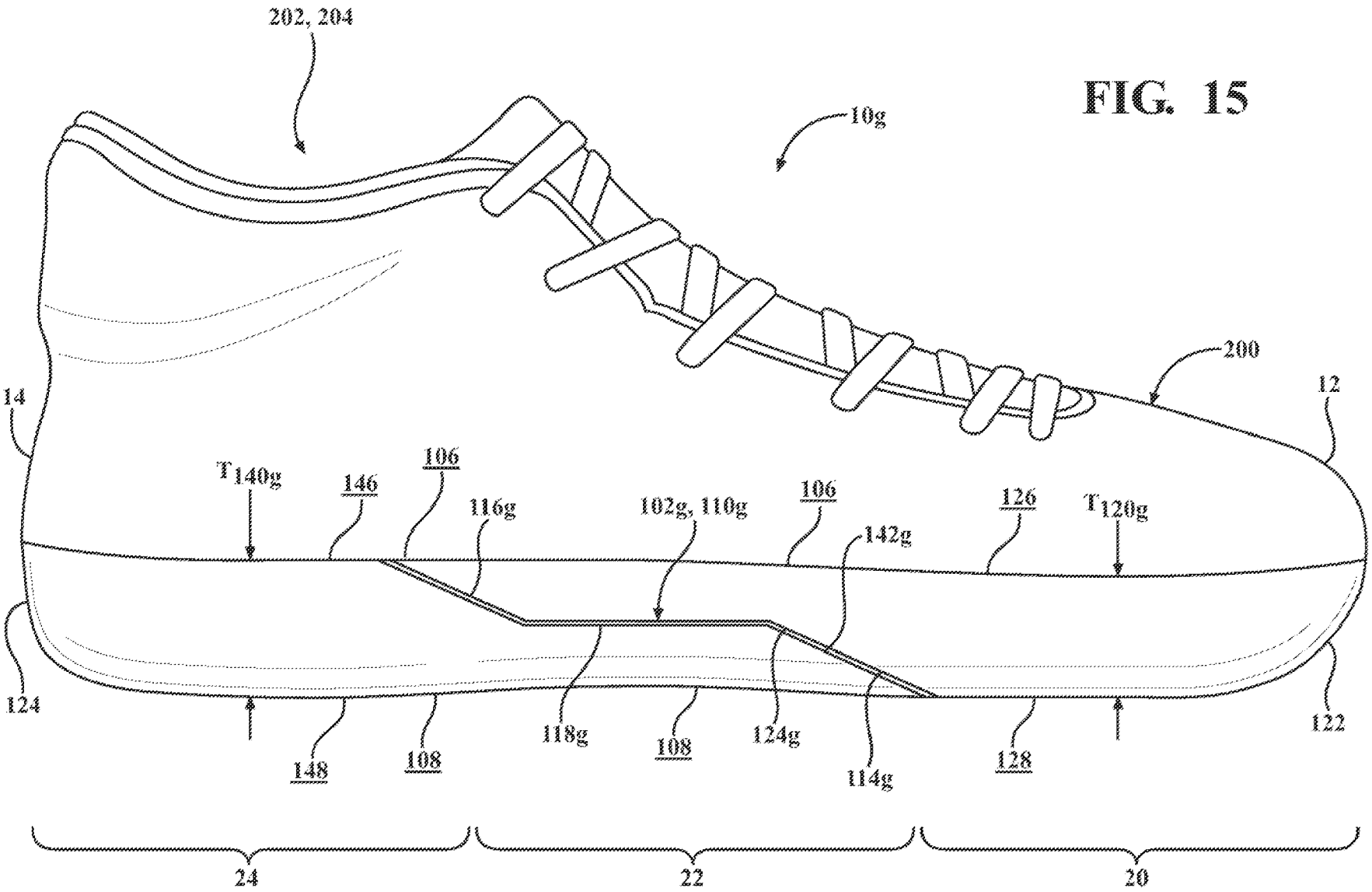
FIGS. 15 and 16 are views of another example of an article of footwear including a sole structure in accordance with the principles of the present disclosure.
Figure 16:
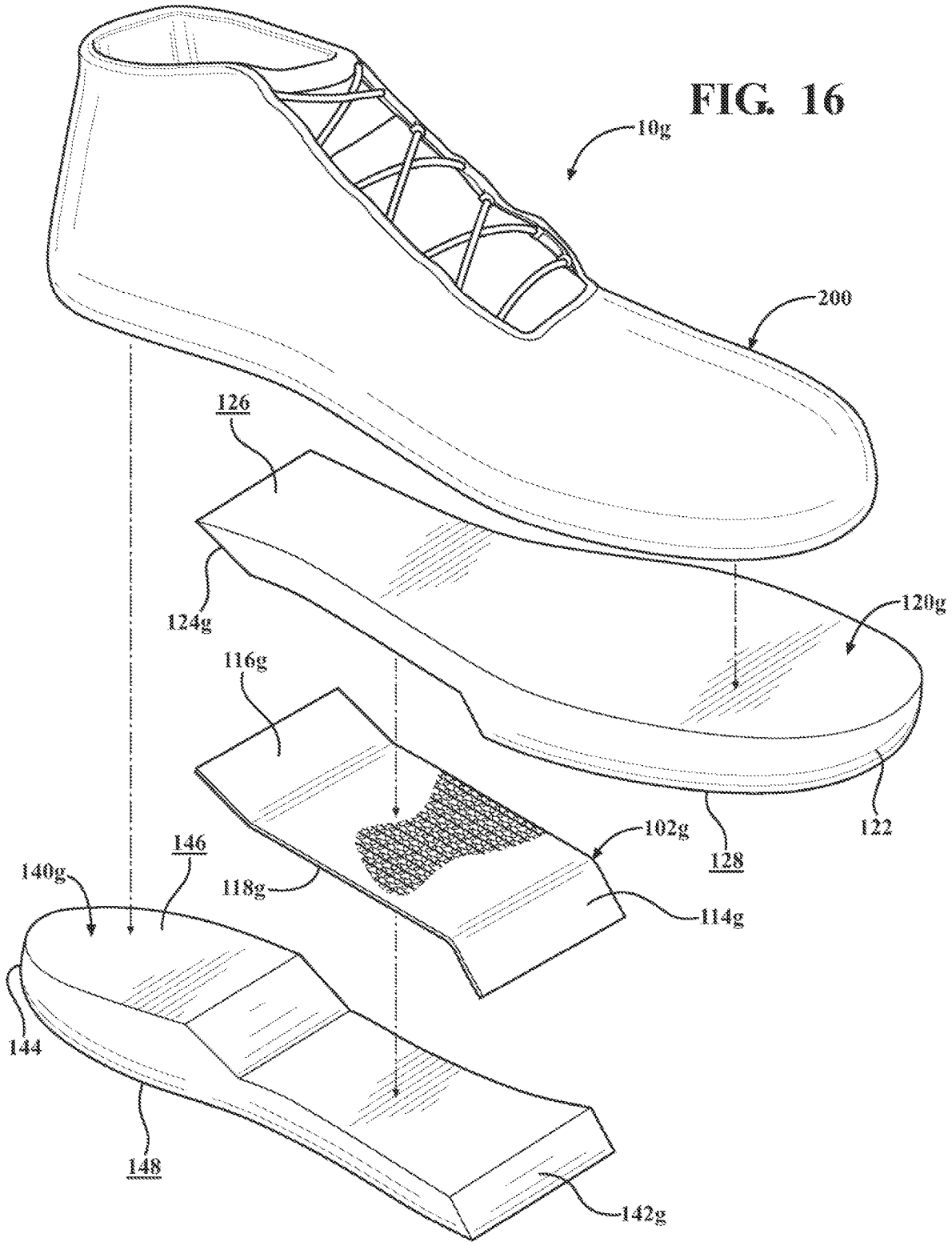

With particular reference to FIGS. 15 and 16, an article of footwear 10*g* is provided and includes a sole structure 100*g* and the upper 200 attached to the sole structure 100*g*. In view of the substantial similarity in structure and function of the components associated with the article of footwear 10 with respect to the article of footwear 10*g*, like reference numerals are used hereinafter and in the drawings to identify like components, while like reference numerals containing letter extensions are used to identify those components that have been modified.

In the example of FIGS. 15 and 16, the sole structure 100*g* includes a fabric panel 102*g* and a cushioning member 104*g*. The cushioning member 104*g* includes a first cushioning element 120*g* disposed adjacent to the anterior end 12 and a second cushioning element 140*g* disposed adjacent to the posterior end 14. As discussed below, the first cushioning element 120*g* and the second cushioning element 140*g* cooperate with the fabric panel 102*g* to form a joint 110*g* extending incrementally from the ground-engaging surface 108 to the footbed 106 along the mid-foot region 22.

The first cushioning element 120*g* extends from the first end 122 at the anterior end 12 to a second end 124*g* in the mid-foot region 22. As shown, the first cushioning element 120*g* includes a top surface 126 forming a portion of the footbed 106 in the forefoot region 20 and the mid-foot region 22, and a bottom surface 128 formed on an opposite side from the top surface 126 and forming a portion of the ground-engaging surface 108 in the forefoot region 20. Accordingly, the top surface 126 extends farther from the first end 122 than the bottom surface 128.

A thickness $T_{120g}$ of the first cushioning element 120*g*, measured along a direction from the top surface 126 to the bottom surface 128, incrementally tapers at the second end 124*g*. Thus, unlike previous examples, where the ends of the cushioning elements taper continuously, the thickness $T_{120g}$ of the first cushioning element 120*g* tapers in the first direction along a first portion of the second end 124*g* extending from the bottom surface 128 at the forefoot region 20. The thickness $T_{120g}$ then remains constant along an intermediate portion of the second end 124*g*, and then tapers again in the first direction along a third portion of the second end 124*g* extending to the top surface 126 at the heel region 24. Here, the intermediate portion of the second end 124*g* is parallel to the top surface 126 and the bottom surface 128, while the first portion and the third portion are parallel to each other and formed at oblique angles relative to the top surface 126 and the bottom surface 128.

The second cushioning element 140*g* extends from a first end 142*g* adjacent to and facing the second end 124*g* of the first cushioning element 120*g* to a second end 144 at the posterior end 14. Accordingly, the first end 142*g* of the second cushioning element 140*g* has a complementary profile to the second end 124*g* of the first cushioning element 120*g*, such that a thickness $T_{140g}$ of the second cushioning element 140*g* incrementally increases at the first end 142*g*. Particularly, the thickness $T_{140g}$ of the second cushioning element 140*g* increases in the first direction along a first portion of the first end 142*g* extending from the bottom surface 148 at the forefoot region 20. The thickness $T_{14og}$ then remains constant along an intermediate portion of the first end 142*g*, and then increases again in the first direction along a third portion of the first end 142*g* extending to the top surface 146 at the heel region 24.

When the sole structure 100*g* is assembled, the portions of the second end 124*g* of the first cushioning element 120*g* are joined with the corresponding portions of the first end 142*g* of the second cushioning element 140*g* to form the joint 110*g* extending from the footbed 106 to the ground-engaging surface 108. The fabric panel 102*g* is interposed between second end 124*g* of the first cushioning element 120*g* and the first end 142*g* of the second cushioning element 140*g*. Particularly, the fabric panel 102*g* includes a first portion 114*g* interposed between the first portions of the tapered ends 124*g*, 142*g*, a second portion 116*g* interposed between the third portions of the tapered ends 124*g*, 142*g*, and a third portion 118*g* connecting the first portion 114*g* and the second portion 116*g* and disposed between intermediate portions of the tapered ends 124*g*, 142*g*.

Figure 17:
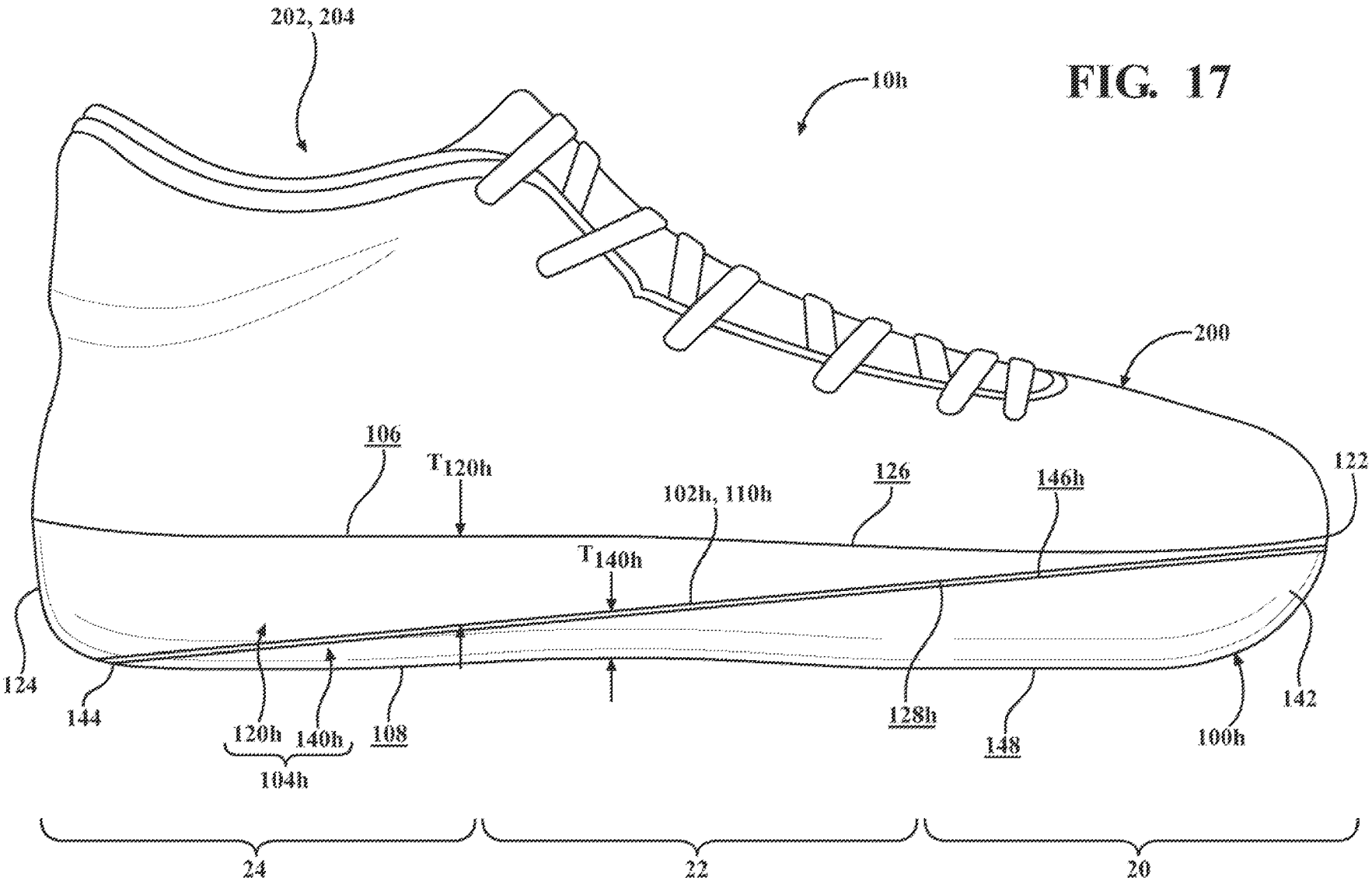
FIGS. 17 and 18 are views of another example of an article of footwear including a sole structure in accordance with the principles of the present disclosure.
Figure 18:
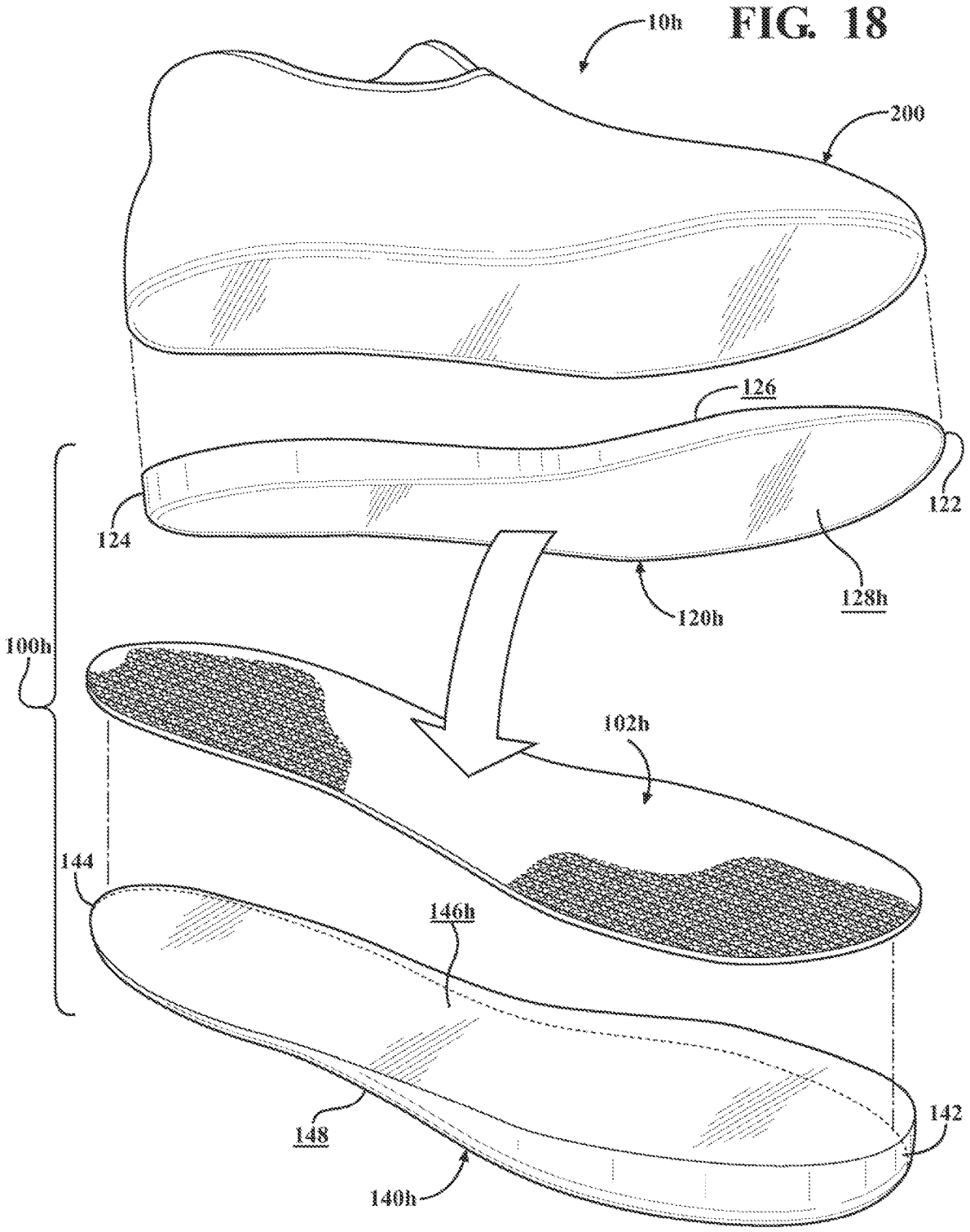

With particular reference to FIGS. 17 and 18, an article of footwear 10*h* is provided and includes a sole structure 100*h* and the upper 200 attached to the sole structure 100*h*. In view of the substantial similarity in structure and function of the components associated with the article of footwear 10 with respect to the article of footwear 10*h*, like reference numerals are used hereinafter and in the drawings to identify like components, while like reference numerals containing letter extensions are used to identify those components that have been modified.

In the example of FIGS. 17 and 18, the sole structure 100*h* includes a fabric panel 102*h* and a cushioning member 104*h*. The cushioning member 104*h* includes a first cushioning element 120*h* extending continuously from the anterior end 12 to the posterior end 14 and a second cushioning element 140*h* disposed beneath the first cushioning element 120*h* and extending from the anterior end 12 to the posterior end 14. As discussed below, the first cushioning element 120*h* and the second cushioning element 140*h* cooperate with the fabric panel 102*h* to form a joint 110*h* extending continuously from the anterior end 12 to the posterior end 14.

The first cushioning element 120*h* extends from the first end 122 at the anterior end 12 to a second end 124 at the posterior end 14. As shown, the first cushioning element 120*h* includes a top surface 126 forming the footbed 106 and a bottom surface 128*h* formed on an opposite side from the top surface 126. A thickness $T_{120h}$ of the first cushioning element 120*h*, measured along a direction from the top surface 126 to the bottom surface 128*h* increases constantly and continuously along a direction from the first end 122 to the second end 124.

The second cushioning element 140*h* extends from the first end 142 at the anterior end 12 to a second end 144 at the posterior end 14. As shown, the second cushioning element 140*h* includes a top surface 146*h* facing the bottom surface 128*h* of the first cushioning element 120*h* and a bottom surface 148 formed on an opposite side from the top surface 146*h*. The bottom surface 148 of the second cushioning element 140*h* forms the ground-engaging surface 108 of the sole structure 100*h*. A thickness $T_{140h}$ of the second cushioning element 140*h*, measured along a direction from the top surface 146*h* to the bottom surface 148 tapers constantly and continuously along a direction from the first end 122 to the second end 124.

When the sole structure 100*h* is assembled, the bottom surface 128*h* of the first cushioning element 120*h* is joined to the top surface 146*h* of the second cushioning element 140*h* to form the joint 110*h* extending continuously from the anterior end 12 to the posterior end 14. The fabric panel 102*h* is interposed between the bottom surface 128*h* of the first cushioning element 120*h* and the top surface 146*h* of the second cushioning element 140*h*. Accordingly, the first joint 110*h* and the fabric panel 102*h* extend continuously from the anterior end 12 to the posterior end 14 and from the footbed 106 to the ground-engaging surface 108.

Figure 19:
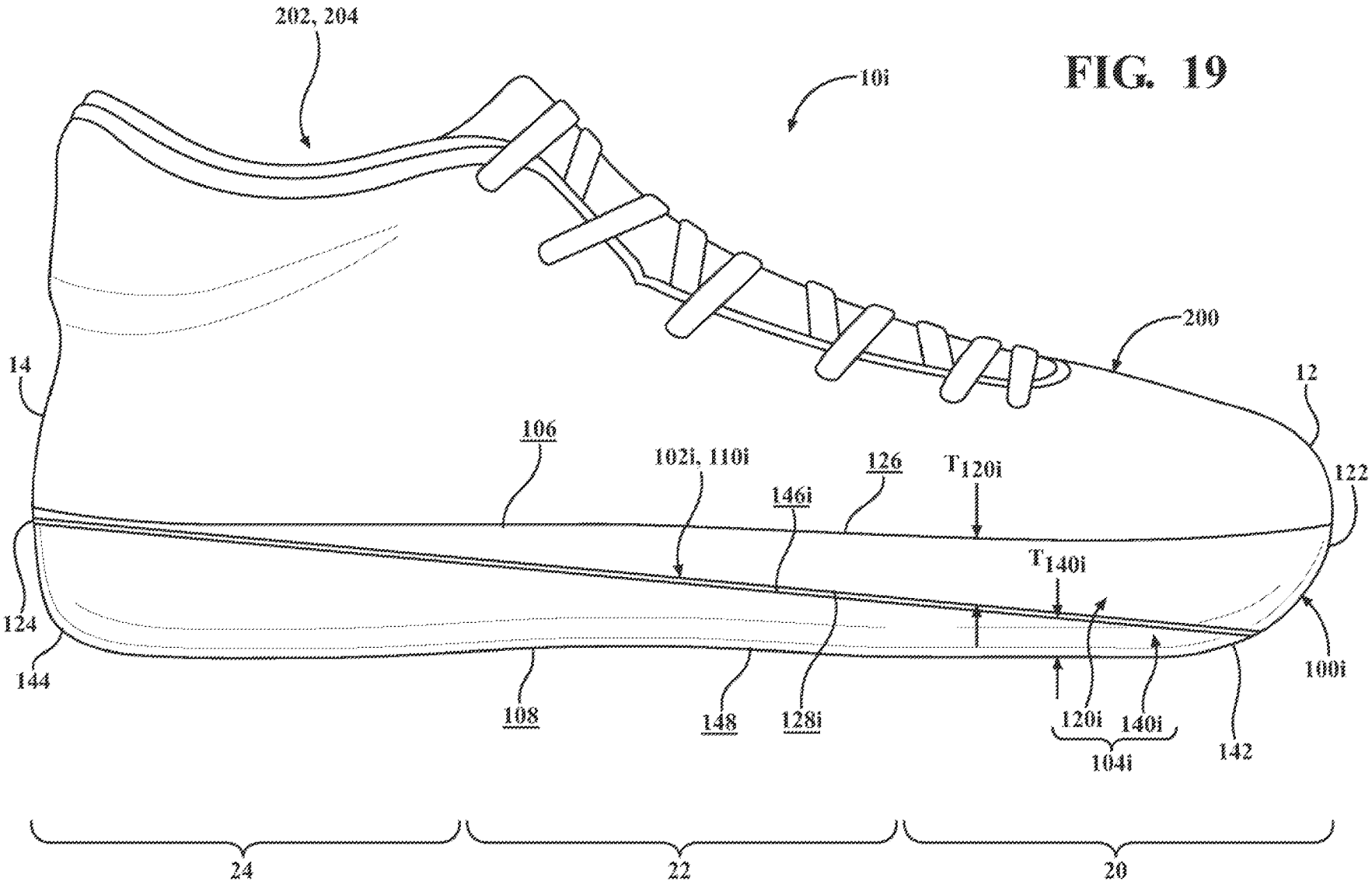
FIGS. 19 and 20 are views of another example of an article of footwear including a sole structure in accordance with the principles of the present disclosure.
Figure 20:
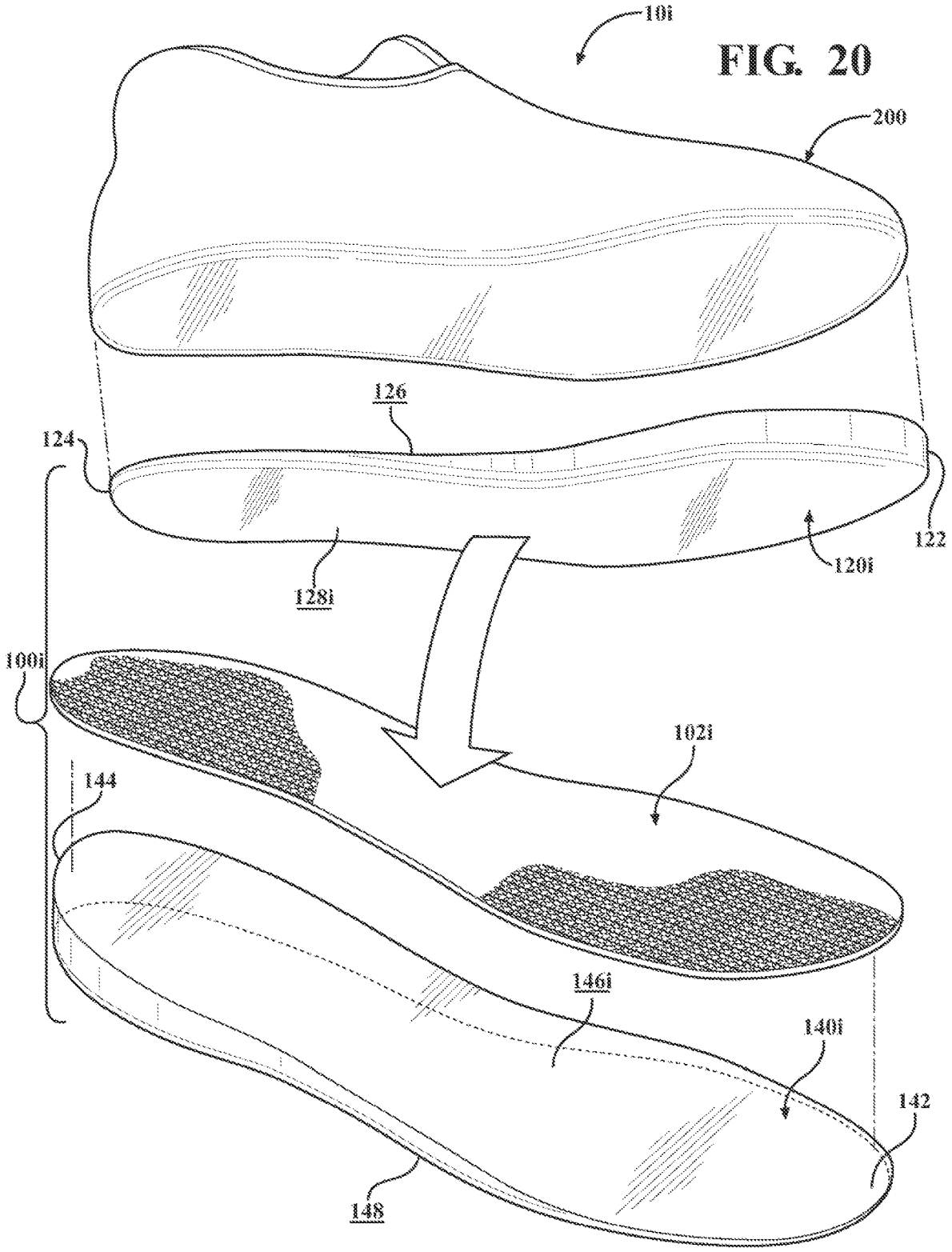

With particular reference to FIGS. 19 and 20, an article of footwear 10*i* is provided and includes a sole structure 100*i* and the upper 200 attached to the sole structure 100*i*. In view of the substantial similarity in structure and function of the components associated with the article of footwear 10 with respect to the article of footwear 10*i*, like reference numerals are used hereinafter and in the drawings to identify like components while like reference numerals containing letter extensions are used to identify those components that have been modified.

In the example of FIGS. 19 and 20, the sole structure 100*i* includes a fabric panel 102*i* and a cushioning member 104*i*. The cushioning member 104*i* includes a first cushioning element 120*i* extending continuously from the anterior end 12 to the posterior end 14 and a second cushioning element 140*i* disposed beneath the first cushioning element 120*i* and extending from the anterior end 12 to the posterior end 14. As discussed below, the first cushioning element 120*i* and the second cushioning element 140*i* cooperate with the fabric panel 102*i* to form a joint 110*i* extending continuously from the anterior end 12 to the posterior end 14.

The first cushioning element 120*i* extends from the first end 122 at the anterior end 12 to a second end 124 at the posterior end 14. As shown, the first cushioning element 120*i* includes a top surface 126 forming the footbed 106 and a bottom surface 128*i* formed on an opposite side from the top surface. A thickness $T_{120i}$ of the first cushioning element 120*i*, measured along a direction from the top surface 126 to the bottom surface 128*i* tapers constantly and continuously along a direction from the first end 122 to the second end 124.

The second cushioning element 140*i* extends from the first end 142 at the anterior end 12 to a second end 144 at the posterior end 14. As shown, the second cushioning element 140*i* includes a top surface 146*i* facing the bottom surface 128*i* of the first cushioning element 120*i* and a bottom surface 148 formed on an opposite side from the top surface 146. The bottom surface 148 of the second cushioning element 140*i* forms the ground-engaging surface 108 of the sole structure 100*i*. A thickness $T_{140i}$ of the second cushioning element 140*i*, measured along a direction from the top surface 146*i* to the bottom surface 148, increases constantly and continuously along a direction from the first end 122 to the second end 124.

When the sole structure 100*i* is assembled, the bottom surface 128*i* of the first cushioning element 120*i* is joined to the top surface 146*i* of the second cushioning element 140*i* to form the joint 110*i* extending continuously from the anterior end 12 to the posterior end 14. The fabric panel 102*i* is interposed between the bottom surface 128*i* of the first cushioning element 120*i* and the top surface 146*i* of the second cushioning element 140*i* to form the first joint 110*i* of the sole structure 100*i*. Here, the first joint 110*i* and the fabric panel 102*i* extend continuously from the anterior end 12 to the posterior end 14 and from the ground-engaging surface 108 to the footbed 106.

Figure 21:
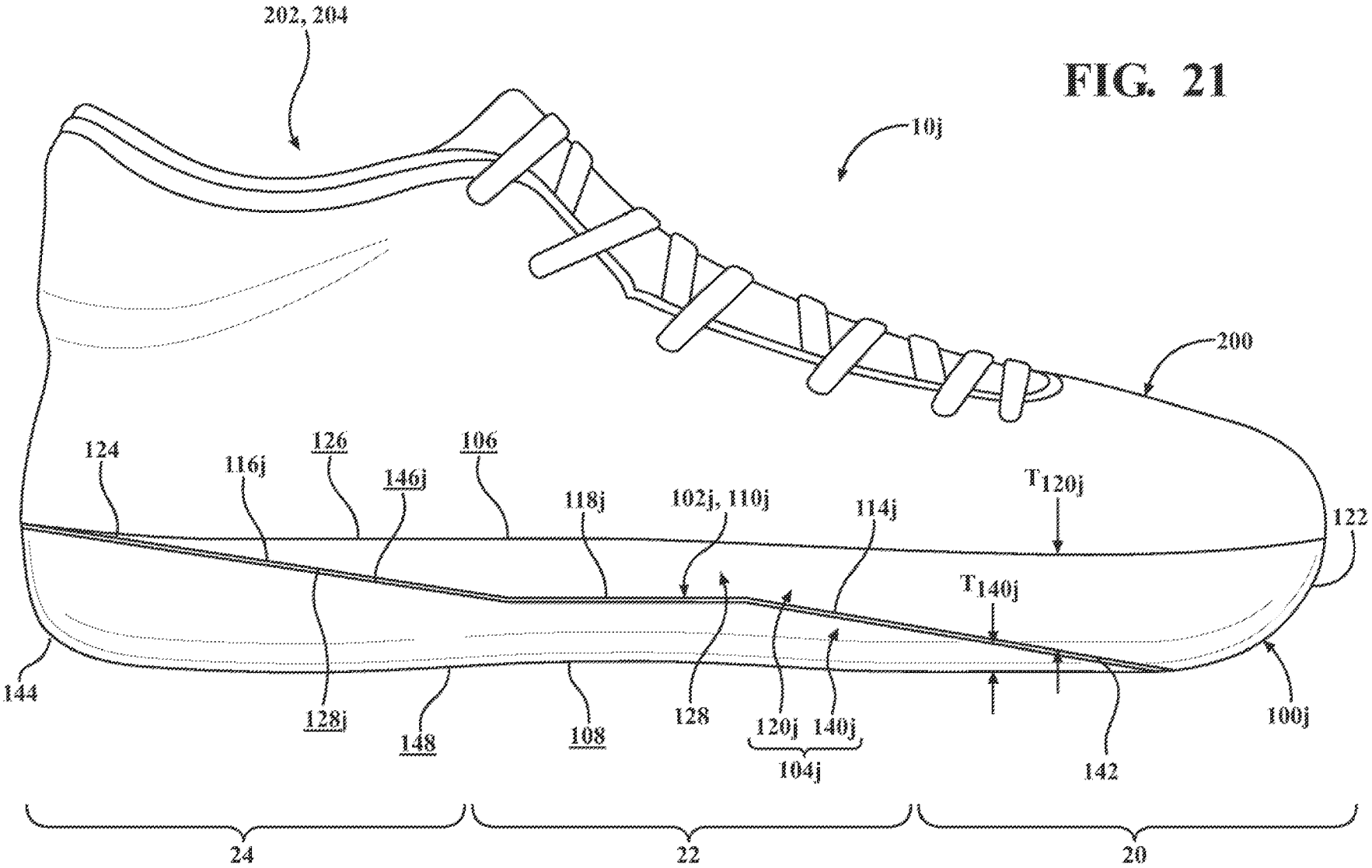
FIGS. 21 and 22 are views of another example of an article of footwear including a sole structure in accordance with the principles of the present disclosure.
Figure 22:
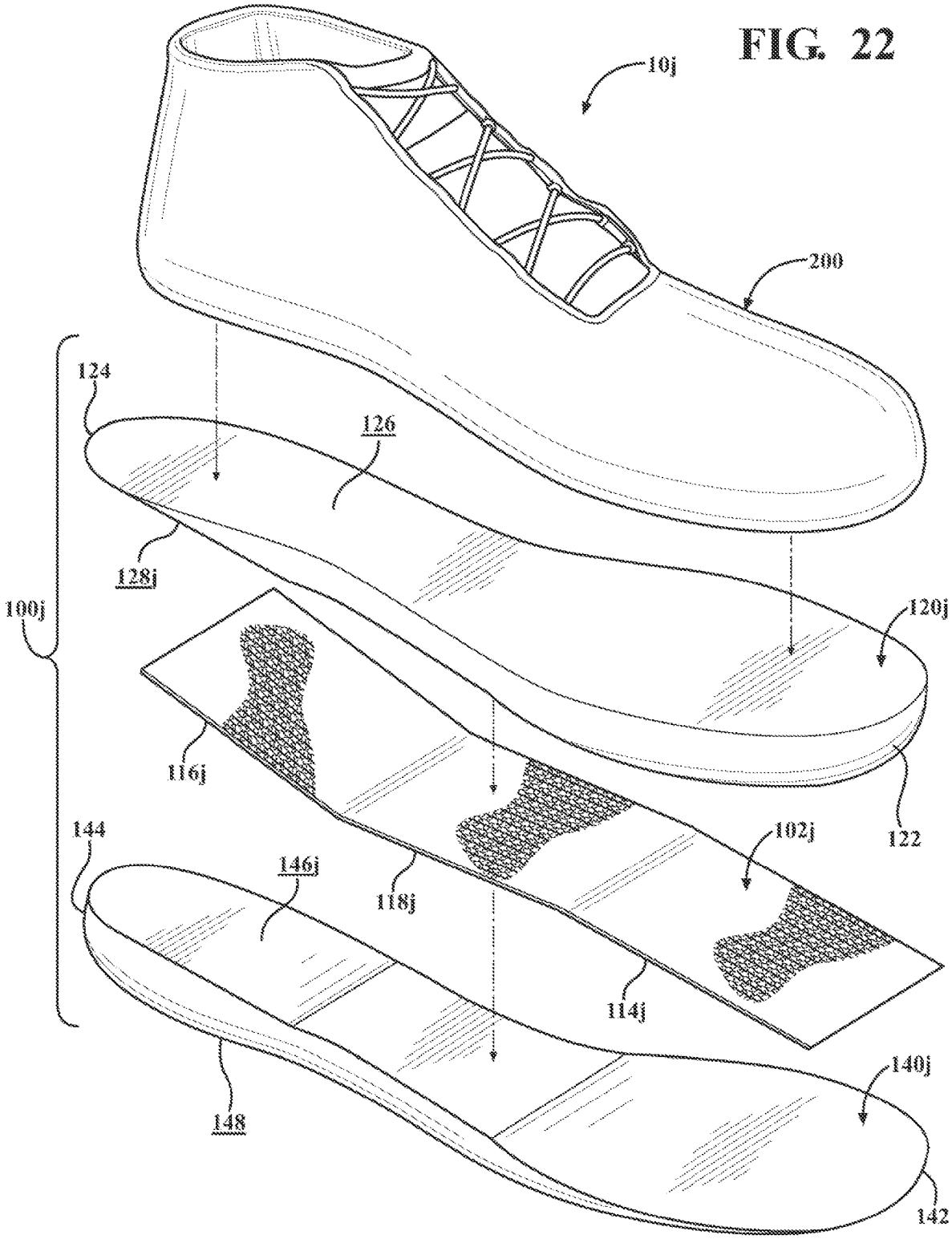

With particular reference to FIGS. 21 and 22, an article of footwear 10*j* is provided and includes a sole structure 100*j* and the upper 200 attached to the sole structure 100*j*. In view of the substantial similarity in structure and function of the components associated with the article of footwear 10 with respect to the article of footwear 10*j*, like reference numerals are used hereinafter and in the drawings to identify like components, while like reference numerals containing letter extensions are used to identify those components that have been modified.

In the example of FIGS. 21 and 22, the sole structure 100*j* includes a fabric panel 102*j* and a cushioning member 104*j*. The cushioning member 104*j* includes a first cushioning element 120*j* extending from the anterior end 12 to the posterior end 14 and a second cushioning element 140*j* disposed beneath the first cushioning element 120*j*. As discussed below, the first cushioning element 120*j* and the second cushioning element 140*j* cooperate with the fabric panel 102*j* to form a joint 110*j* extending along the length of the sole structure 100*j*.

The first cushioning element 120*j* extends from the first end 122 at the anterior end 12 to a second end 124 at the posterior end 14. As shown, the first cushioning element 120*j* includes a top surface 126 forming the footbed 106, and a bottom surface 128*j* formed on an opposite side from the top surface 126. A thickness $T_{120j}$ of the first cushioning element 120*j*, measured along a direction from the top surface 126 to the bottom surface 12*j*8, incrementally tapers along a direction from the first end 122 to the second end 124. Particularly, the thickness $T_{120j}$ of the first cushioning element 120*j* tapers in the first direction along a first portion of the bottom surface 128*j* extending from the first end 122 to the mid-foot region 22. The thickness $T_{120j}$ then remains constant along an intermediate portion of the bottom surface 128*j* in the mid-foot region 22, and then tapers again in the first direction along a third portion of the bottom surface 128*j* that converges with the top surface 126 at the posterior end 14. Here, the intermediate portion of the bottom surface 128*j* is parallel to the top surface 126, while the first portion and the third portion are parallel to each other and formed at oblique angles relative to the top surface 126. Particularly, the first portion and the third portion of the bottom surface 128*j* are convergent with the top surface 126 along the direction from the first end 122 to the second end 124.

The second cushioning element 140*j* extends from the first end 142 at the anterior end 12 to a second end 144 at the posterior end 14. As shown, the second cushioning element 140*j* includes a top surface 146*j* facing the bottom surface 128*j* of the first cushioning element 120*j*, and a bottom surface 148 formed on an opposite side from the top surface 126 and forming the ground-engaging surface 108 of the sole structure 100*j*. A thickness $T_{140j}$ of the second cushioning element 140*j*, measured along a direction from the top surface 146*j* to the bottom surface 148, incrementally increases along a direction from the first end 142 to the second end 144. Particularly, the thickness $T_{140j}$ of the second cushioning element 140*j* increases in the first direction along a first portion of the top surface 146*j* extending from the first end 142 to the mid-foot region 22. The thickness $T_{140j}$ then remains constant along an intermediate portion of the top surface 146*j* in the mid-foot region 22, and then increases again in the first direction along a third portion of the top surface 146*j* extending to the posterior end 14. Here, the intermediate portion of the top surface 146*j* is parallel to the bottom surface 148, while the first portion and the third portion are parallel to each other and formed at oblique angles relative to the bottom surface. Particularly, the first portion and the third portion of the top surface 146*j* are divergent from the bottom surface 148 along the direction from the first end 142 to the second end 144.

When the sole structure 100*j* is assembled, the bottom surface 128*j* of the first cushioning element 120*j* is joined to the top surface 146*j* of the second cushioning element 140*j* to form the joint 110*j* extending along the length of the sole structure 100*j*. The fabric panel 102*j* is interposed between the bottom surface 128*j* of the first cushioning element 120*j* and the top surface 146*j* of the second cushioning element 140*j* and also extends from the anterior end 12 to the posterior end 14. The fabric panel 102*j* includes a first portion 114*j* interposed between the first portions of the tapered surfaces 128*j*, 146*j*, a second portion 116*j* interposed between the third portions of the tapered surfaces 128*j*, 146*j*, and a third portion 118*j* connecting the first portion 114*j* and the second portion 116*j* and disposed between intermediate portions of the tapered surfaces 128*j*, 146*j*.

Figure 23:
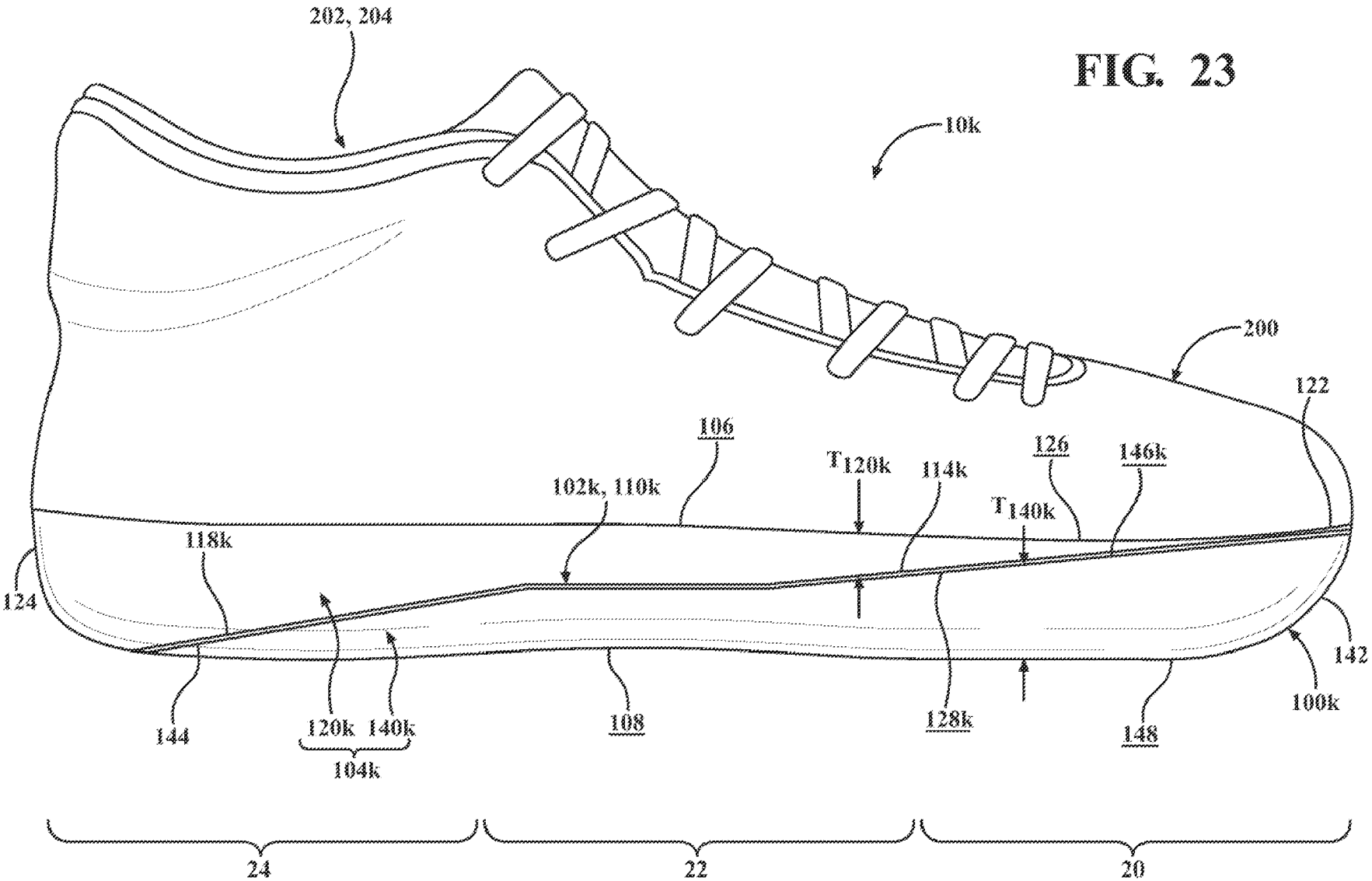
FIGS. 23 and 24 are views of another example of an article of footwear including a sole structure in accordance with the principles of the present disclosure.
Figure 24:
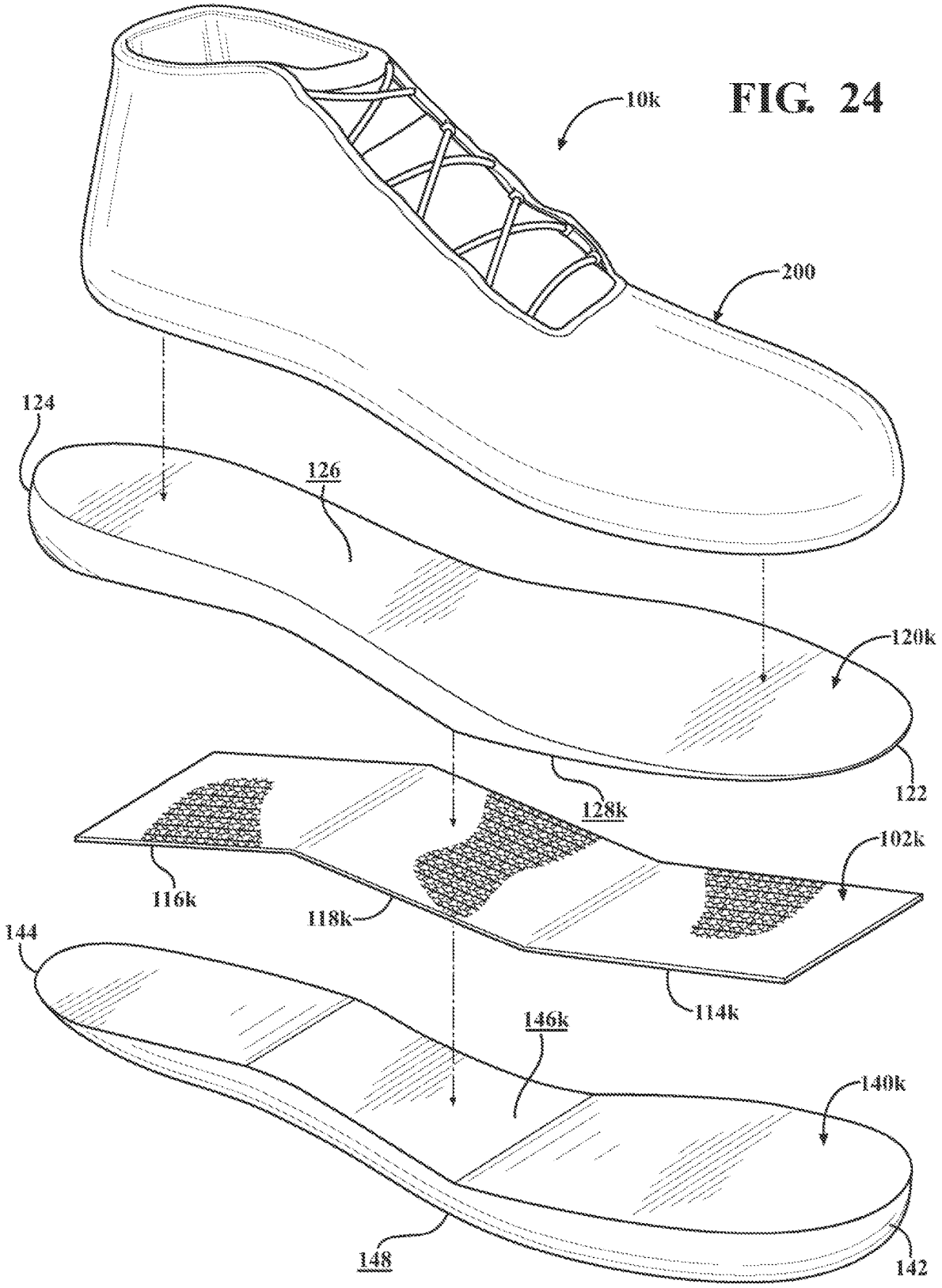

With particular reference to FIGS. 23 and 24, an article of footwear 10*k* is provided and includes a sole structure 100*k* and the upper 200 attached to the sole structure 100*k*. In view of the substantial similarity in structure and function of the components associated with the article of footwear 10 with respect to the article of footwear 10*k*, like reference numerals are used hereinafter and in the drawings to identify like components, while like reference numerals containing letter extensions are used to identify those components that have been modified.

In the example of FIGS. 23 and 24, the sole structure 100*k* includes a fabric panel 102*k* and a cushioning member 104*k*. The cushioning member 104*k* includes a first cushioning element 120*k* extending from the anterior end 12 to the posterior end 14 and a second cushioning element 140*k* disposed beneath the first cushioning element 120*k*. As discussed below, the first cushioning element 120*k* and the second cushioning element 140*k* cooperate with the fabric panel 102*k* to form a joint 110*k* extending along the length of the sole structure 100*k*.

The first cushioning element 120*k* extends from the first end 122 at the anterior end 12 to a second end 124 at the posterior end 14. As shown, the first cushioning element 120*k* includes a top surface 126 forming the footbed 106, and a bottom surface 128*k* formed on an opposite side from the top surface 126. A thickness $T_{120k}$ of the first cushioning element 120*k*, measured along a direction from the top surface 126 to the bottom surface 128*k*, incrementally increases along a direction from the first end 122 to the second end 124. Particularly, the thickness $T_{120k}$ of the first cushioning element 120*k* increases in a first direction along a first portion of the bottom surface 128*k* extending from the first end 122 to the mid-foot region 22. The thickness $T_{120k}$ then remains constant along an intermediate portion of the bottom surface 128*k* in the mid-foot region 22, and then increases again in the first direction along a third portion of the bottom surface 128*k* to the posterior end 14. Here, the intermediate portion of the bottom surface 128*k* is parallel to the top surface 126, while the first portion and the third portion are parallel to each other and formed at oblique angles relative to the top surface 126. Particularly, the first portion and the third portion of the bottom surface 128*k* are divergent from the top surface 126 along the direction from the first end 122 to the second end 124.

The second cushioning element 140*k* extends from the first end 142 at the anterior end 12 to a second end 144 at the posterior end 14. As shown, the second cushioning element 140*k* includes a top surface 146*k* facing the bottom surface 128*k* of the first cushioning element 120*k*, and a bottom surface 148 formed on an opposite side from the top surface 146*k* and forming the ground-engaging surface 108 of the sole structure 100*k*. A thickness $T_{140k}$ of the second cushioning element 140*k*, measured along a direction from the top surface 146*k* to the bottom surface 148, incrementally tapers along a direction from the first end 142 to the second end 144. Particularly, the thickness $T_{140k}$ of the second cushioning element 140*j* tapers in the first direction along a first portion of the top surface 146*k* extending from the first end 142 to the mid-foot region 22. The thickness $T_{140k}$ then remains constant along an intermediate portion of the top surface 146*k* in the mid-foot region 22, and then tapers again in the first direction along a third portion of the top surface 146*k* extending to the posterior end 14. Here, the intermediate portion of the top surface 146*k* is parallel to the bottom surface 148, while the first portion and the third portion are parallel to each other and formed at oblique angles relative to the bottom surface. Particularly, the first portion and the third portion of the top surface 146*k* are convergent with the bottom surface 148 along the direction from the first end 142 to the second end 144.

When the sole structure 100*k* is assembled, the bottom surface 128*k* of the first cushioning element 120*k* is joined to the top surface 146*k* of the second cushioning element 140*k* to form the joint 110*k* extending along the length of the sole structure 100*k*. The fabric panel 102*k* is interposed between the bottom surface 128*k* of the first cushioning element 120*k* and the top surface 146*k* of the second cushioning element 140*k* and also extends from the anterior end 12 to the posterior end 14. The fabric panel 102*k* includes a first portion 114*k* interposed between the first portions of the tapered surfaces 128*k*, 146*k*, a second portion 116*k* interposed between the third portions of the tapered surfaces 128*k*, 146*k*, and a third portion 118*k* connecting the first portion 114*k* and the second portion 116*k* and disposed between intermediate portions of the tapered surfaces 128*k*, 146*k*.

Figure 25:
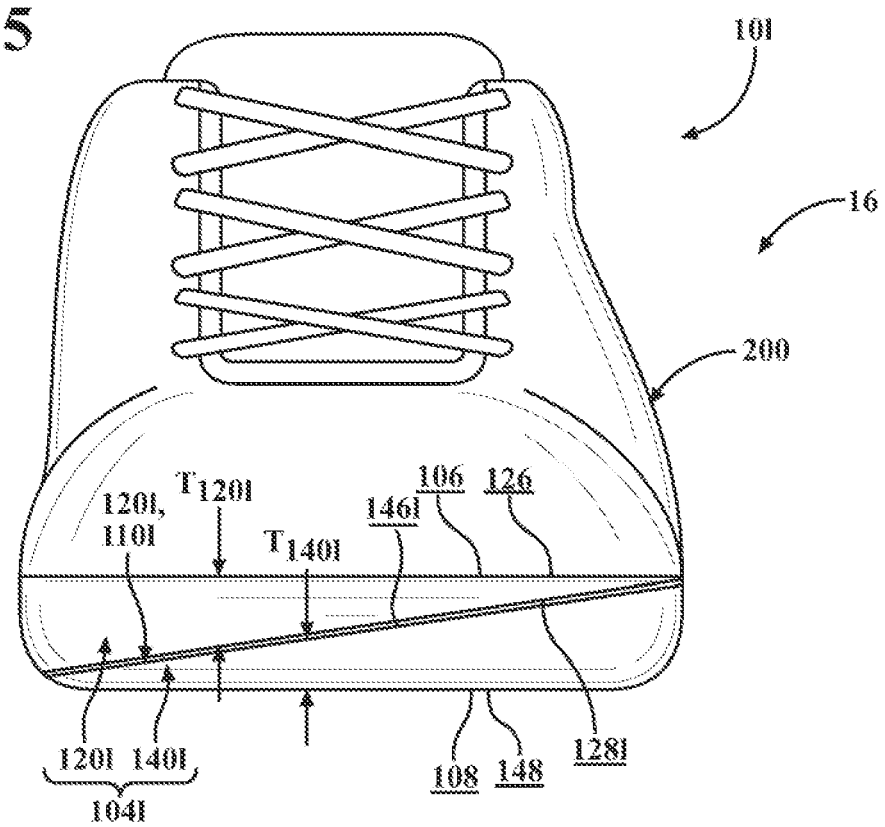
FIGS. 25 and 26 are views of another example of an article of footwear including a sole structure in accordance with the principles of the present disclosure.
Figure 26:
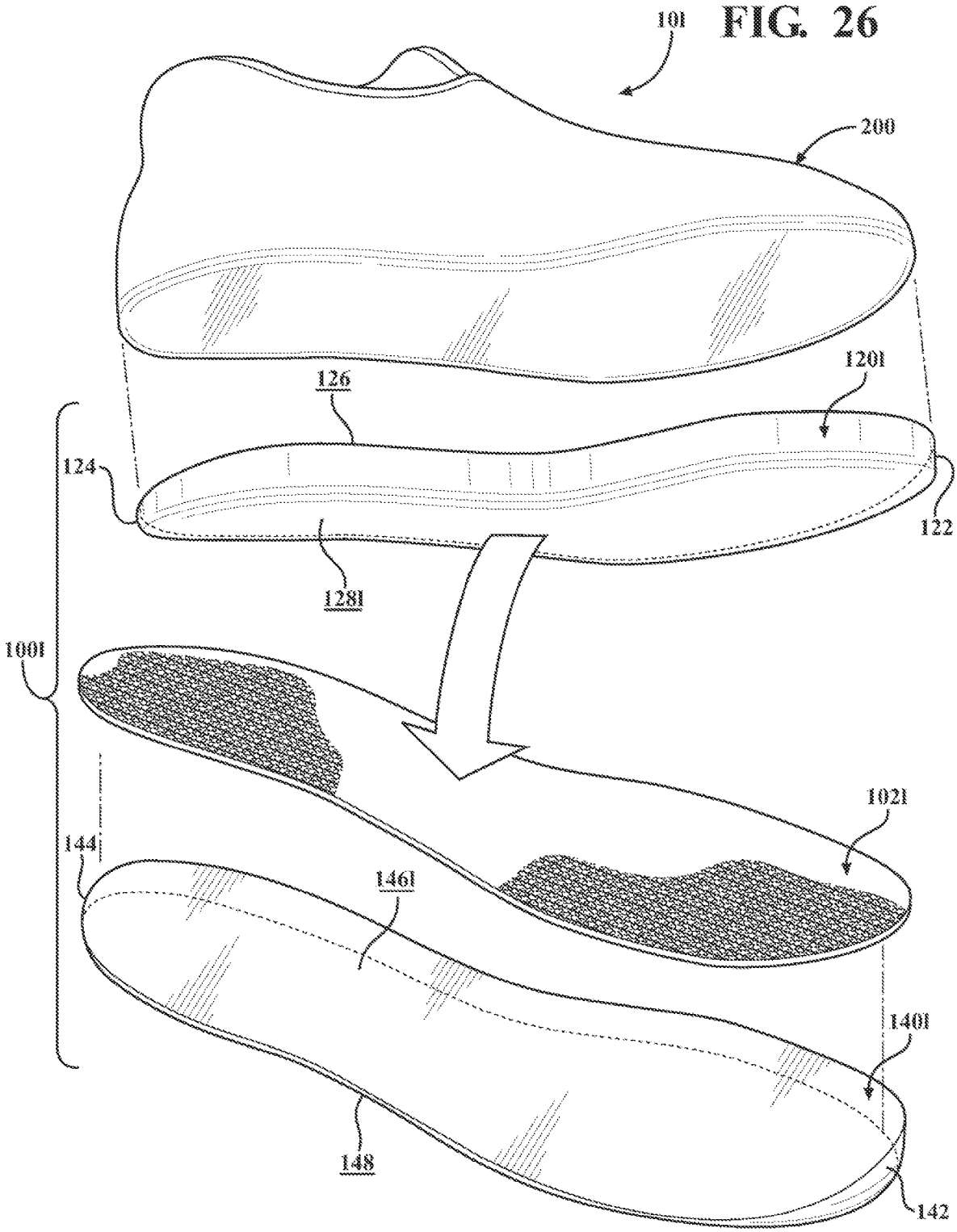

With particular reference to FIGS. 25 and 26, an article of footwear 10*l* is provided and includes a sole structure 100*l* and the upper 200 attached to the sole structure 100*l*. In view of the substantial similarity in structure and function of the components associated with the article of footwear 10 with respect to the article of footwear 10*l*, like reference numerals are used hereinafter and in the drawings to identify like components, while like reference numerals containing letter extensions are used to identify those components that have been modified.

In the example of FIGS. 25 and 26, the sole structure 100*l* includes a fabric panel 102*l* and a cushioning member 104*l*. The cushioning member 104*l* includes a first cushioning element 120*l* extending from the anterior end 12 to the posterior end 14 and a second cushioning element **140*l* disposed beneath the first cushioning element 120*l*. As discussed below, the first cushioning element 120*l* and the second cushioning element 140*l* cooperate with the fabric panel 102*l* to form a joint 110*l* extending along the length of the sole structure 100*l***.

The first cushioning element **120*l* extends from the first end 122 at the anterior end 12 to a second end 124 at the posterior end 14. As shown, the first cushioning element 120*l* includes a top surface 126 forming the footbed 106, and a bottom surface 128*l* formed on an opposite side from the top surface 126. A thickness $T_{120l}$ of the first cushioning element 120*l*, measured along a direction from the top surface 126 to the bottom surface 128*l*, continuously increases along a direction from the lateral side 16 to the medial side 18. In other words, the bottom surface 128*l* diverges from the top surface 126 along a direction from the lateral side 16 to the medial side 18**.

The second cushioning element **140*l* extends from the first end 142 at the anterior end 12 to a second end 144 at the posterior end 14. As shown, the second cushioning element 140*l* includes a top surface 146*l* facing the bottom surface 128*l* of the first cushioning element 120*l*, and a bottom surface 148 formed on an opposite side from the top surface 146*l*. The bottom surface 148 of the second cushioning element 140*l* forms the ground-engaging surface 108 of the sole structure 100*l*. A thickness $T_{140l}$ of the second cushioning element 140*l*, measured along a direction from the top surface 146*l* to the bottom surface 148, tapers constantly and continuously from the lateral side 16 to the medial side 18. In other words, the top surface 146*l* converges with the bottom surface 148 along a direction from the lateral side 16 to the medial side 18**.

When the sole structure is assembled, the bottom surface **128*l* of the first cushioning element 120*l* is joined to the top surface 146*l* of the second cushioning element 140*l* to form the first joint 110*l*. Accordingly, the first joint 110*l* extends at an oblique angle from the footbed 106 on the lateral side 16 to the ground-engaging surface 108 on the medial side 18. The fabric panel 102*l* is interposed between the bottom surface 128*l* of the first cushioning element 120*l* and the top surface 146*l* of the second cushioning element 140*l* to form the first joint 110*l* of the sole structure 100*l*. Here, the first joint 110*l* and the fabric panel 102*l* extend continuously from the anterior end 12 to the posterior end 14**.

Figure 27:
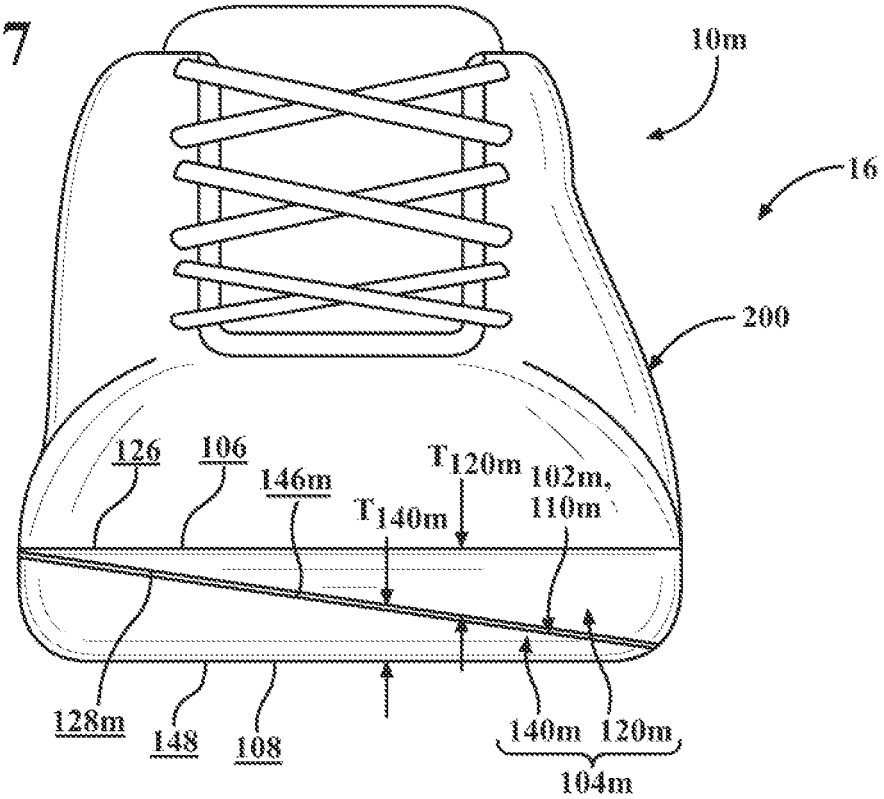
FIGS. 27 and 28 are views of another example of an article of footwear including a sole structure in accordance with the principles of the present disclosure.
Figure 28:
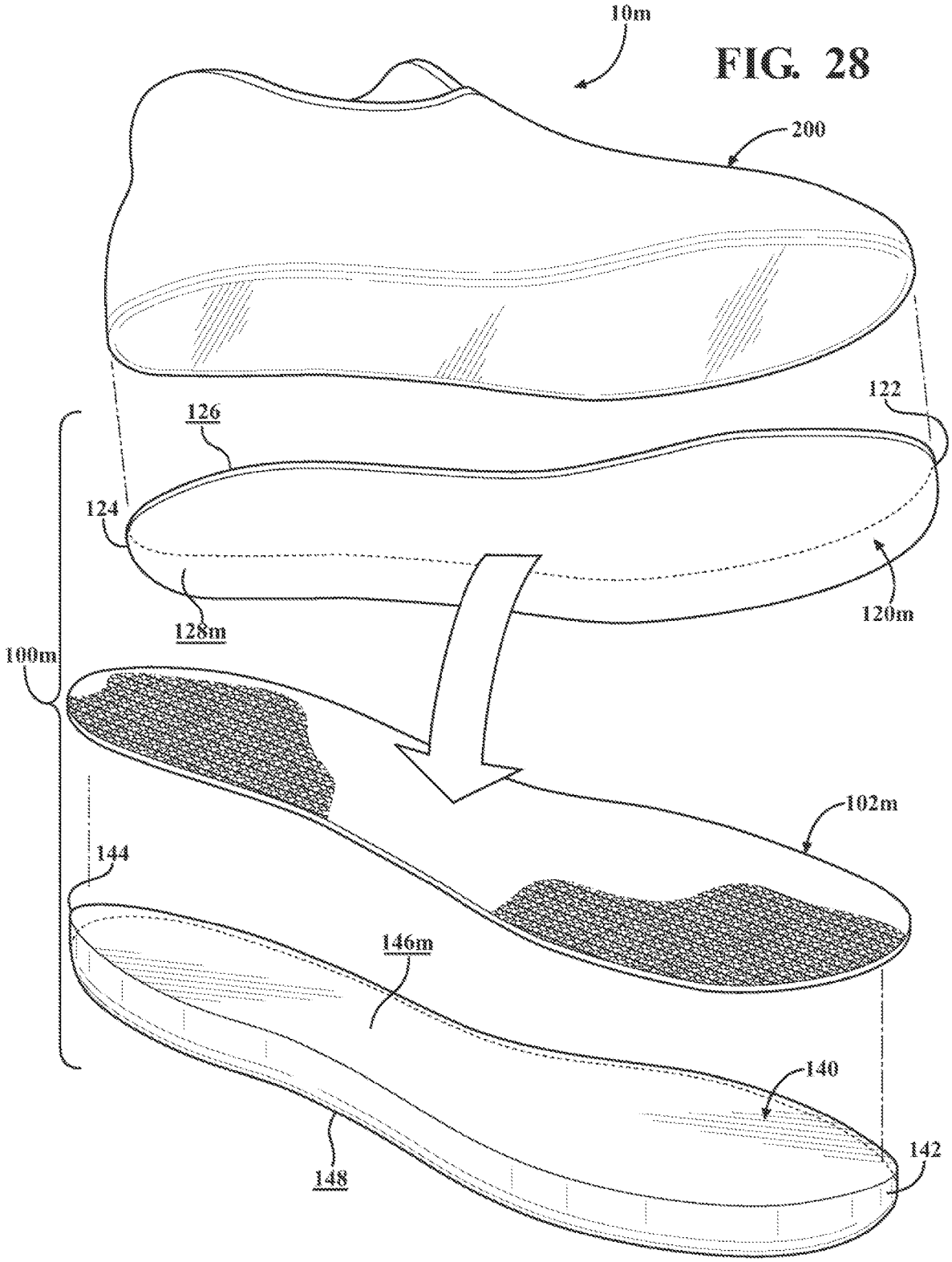

With particular reference to FIGS. 27 and 28, an article of footwear **10*m* is provided and includes a sole structure 100*m* and the upper 200 attached to the sole structure 100*m*. In view of the substantial similarity in structure and function of the components associated with the article of footwear 10 with respect to the article of footwear 10*m***, like reference numerals are used hereinafter and in the drawings to identify like components, while like reference numerals containing letter extensions are used to identify those components that have been modified.

In the example of FIGS. 27 and 28, the sole structure **100*m* includes a fabric panel 102*m* and a cushioning member 104*m*. The cushioning member 104*m* includes a first cushioning element 120*m* extending from the anterior end 12 to the posterior end 14 and a second cushioning element 140*m* disposed beneath the first cushioning element 120*m*. As discussed below, the first cushioning element 120*m* and the second cushioning element 140*m* cooperate with the fabric panel 102*m* to form a joint 110*m* extending along the length of the sole structure 100*m***.

The first cushioning element **120*m* extends from the first end 122 at the anterior end 12 to a second end 124 at the posterior end 14. As shown, the first cushioning element 120*m* includes a top surface 126 forming the footbed 106, and a bottom surface 128*m* formed on an opposite side from the top surface 126. A thickness $T_{120m}$ of the first cushioning element 120*m*, measured along a direction from the top surface 126 to the bottom surface 128*m*, continuously tapers along a direction from the lateral side 16 to the medial side 18. In other words, the bottom surface 128*m* converges with the top surface 126 along a direction from the lateral side 16 to the medial side 18**.

The second cushioning element **140*m* extends from the first end 142 at the anterior end 12 to a second end 144 at the posterior end 14. As shown, the second cushioning element 140*m* includes a top surface 146*m* facing the bottom surface 128*m* of the first cushioning element 120*m* and a bottom surface 148 formed on an opposite side from the top surface. The bottom surface 148 of the second cushioning element 140*m* forms the ground-engaging surface 108 of the sole structure 100*m*. A thickness $T_{140m}$ of the second cushioning element 140*m*, measured along a direction from the top surface 146*m* to the bottom surface 148 tapers constantly and continuously from the lateral side 16 to the medial side 18. In other words, the top surface 146*m* diverges from the bottom surface 148 along a direction from the lateral side 16 to the medial side 18**.

When the sole structure is assembled, the bottom surface **128*m* of the first cushioning element 120*m* is joined to the top surface 146*m* of the second cushioning element 140*m* to form the first joint 110*m*. Accordingly, the first joint 110*m* extends at an oblique angle from the footbed 106 on the medial side 18 to the ground-engaging surface 108 on the lateral side 16. The fabric panel 102*m* is interposed between the bottom surface 128*m* of the first cushioning element 120*m* and the top surface 146*m* of the second cushioning element 140*m* to form the first joint 110*m* of the sole structure 100*m*. Here, the first joint 110*m* and the fabric panel 102*m* extend continuously from the anterior end 12 to the posterior end 14**.

Figure 29:
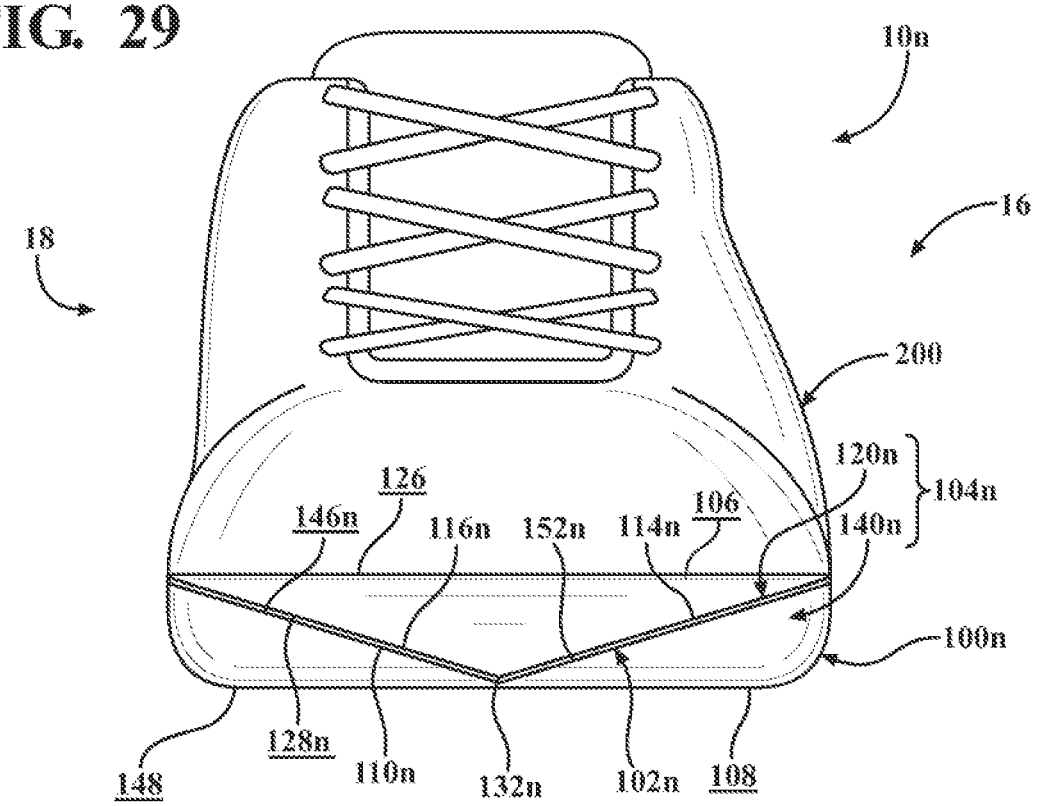
FIGS. 29 and 30 are views of another example of an article of footwear including a sole structure in accordance with the principles of the present disclosure.
Figure 30:
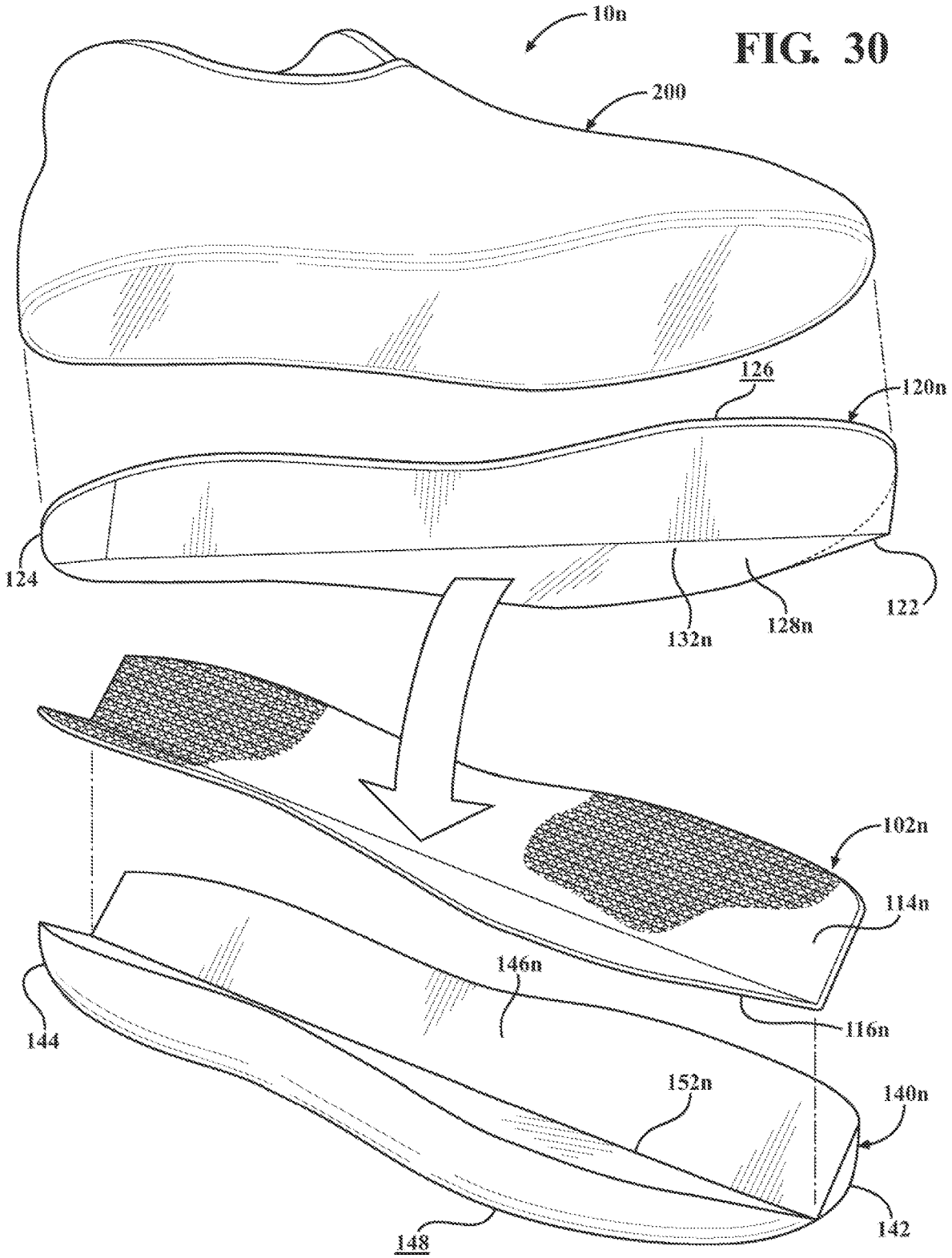

With particular reference to FIGS. 29 and 30, an article of footwear **10*n* is provided and includes a sole structure 100*n* and the upper 200 attached to the sole structure 100*n*. In view of the substantial similarity in structure and function of the components associated with the article of footwear 10 with respect to the article of footwear 10*n***, like reference numerals are used hereinafter and in the drawings to identify like components, while like reference numerals containing letter extensions are used to identify those components that have been modified.

In the example of FIGS. 29 and 30, the sole structure **100*n* includes a fabric panel 102*n* and a cushioning member 104*n*. The cushioning member 104*n* includes a first cushioning element 120*n* extending from the anterior end 12 to the posterior end 14 and a second cushioning element 140*n* disposed beneath the first cushioning element 120*n*. As discussed below, the first cushioning element 120*n* and the second cushioning element 140*n* cooperate with the fabric panel 102*n* to form a V-shaped joint 110*n* extending along the length of the sole structure 100*n***.

The first cushioning element **120*n* extends from the first end 122 at the anterior end 12 to a second end 124 at the posterior end 14. As shown, the first cushioning element 120*n* includes a top surface 126 forming the footbed 106, and a bottom surface 128*n* formed on an opposite side from the top surface 126. A thickness $T_{120n}$ of the first cushioning element 120*n*, measured along a direction from the top surface 126 to the bottom surface 128*n*, continuously increases in a direction from each of the lateral side 16 and the medial side 18 to a central portion extending along the longitudinal axis $A_{10}$. Accordingly, the first cushioning element 120***n* forms a first mating feature 132*n* along a length of the sole structure 100*n*. Here, the first mating feature 132*n* is a spine or ridge 132*n*. The ridge 132*n* is defined by a first portion of the bottom surface 128*n* that diverges from the top surface 126 along a direction from the lateral side 16 and a second portion of the bottom surface 128*n* that diverges from the top surface 126 along a direction from the medial side 18. Here, the first portion and the second portion of the bottom surface 128*n* intersect along a central portion of the first cushioning element 120*n*. The first portion and the second portion of the bottom surface 128*n* are each planar surfaces.

The second cushioning element 140*n* extends from the first end 142 at the anterior end 12 to a second end 144 at the posterior end 14. As shown, the second cushioning element 140*n* includes a top surface 146*n* facing the bottom surface 128*n* of the first cushioning element 120*n*, and a bottom surface 148 formed on an opposite side from the top surface 146*n* and forming the ground-engaging surface 108 of the sole structure 100*n*. A thickness $T_{140n}$ of the second cushioning element 140*n*, measured along a direction from the top surface 146*n* to the bottom surface 148, continuously tapers or decreases in a direction from each of the lateral side 16 and the medial side 18 to a central portion extending along the length of the second cushioning element 140*n*. Accordingly, the second cushioning element 140*n* forms a second mating feature 152*n* extending along a length of the sole structure 100*n*. Here, the second mating feature is a receptacle or channel 152*n* configured to mate with or engage the ridge 132*n* of the first cushioning element 120*n*. The channel 152*n* is defined by a first portion of the top surface 146*n* that converges with the bottom surface 148 along a direction from the lateral side 16 and a second portion of the top surface 146*n* that converges with the bottom surface 148 along a direction from the medial side 18. Here, the first portion and the second portion of the top surface 146*n* intersect along a central portion of the second cushioning element 140*n*. The first portion and the second portion of the top surface 146*n* are each planar surfaces.

When the sole structure 100*n* is assembled, the first mating feature 132*n* on the bottom surface 128*n* of the first cushioning element 120*n* mates with and is joined to the second mating feature 152*p* on the top surface 146*n* of the second cushioning element 140*n* to form the joint 110*n* extending along the length of the sole structure 100*n*. The fabric panel 102*n* is interposed between the bottom surface 128*n* of the first cushioning element 120*n* and the top surface 146*n* of the second cushioning element 140*n* and extends along the entire length of the joint 110*n*. Here, the first joint 110*n* and the fabric panel 102*n* have a V-shaped cross section extending continuously from the anterior end 12 to the posterior end 14. Accordingly, the fabric panel 102*n* is formed to include a first portion 114*n* extending along the lateral side 16 and a second portion 116*n* extending along the medial side 18.

Figure 31:
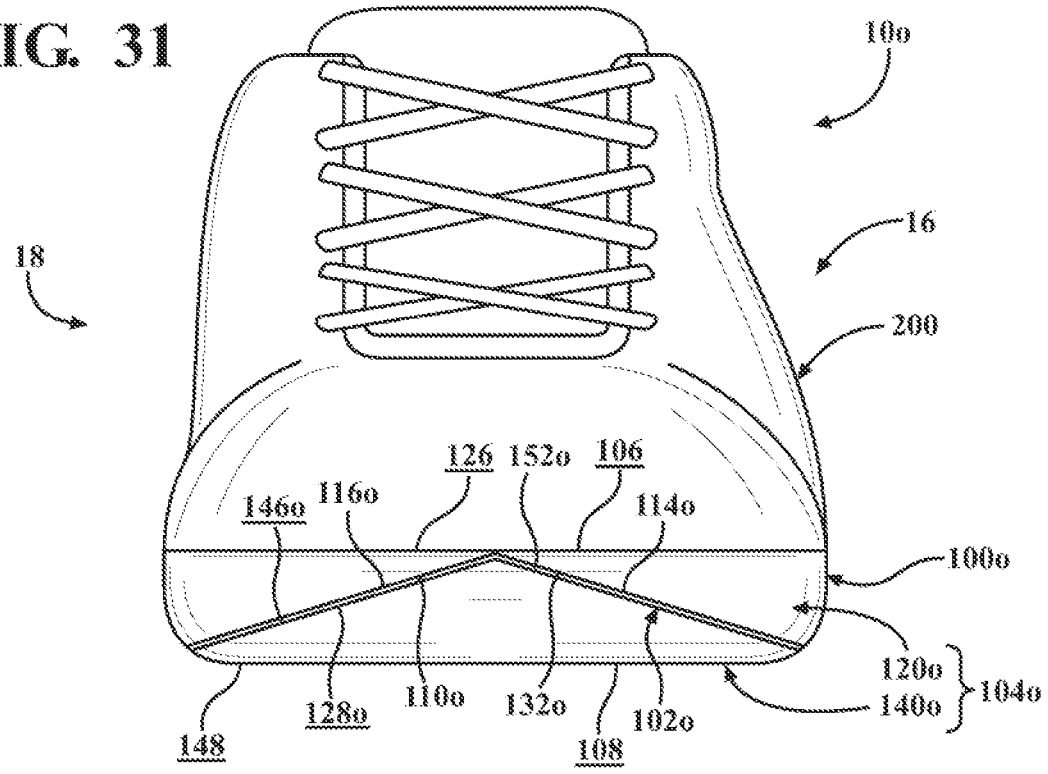
FIGS. 31 and 32 are views of another example of an article of footwear including a sole structure in accordance with the principles of the present disclosure.
Figure 32:
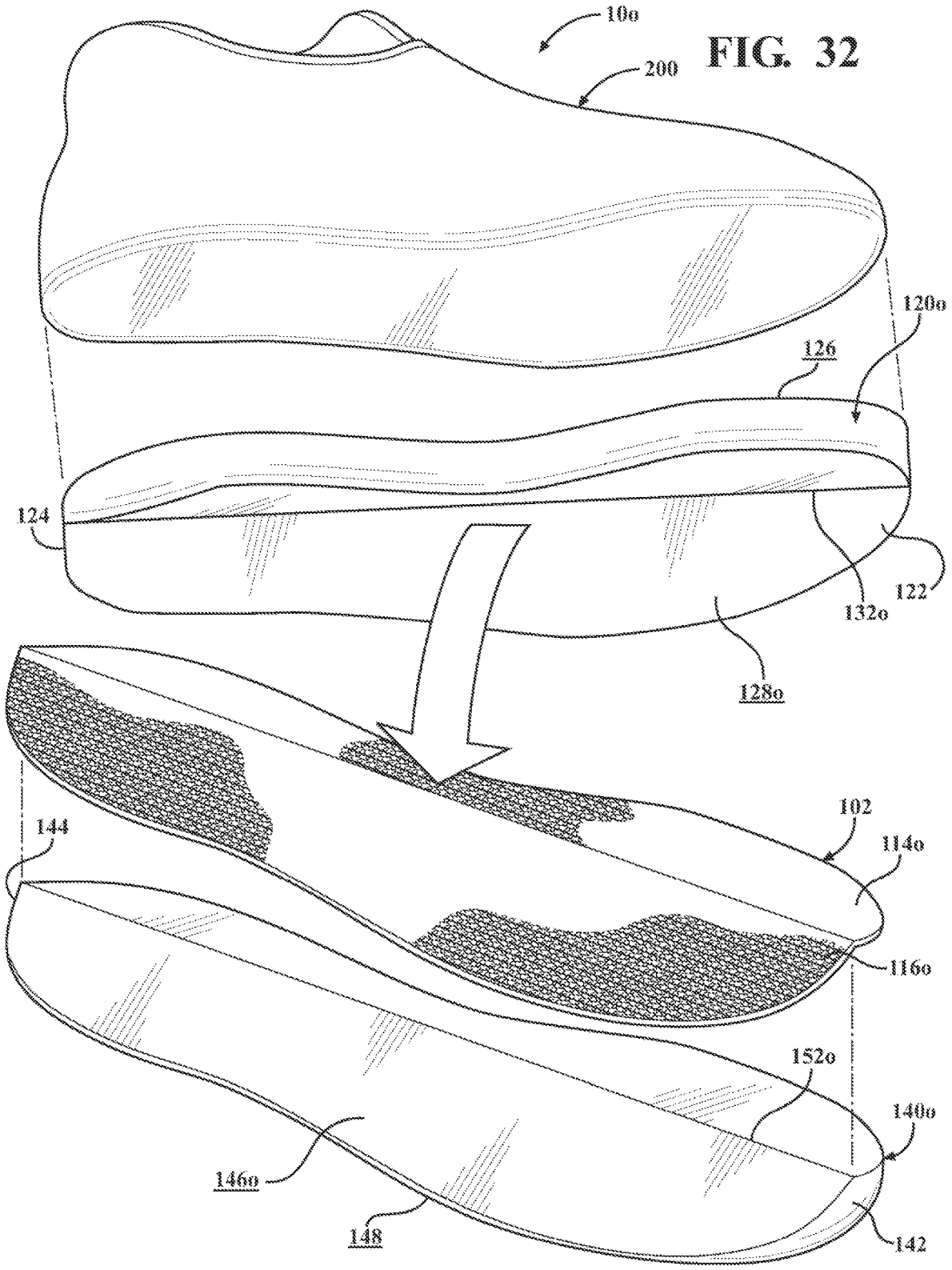

With particular reference to FIGS. 31 and 32, an article of footwear 10*o* is provided and includes a sole structure 100*o* and the upper 200 attached to the sole structure 100*o*. In view of the substantial similarity in structure and function of the components associated with the article of footwear 10 with respect to the article of footwear 10*o*, like reference numerals are used hereinafter and in the drawings to identify like components, while like reference numerals containing letter extensions are used to identify those components that have been modified.

In the example of FIGS. 31 and 32, the sole structure 100*o* includes a fabric panel 102*o* and a cushioning member 104*o*. The cushioning member 104*o* includes a first cushioning element 120*o* extending from the anterior end 12 to the posterior end 14 and a second cushioning element 140*o* disposed beneath the first cushioning element 120*o*. As discussed below, the first cushioning element 120*o* and the second cushioning element 140*o* cooperate with the fabric panel 102*o* to form an A-shaped or inverted V-shaped joint 110*o* extending along the length of the sole structure 1000.

The first cushioning element 120*o* extends from the first end 122 at the anterior end 12 to a second end 124 at the posterior end 14. As shown, the first cushioning element 120*o* includes a top surface 126 forming the footbed 106, and a bottom surface 128*o* formed on an opposite side from the top surface 126. A thickness $T_{12W}$ of the first cushioning element 120*o*, measured along a direction from the top surface 126 to the bottom surface 128*o*, continuously decreases in a direction from each of the lateral side 16 and the medial side 18 to a central portion extending along the longitudinal axis $A_{10}$. Accordingly, the first cushioning element 120*o* forms a first mating feature 132*o* extending along a length of the sole structure 100*o*. Here, the first mating feature 132*o* is a receptacle or channel 132*o*. The channel 132*o* is defined by a first portion of the bottom surface 128*o* that converges with the top surface 126 along a direction from the lateral side 16 and a second portion of the bottom surface 128*o* that converges with the top surface 126 along a direction from the medial side 18. Here, the first portion and the second portion of the bottom surface 128*o* intersect along a central portion of the first cushioning element 120*o*. The first portion and the second portion of the bottom surface 128*o* are each planar surfaces.

The second cushioning element 140*o* extends from the first end 142 at the anterior end 12 to a second end 144 at the posterior end 14. As shown, the second cushioning element 140*o* includes a top surface 146*o* facing the bottom surface 128*o* of the first cushioning element 120*o*, and a bottom surface 148 formed on an opposite side from the top surface 146*o* and forming the ground-engaging surface 108 of the sole structure 100*o*. A thickness $T_{140o}$ of the second cushioning element 140*o*, measured along a direction from the top surface 146*o* to the bottom surface 148, continuously increases in a direction from each of the lateral side 16 and the medial side 18 to a central portion extending along a length of the second cushioning element 140*o*. Accordingly, the second cushioning element 140*o* forms a second mating feature 152*o* extending along a length of the sole structure 100*o*. Here, the second mating feature 152*o* is a spine or ridge 152*o* configured to mate with or engage the channel 132*o* of the first cushioning element 120*o*. The ridge 152*o* is defined by a first portion of the top surface 146*o* that diverges from the bottom surface 148 along a direction from the lateral side 16 and a second portion of the top surface 146*o* that diverges from the bottom surface 148 along a direction from the medial side 18. Here, the first portion and the second portion of the top surface 146*o* intersect along a central portion of the second cushioning element 140*o*. The first portion and the second portion of the top surface 146*o* are each planar surfaces.

When the sole structure 100*o* is assembled, first mating feature 132*o* on the bottom surface 128*o* of the first cushioning element 120*o* mates with and is joined to the top surface 146*o* of the second cushioning element 140*o* to form the joint 110*o* extending along the length of the sole structure 100*o*. The fabric panel 102*o* is interposed between the bottom surface 128*o* of the first cushioning element 120*o* and the top surface 146*o* of the second cushioning element 140*o* and extends along the entire length of the joint 110*o*. Here, the first joint 110*o* and the fabric panel 102*o* have an A-shaped or inverted V-shaped cross-section extending continuously from the anterior end 12 to the posterior end 14. Accordingly, the fabric panel 102*o* is formed to include a first portion 114*o* extending along the lateral side 16 and a second portion 116*o* extending along the medial side 18.

Figure 33:
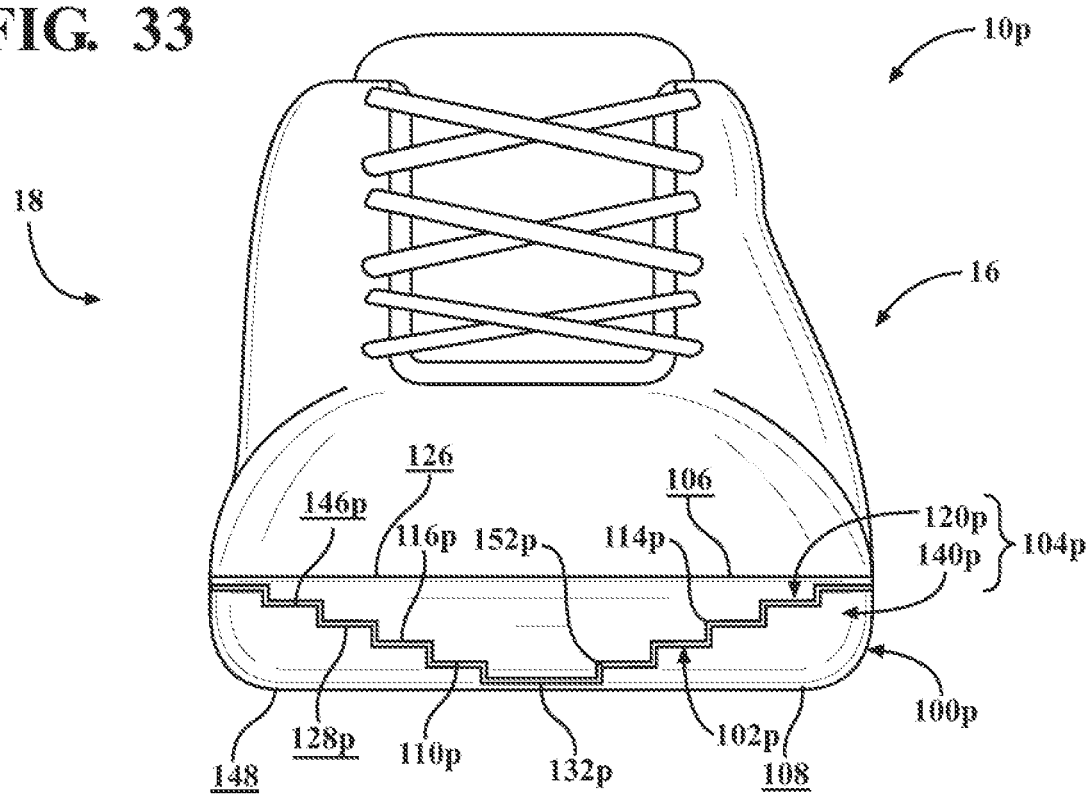
FIGS. 33 and 34 are views of another example of an article of footwear including a sole structure in accordance with the principles of the present disclosure.
Figure 34:
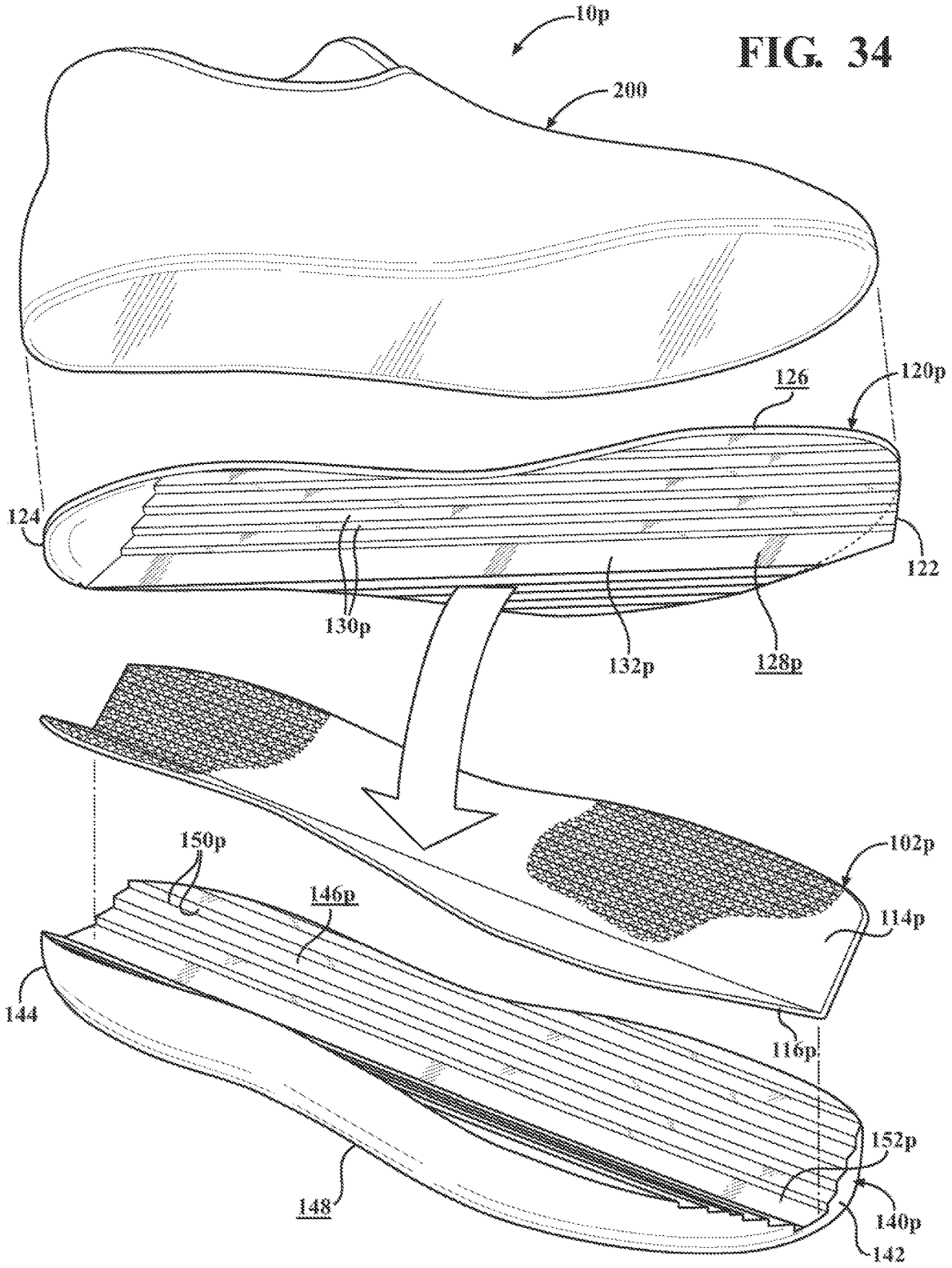

With particular reference to FIGS. 33 and 34, an article of footwear 10*p* is provided and includes a sole structure 100*p* and the upper 200 attached to the sole structure 100*p*. In view of the substantial similarity in structure and function of the components associated with the article of footwear 10 with respect to the article of footwear 10*p*, like reference numerals are used hereinafter and in the drawings to identify like components, while like reference numerals containing letter extensions are used to identify those components that have been modified.

In the example of FIGS. 33 and 34, the sole structure 100*p* includes a fabric panel 102*p* and a cushioning member 104*p*. The cushioning member 104*p* includes a first cushioning element 120*p* extending from the anterior end 12 to the posterior end 14 and a second cushioning element 140*p* disposed beneath the first cushioning element 120*p*. As discussed below, the first cushioning element 120*p* and the second cushioning element 140*p* cooperate with the fabric panel 102*p* to form a V-shaped joint 110*p* extending along the length of the sole structure 100*p*.

The sole structure 100*p* is formed substantially similar to the sole structure 100*n* shown in FIGS. 29 and 30 and discussed above. Accordingly, the first cushioning element 120*p* includes a bottom surface 128*p* that forms a first mating feature 132*p* in the form of a spine or ridge 132*p* extending along the length of the sole structure 100*p*. Similarly, the second cushioning element 140*p* includes a top surface 146*p* that forms a second mating feature 152*p* in the form of a receptacle or channel 152*p* that is configured to mate with the ridge 132*p* of the first cushioning element 120*p*.

Unlike the sole structure 100*n* of FIGS. 29 and 30, the mating features 132*p*, 152*p* each include a series of steps 130*p*, 150*p* formed therein. In the illustrated example, the ridge 132*p* of the first cushioning element 120*p* includes a plurality of steps 130*p* arranged in series along the first portion and the second portion of the bottom surface 128*p*. Accordingly, a first plurality of the steps 130*p* is arranged in series from the lateral side 16 to the central portion and a second plurality of the steps 130*p* is arranged in series from the medial side 18 to the central portion. Each of the steps 130*p* extends continuously along an entire length of the first cushioning element 120*p*, from the first end 122 to the second end 124.

The channel 152*p* of the second cushioning element 140*p* includes a plurality of steps 150*p* arranged in series along the first portion and the second portion of the top surface 146*p*. Accordingly, a first plurality of the steps 150*p* is arranged in series from the lateral side 16 to the central portion and a second plurality of the steps 150*p* is arranged in series from the medial side 18 to the central portion. Each of the steps 150*p* extends continuously along an entire length of the second cushioning element 140*p*, from the first end 142 to the second end 144.

When the sole structure 100*p* is assembled, first mating feature 132*p* on the bottom surface 128*p* of the first cushioning element 120*p* mates with and is joined to the second mating feature 152*p* on the top surface 146*p* of the second cushioning element 140*p* to form the joint 110*p* extending along the length of the sole structure 100*p*. The fabric panel 102*p* is interposed between the bottom surface 128*p* of the first cushioning element 120*p* and the top surface 146*p* of the second cushioning element 140*p* to form the first joint 110*p* of the sole structure 100*p*. Here, the first joint 110*p* and the fabric panel 102*p* have a V-shaped cross section extending continuously from the anterior end 12 to the posterior end 14. Accordingly, the fabric panel 102*p* is formed to include a first portion 114*p* extending along the lateral side 16 and a second portion 116*p* extending along the medial side 18. However, as best shown in FIG. 33, the joint 110*p* has an incremental or stepped profile formed by the mating features 132*p*, 152*p*.

Figure 35:
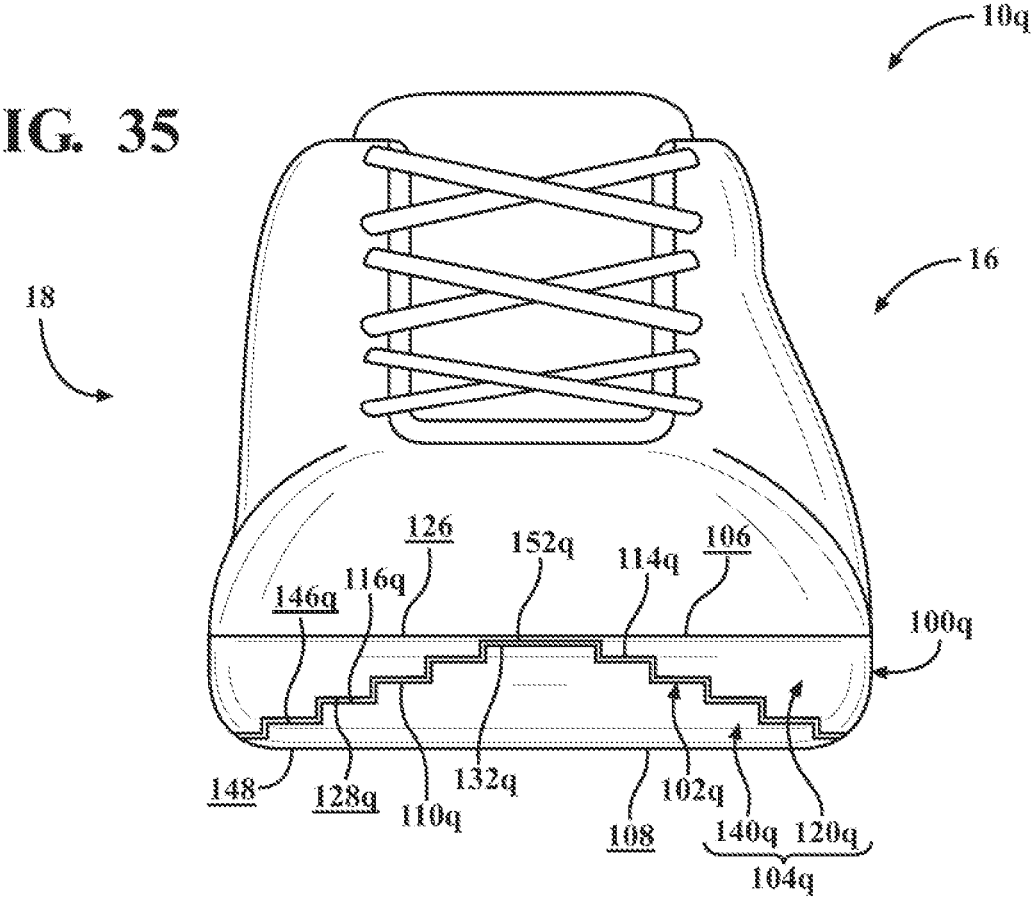
FIGS. 35 and 36 are views of another example of an article of footwear including a sole structure in accordance with the principles of the present disclosure.
Figure 36:
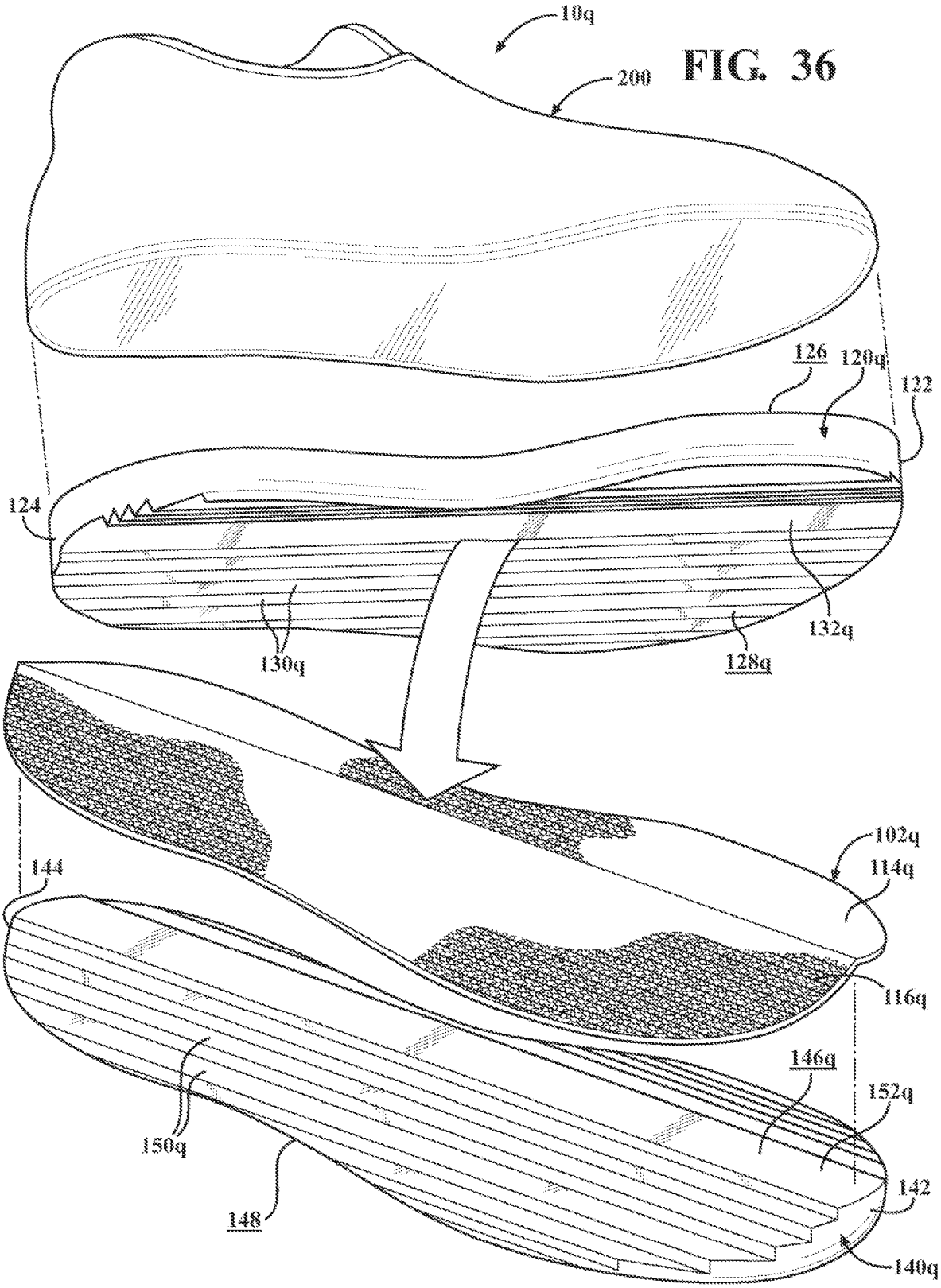

With particular reference to FIGS. 35 and 36, an article of footwear 10*q* is provided and includes a sole structure 100*q* and the upper 200 attached to the sole structure 100*q*. In view of the substantial similarity in structure and function of the components associated with the article of footwear 10 with respect to the article of footwear 10*q*, like reference numerals are used hereinafter and in the drawings to identify like components, while like reference numerals containing letter extensions are used to identify those components that have been modified.

In the example of FIGS. 35 and 36, the sole structure 100*q* includes a fabric panel 102*q* and a cushioning member 104*q*. The cushioning member 104*q* includes a first cushioning element 120*q* extending from the anterior end 12 to the posterior end 14 and a second cushioning element 140*q* disposed beneath the first cushioning element 120*q*. As discussed below, the first cushioning element 120*q* and the second cushioning element 140*q* cooperate with the fabric panel 102*q* to form an A-shaped or inverted V-shaped joint 110*q* extending along the length of the sole structure 100*q*.

The sole structure 100*q* is formed substantially similar to the sole structure 100*o* shown in FIGS. 31 and 32 and discussed above. Accordingly, the first cushioning element 120*q* includes a bottom surface 128*q* that forms a first mating feature 132*q* in the form of a receptacle or channel 132*q* extending along the length of the sole structure 100*q*. Similarly, the second cushioning element 140*q* includes a top surface 146*q* that forms a second mating feature 152*q* in the form of a spine or ridge 152*q* that is configured to mate with the channel 132*q* of the first cushioning element 120*q*.

Unlike the sole structure 100*o* of FIGS. 31 and 32, the mating features 132*q*, 152*q* each include a series of steps 130*q*, 150*q* formed therein. In the illustrated example, the channel 132*q* of the first cushioning element 120*q* includes a plurality of steps 130*q* arranged in series along the first portion and the second portion of the bottom surface 128*q*. Accordingly, a first plurality of the steps 130*q* is arranged in series from the lateral side 16 to the central portion and a second plurality of the steps 130*q* is arranged in series from the medial side 18 to the central portion. Each of the steps 130*p* extends continuously along an entire length of the first cushioning element 120*q*, from the first end 122 to the second end 124.

The ridge 152*q* of the second cushioning element 140*q* includes a plurality of steps 150*q* arranged in series along the first portion and the second portion of the top surface 146*q*. Accordingly, a first plurality of the steps 150*q* is arranged in series from the lateral side 16 to the central portion and a second plurality of the steps 150*q* is arranged in series from the medial side 18 to the central portion. Each of the steps 150*q* extends continuously along an entire length of the first cushioning element 120*q*, from the first end 122 to the second end 124.

When the sole structure 100*q* is assembled, the first mating feature 132*q* on the bottom surface 128*q* of the first cushioning element 120*q* mates with and is joined to the second mating feature 152*q* on the top surface 146*q* of the second cushioning element 140*q* to form the joint 110*q* extending along the length of the sole structure 100*p*. The fabric panel 102*q* is interposed between the bottom surface 128*q* of the first cushioning element 120*q* and the top surface 146*q* of the second cushioning element 140*q*. Here, the first joint 110*q* and the fabric panel 102*q* have an A-shaped or inverted V-shaped cross section extending continuously from the anterior end 12 to the posterior end 14. Accordingly, the fabric panel 102*q* is formed to include a first portion 114*q* extending along the lateral side 16 and a second portion 116*q* extending along the medial side 18. However, as best shown in FIG. 35, the joint 110*q* has an incremental or stepped profile formed by the mating features 132*q*, 152*q*.

Figure 37:
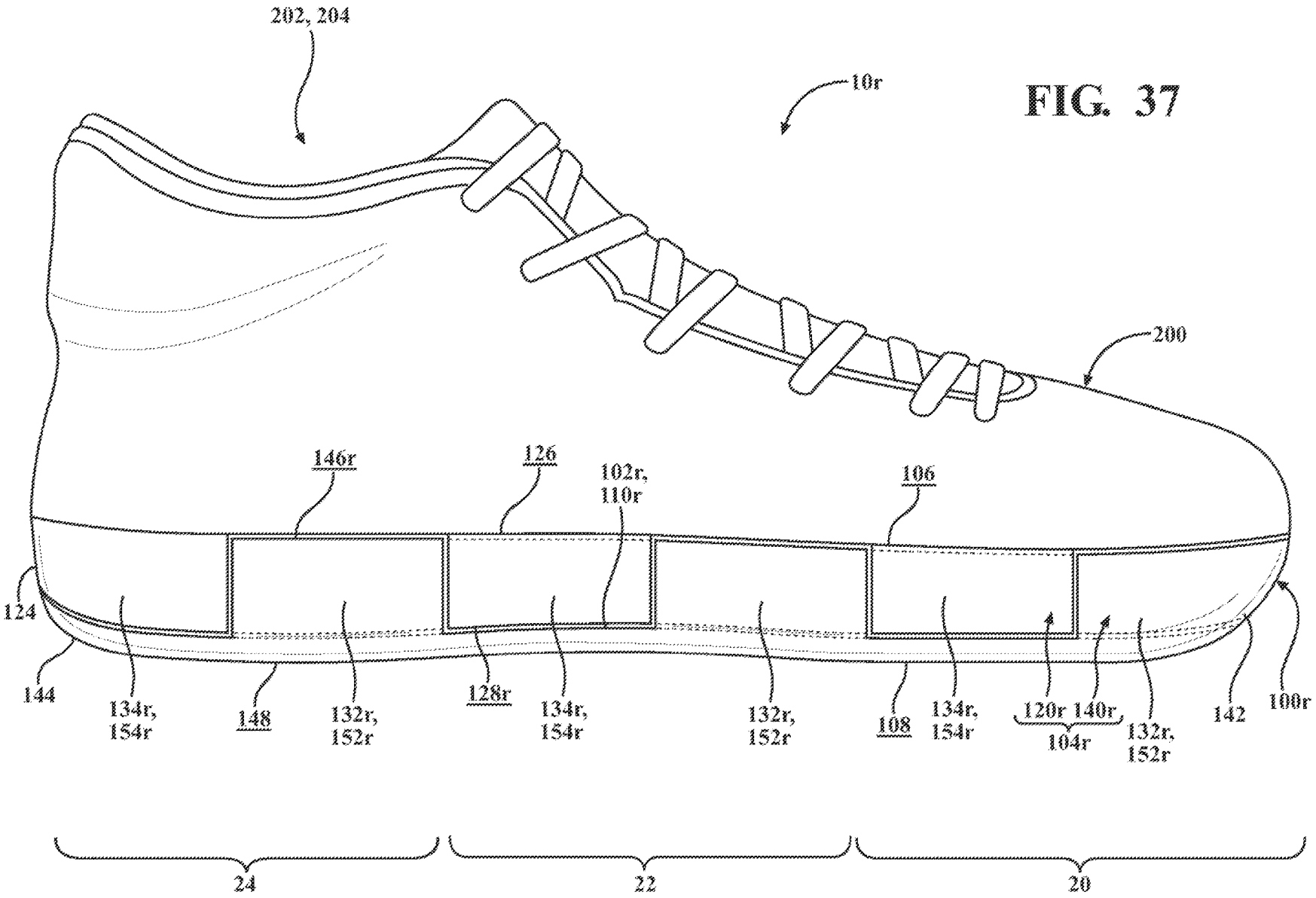
FIGS. 37-39 are views of another example of an article of footwear including a sole structure in accordance with the principles of the present disclosure.
Figure 38:
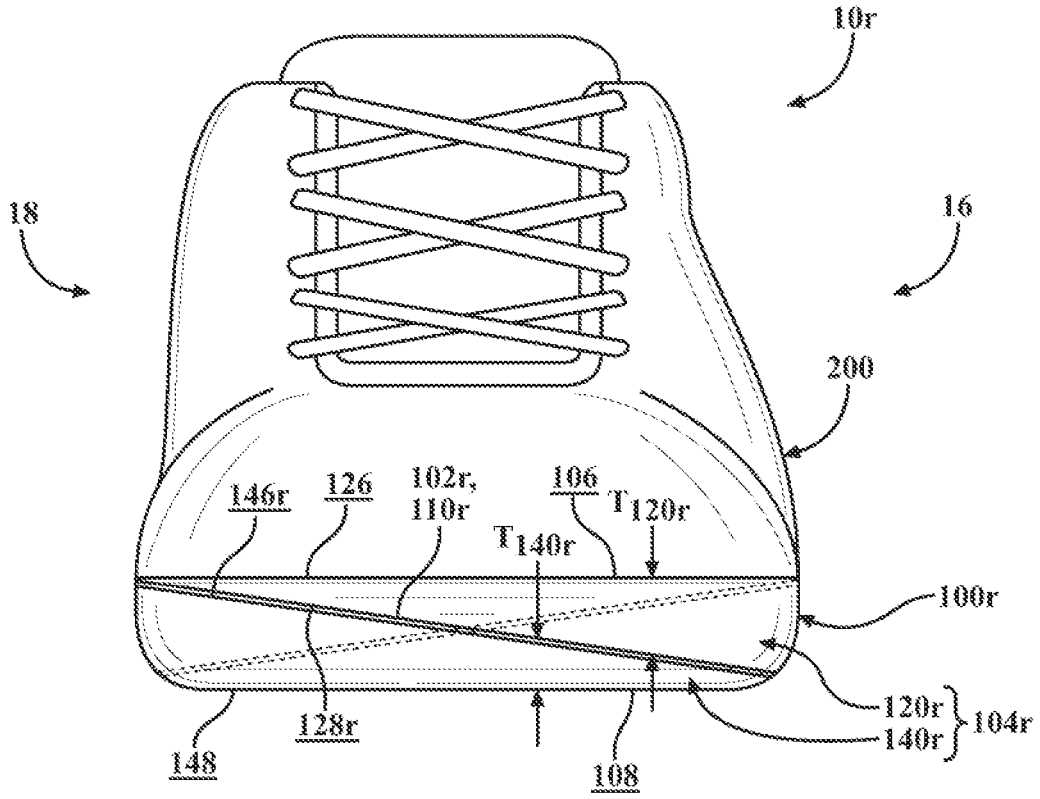
Figure 39:
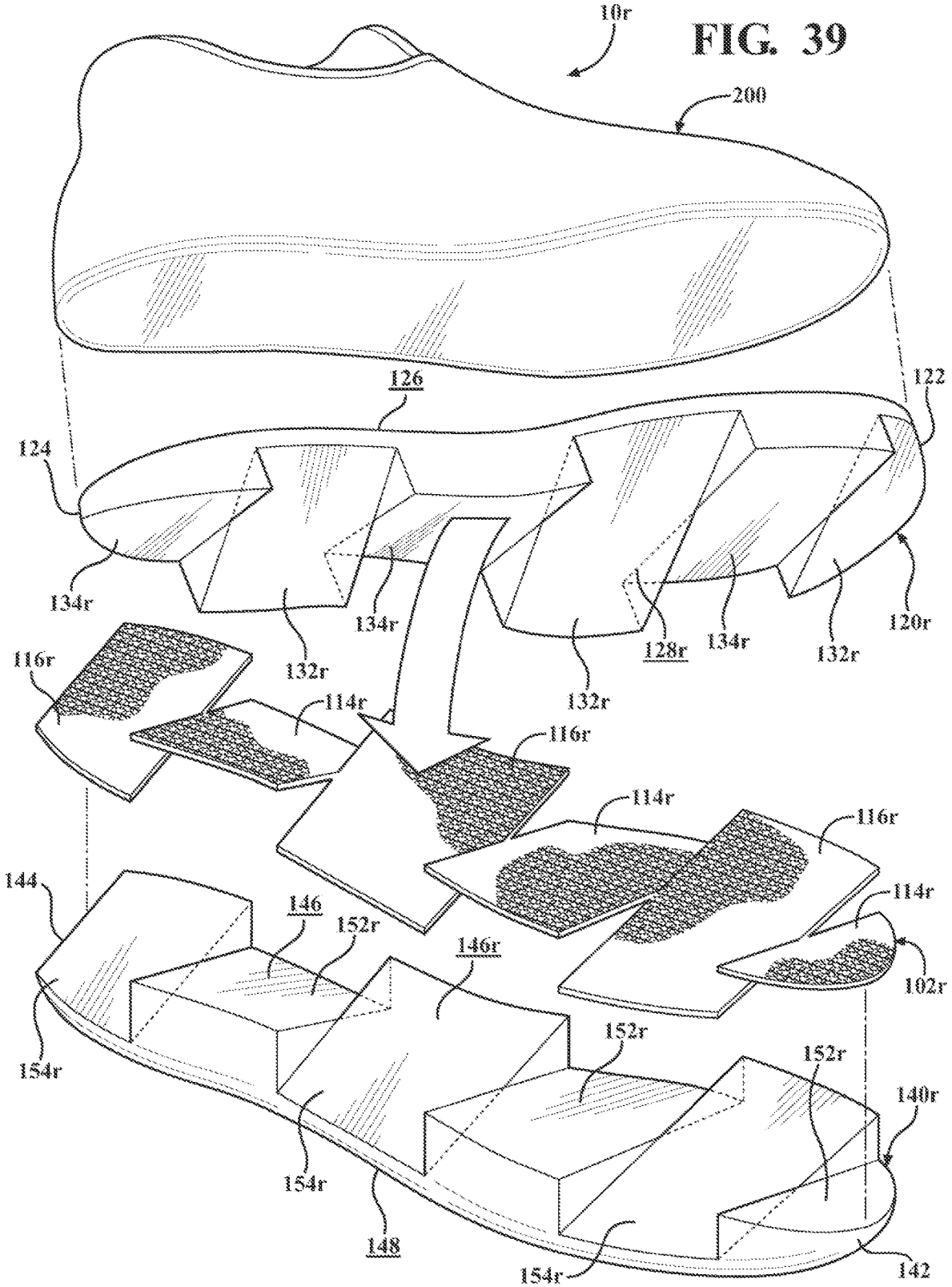

With particular reference to FIGS. 37-39, an article of footwear 10*r* is provided and includes a sole structure 100*r* and the upper 200 attached to the sole structure 100*r*. In view of the substantial similarity in structure and function of the components associated with the article of footwear 10 with respect to the article of footwear 10*r*, like reference numerals are used hereinafter and in the drawings to identify like components, while like reference numerals containing letter extensions are used to identify those components that have been modified.

In the example of FIGS. 37-39, the sole structure 100*r* includes a fabric panel 102*r* and a cushioning member 104*r*. The cushioning member 104*r* includes a first cushioning element 120*r* extending from the anterior end 12 to the posterior end 14 and a second cushioning element 140*r* disposed beneath the first cushioning element 120*r*. As discussed below, the first cushioning element 120*r* and the second cushioning element 140*r* cooperate with the fabric panel 102*r* to form an alternating joint 110*r* extending along the length of the sole structure 100*r*.

With reference to FIG. 39, the first cushioning element 120*r* extends continuously from the first end 122 at the anterior end 12 to a second end 124 at the posterior end 14. The first cushioning element 120*r* includes a top surface 126 extending along the entire length of the first cushioning element 120*r* and forming the footbed 106 of the sole structure 100*r*. A bottom surface 128*r* is formed on an opposite side of the first cushioning element 120*r* from the top surface 126. Thicknesses $T_{120r}$ of the first cushioning element 120*r* are measured along a direction from the top surface 126 to the bottom surface 128*r*.

The bottom surface 128*r* of the first cushioning element 120*r* includes a plurality of first mating features 132*r* and a plurality of second mating features 134*r* arranged in an alternating series along a length of the first cushioning element 120*r* from the first end 122 to the second end 124. In the illustrated example, the first mating features 132*r* are formed by portions or segments of the first cushioning element 120*r* where the thickness $T_{120r}$ tapers constantly and continuously from the lateral side 16 to the medial side 18, while the second mating features 134*r* are formed by portions or segments of the first cushioning element 120*r* where the thickness $T_{120r}$ tapers constantly and continuously from the medial side 18 to the lateral side 16. In other words, the first mating features 132*r* are defined by planar portions or segments of the bottom surface 128*r* that converge with the top surface 126 along a direction from the lateral side 16 to the medial side 18, while the second mating features 134*r* are defined by planar portions or segments of the bottom surface 128*r* that converge with the top surface 126 along a direction from the medial side 18 to the lateral side 16.

In the illustrated example, the bottom surface 128*r* includes three (3) of the first mating features 132*r* and three (3) of the second mating features 134*r* alternatingly arranged. With reference to FIG. 37, the first cushioning element 120*r* includes a first pair of the mating features 132*r*, 134*r* disposed in the forefoot region 20, a second pair of the mating features 132*r*, 134*r* disposed in the mid-foot region 22, and a third pair of the mating features 132*r*, 134*r* disposed in the heel region 24. However, in other examples, the quantity and spacing of the mating features 132*r*, 134*r* may be different.

With reference to FIG. 39, the second cushioning element 140*r* extends continuously from the first end 142 at the anterior end 12 to a second end 144 at the posterior end 14. The second cushioning element 140*r* includes a top surface 146*r* extending along the entire length of the first cushioning element 120*r* and facing the bottom surface 128*r* of the first cushioning element 120*r*. A bottom surface 148 is formed on the opposite side from the top surface 146*r* and forms the ground-engaging surface 108 of the sole structure 100*r*. The top surface 146*r* of the second cushioning element 140*r* includes a plurality of third mating features 152*r* and a plurality of fourth mating features 154*r* arranged in an alternating series along a length of the second cushioning element 140*r* from the first end 142 to the second end 144.

In the illustrated example, the third mating features 152*r* are formed by portions or segments of the second cushioning element 140*r* where the thickness $T_{140r}$ tapers constantly and continuously from the medial side 18 to the lateral side 16, while the fourth mating features 154*r* are formed by portions or segments of the second cushioning element 140*r* where the thickness $T_{140r}$ tapers constantly and continuously from the lateral side 16 to the medial side 18. In other words, the third mating features 152*r* are defined by planar portions or segments of the top surface 146*r* that converge with the bottom surface 148 along a direction from the medial side 18 to the lateral side 16, while the fourth mating features 154*r* are defined by planar portions or segments of the top surface 146*r* that converge with the bottom surface 148 along a direction from the lateral side 16 to the medial side 18. Accordingly, the third and fourth mating features 152*r*, 154*r* are configured to mate with the first and second mating features 132*r*, 134*r* on the bottom of the first cushioning element 120*r*.

In the illustrated example, the top surface 146*r* includes three (3) of the third mating features 152*r* and three (3) of the fourth mating features 154*r* alternatingly arranged. With reference to FIG. 37, the second cushioning element 140*r* includes a first pair of the mating features 152*r*, 154*r* disposed in the forefoot region 20, a second pair of the mating features 152*r*, 154*r* disposed in the mid-foot region 22, and a third pair of the mating features 152*r*, 154*r* disposed in the heel region 24. However, in other examples, the quantity and spacing of the mating features 152*r*, 154*r* may be different.

When the sole structure 100*r* is assembled, the mating features 132*r*, 134*r* of the bottom surface 128*r* of the first cushioning element 120*r* mate with and are joined to the mating features 152*r*, 154*r* of the top surface 146*r* of the second cushioning element 140*r* to define the joint 110*r* along the length of the sole structure 100*r*. Here, the mating features 132*r*, 134*r*, 152*r*, 154*r* are formed by planar portions of the surfaces 128*r*, 148*r*, such that adjacent ones of the mating features 132*r*, 134*r*, 152*r*, 154*r* are distinctly formed.

The fabric panel 102*r* is disposed within the joint 110*r* between the bottom surface 128*r* of the first cushioning element 120*r* and the top surface 146*r* of the second cushioning element 140*r*. As best shown in FIG. 39, the fabric panel 102*r* includes a plurality of first portions 114*r* and a plurality of second portions 116*r* alternatingly arranged along the length of the sole structure 100*r*. The first portions 114*r* are configured to be interposed between opposing pairs of the first mating features 132*r* and third mating features 152*r*, while the second portions 116*r* are configured to be interposed between opposing pairs of the second mating features 134*r* and the fourth mating features 154*r*.

Figure 40:
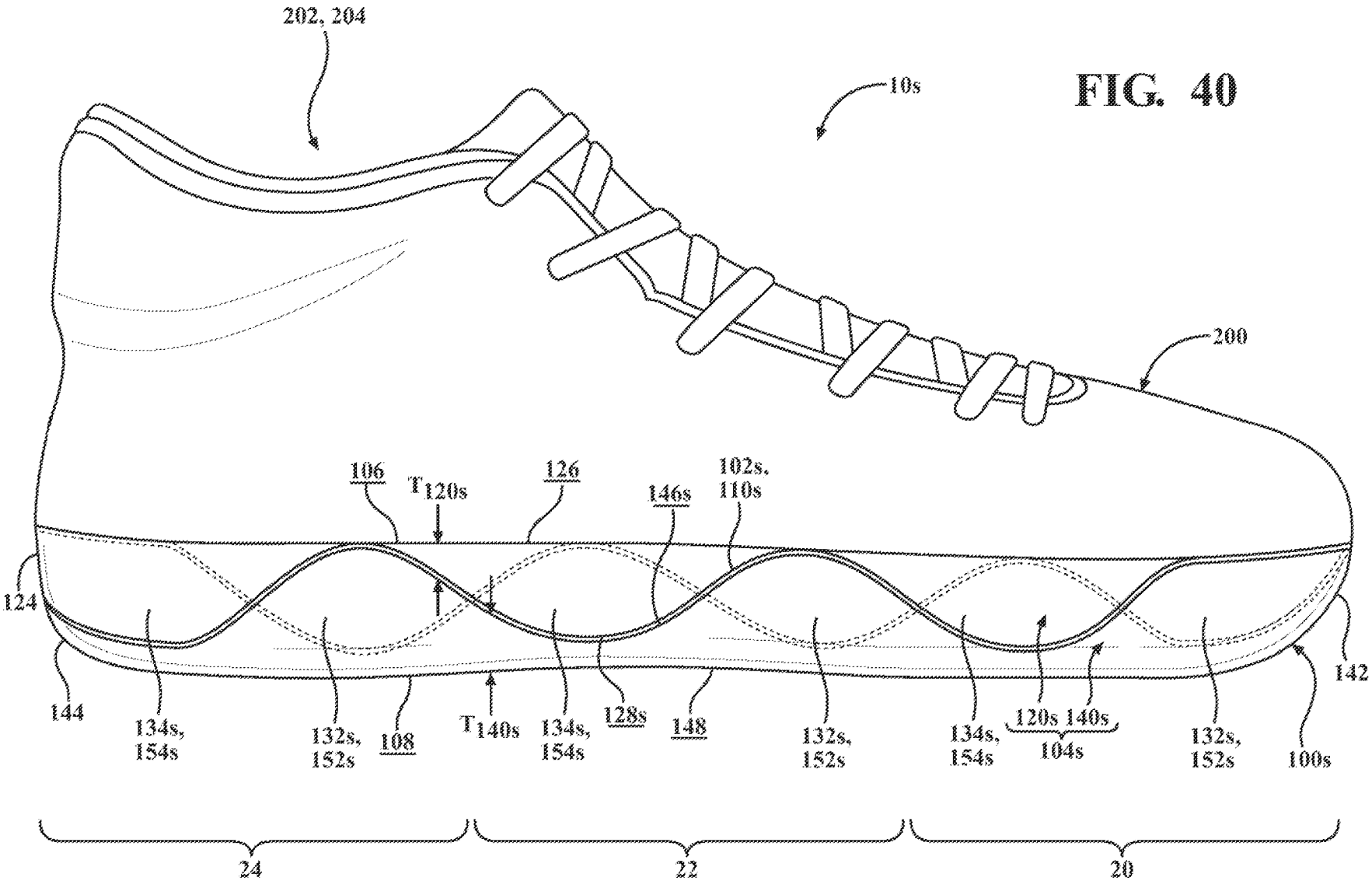
FIGS. 40-42 are views of another example of an article of footwear including a sole structure in accordance with the principles of the present disclosure.
Figure 41:
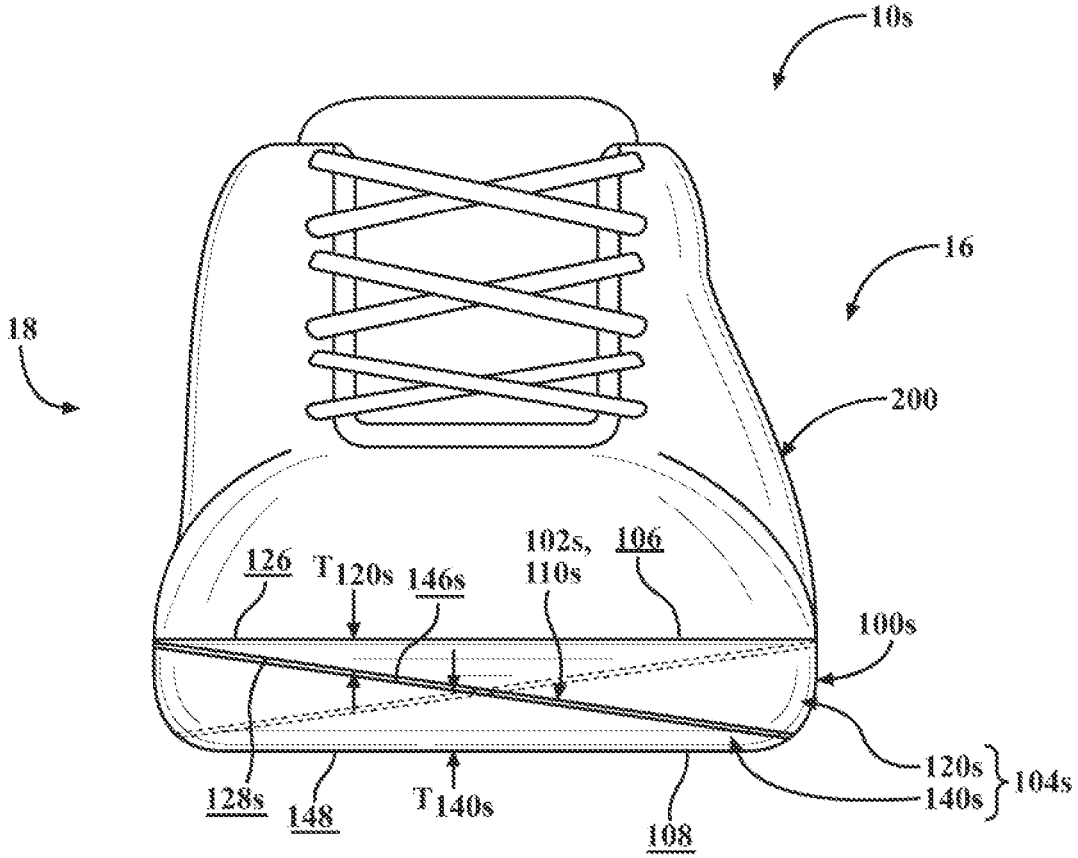
Figure 42:
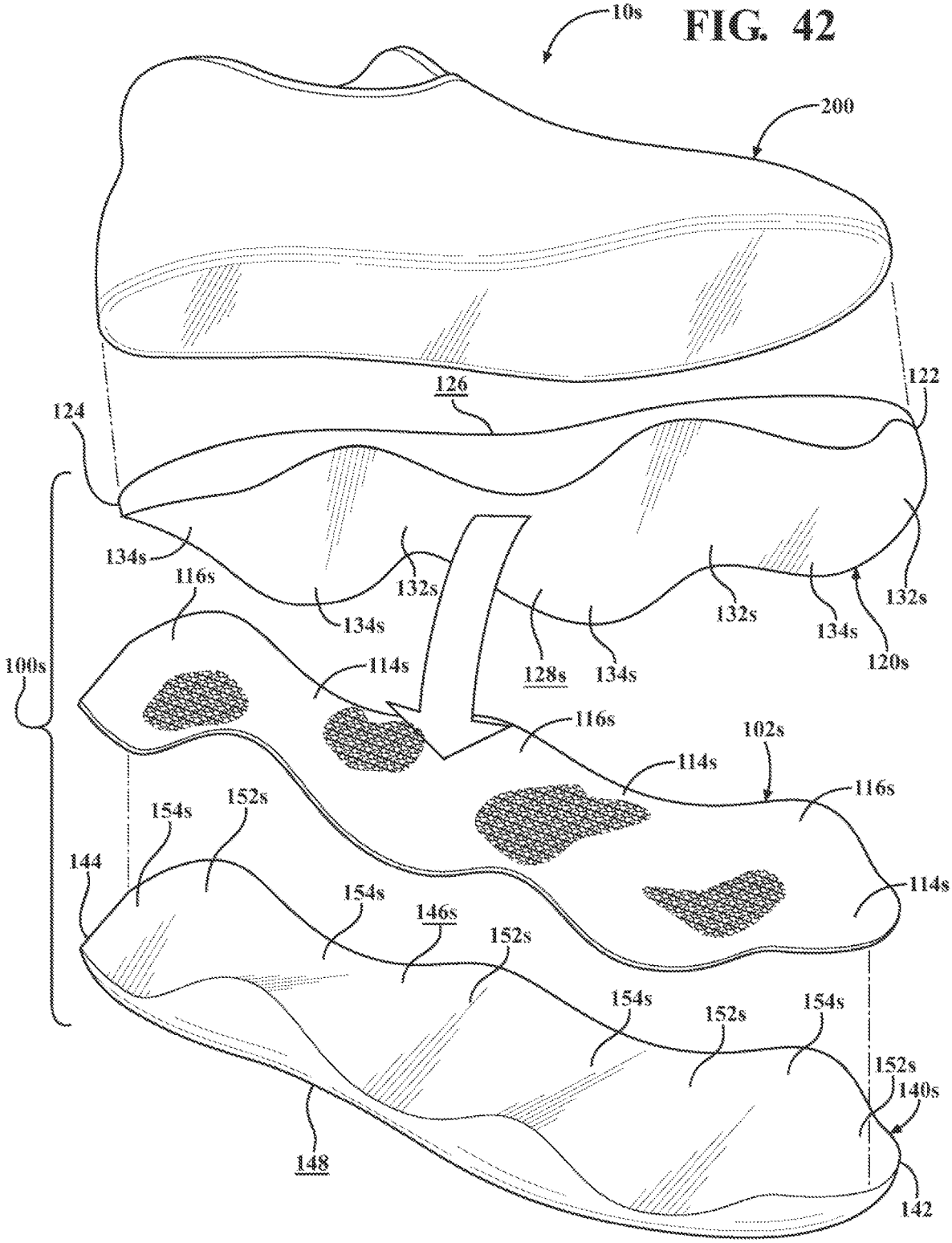

With particular reference to FIGS. 40-42, an article of footwear 10*s* is provided and includes a sole structure 100*s* and the upper 200 attached to the sole structure 100*s*. In view of the substantial similarity in structure and function of the components associated with the article of footwear 10 with respect to the article of footwear 10*s*, like reference numerals are used hereinafter and in the drawings to identify like components, while like reference numerals containing letter extensions are used to identify those components that have been modified.

In the example of FIGS. 40-42, the sole structure 100*s* includes a fabric panel 102*s* and a cushioning member 104*s*. The cushioning member 104*s* includes a first cushioning element 120*s* extending from the anterior end 12 to the posterior end 14 and a second cushioning element 140*s* disposed beneath the first cushioning element 120*s*. As discussed below, the first cushioning element 120*s* and the second cushioning element 140*s* cooperate with the fabric panel 102*s* to form an alternating joint 110*s* extending along the length of the sole structure 100*s*.

With reference to FIG. 42, the first cushioning element 120*s* extends continuously from the first end 122 at the anterior end 12 to a second end 124 at the posterior end 14. The first cushioning element 120*s* includes a top surface 126 extending along the entire length of the first cushioning element 120*s* and forming the footbed 106 of the sole structure 100*s*. A bottom surface 128*s* is formed on an opposite side of the first cushioning element 120*s* from the top surface 126*s*. Thicknesses $T_{120s}$ of the first cushioning element 120*s* are measured along a direction from the top surface 126 to the bottom surface 128*s*.

The bottom surface 128*s* of the first cushioning element 120*s* includes a plurality of first mating features 132*s* and a plurality of second mating features 134*s* arranged in an alternating series along a length of the first cushioning element 120*s* from the first end 122 to the second end 124. In the illustrated example, the first mating features 132*s* are formed by portions of the first cushioning element 120*s* where the thickness $T_{120s}$ tapers continuously from the lateral side 16 to the medial side 18, while the second mating features 134*s* are formed by portions of the first cushioning element 120*s* where the thickness $T_{120s}$ tapers continuously from the medial side 18 to the lateral side 16. In other words, the first mating features 132*s* are defined by portions of the bottom surface 128*s* that converge with the top surface 126 along a direction from the lateral side 16 to the medial side 18, while the second mating features 134*s* are defined by portions of the bottom surface 128*r* that converge with the top surface 126 along a direction from the medial side 18 to the lateral side 16.

In the illustrated example, the bottom surface 128*s* includes three (3) of the first mating features 132*s* and three (3) of the second mating features 134*s* alternatingly arranged. With reference to FIG. 41, the first cushioning element 120*s* includes a first pair of the mating features 132*s*, 134*s* disposed in the forefoot region 20, a second pair of the mating features 132*s*, 134*s* disposed in the mid-foot region 22, and a third pair of the mating features 132*s*, 134*s* disposed in the heel region 24. However, in other examples, the quantity and spacing of the mating features 132*s*, 134*s* may be different.

With reference to FIG. 42, the second cushioning element 140*s* extends continuously from the first end 142 at the anterior end 12 to a second end 144 at the posterior end 14. The second cushioning element 140*s* includes a top surface 146*s* extending along the entire length of the first cushioning element 120*s* and facing the bottom surface 128*s* of the first cushioning element 120*s*. A bottom surface 148 is formed on the opposite side from the top surface 146*s* and forms the ground-engaging surface 108 of the sole structure 100*s*. The top surface 146*s* of the second cushioning element 140*s* includes a plurality of third mating features 152*s* and a plurality of fourth mating features 154*s* arranged in an alternating series along a length of the second cushioning element 140*s* from the first end 142 to the second end 144.

In the illustrated example, the third mating features 152*s* are formed by portions or segments of the second cushioning element 140*s* where the thickness $T_{140s}$ tapers continuously from the medial side 18 to the lateral side 16, while the fourth mating features 154*s* are formed by portions or segments of the second cushioning element 140*s* where the thickness $T_{140s}$ tapers continuously from the lateral side 16 to the medial side 18. In other words, the third mating features 152*s* are defined by portions or segments of the top surface 146*s* that converge with the bottom surface 148 along a direction from the medial side 18 to the lateral side 16, while the fourth mating features 154*s* are defined by portions or segments of the top surface 146*s* that converge with the bottom surface 148 along a direction from the lateral side to the medial side 18. Accordingly, the third and fourth mating features 152*s*, 154*s* are configured to mate with the first and second mating features 132*s*, 134*s* on the bottom of the first cushioning element 120*s*.

In the illustrated example, the top surface 146*s* includes three (3) of the third mating features 152*s* and three (3) of the fourth mating features 154*s* alternatingly arranged. With reference to FIG. 40, the second cushioning element 140*s* includes a first pair of the mating features 152*s*, 154*s* disposed in the forefoot region 20, a second pair of the mating features 152*s*, 154*s* disposed in the mid-foot region 22, and a third pair of the mating features 152*s*, 154*s* disposed in the heel region 24. However, in other examples, the quantity and spacing of the mating features 152*s*, 154*s* may be different.

When the sole structure 100*s* is assembled, the mating features 132*s*, 134*s* of the bottom surface 128*s* of the first cushioning element 120*s* mate with and are joined to the mating features 152*s*, 154*s* of the top surface 146*s* of the second cushioning element 140*s* to define the joint 110*s* along the length of the sole structure 110*s*. However, unlike the sole structure 100*r* of FIGS. 37-39, which includes mating features 132*r*, 134*r*, 152*r*, 154*r* that are distinctly formed by alternating planar portions of the bottom surface 128*r* and top surface 146*r*, the mating features 132*s*, 134*s*, 152*s*, 154*s* are formed continuously and without interruption along the lengths of the cushioning elements 120*s*, 140*s*. Here, the mating features 132*s*, 134*s*, 152*s*, 154*s* each transition from a convex profile on a thicker first side 16, 18 to a concave profile on the thinner second side 16, 18. Accordingly, the alternating arrangement of the first and second mating features 132*s*, 134*s* along the length of the first cushioning element 120*s* forms an undulated profile along the bottom surface 128*s*. Likewise, the alternating arrangement of the third and fourth mating features 152*s*, 154*s* along the length of the second cushioning element 140*s* forms an undulated profile along the top surface 146*s* that is complementary (e.g., mates with) the profile of the bottom surface 128*s*.

The fabric panel 102*s* is interposed between the bottom surface 128*s* of the first cushioning element 120*s* and the top surface 146*s* of the second cushioning element 140*s* to form the first joint 110*s* of the sole structure 100*s*. As best shown in FIG. 42, the fabric panel 102*s* includes a plurality of first portions 114*s* and a plurality of second portions 116*s* alternatingly arranged along the length of the sole structure 100*s*. The first portions 114*s* are configured to be interposed between opposing pairs of the first mating features 132*s* and third mating features 152*s*, while the second portions 116*s* are configured to be interposed between opposing pairs of the second mating features 134*s* and the fourth mating features 154*s*.

Figure 43:
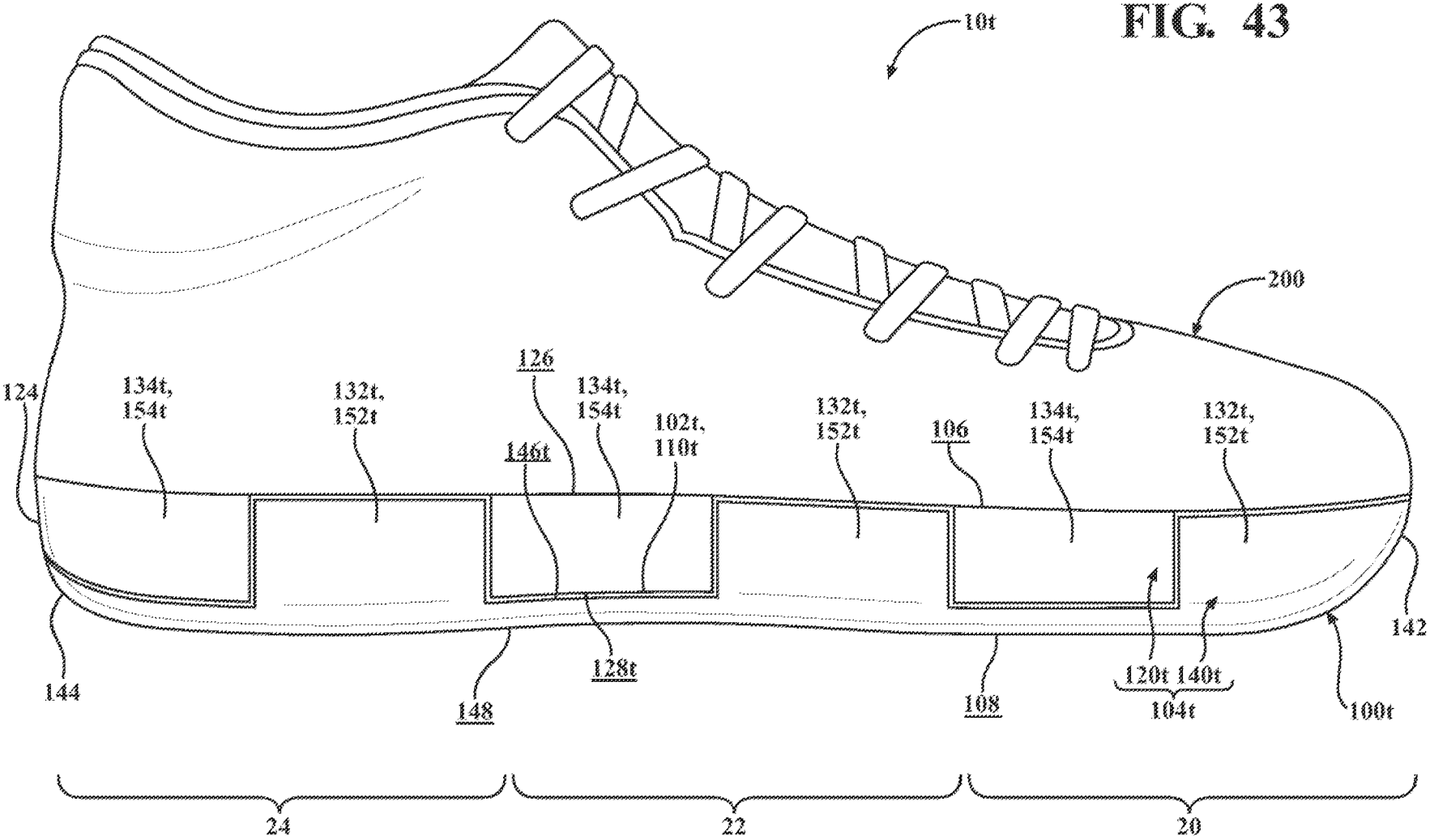
FIGS. 43-45 are views of another example of an article of footwear including a sole structure in accordance with the principles of the present disclosure.
Figure 44:
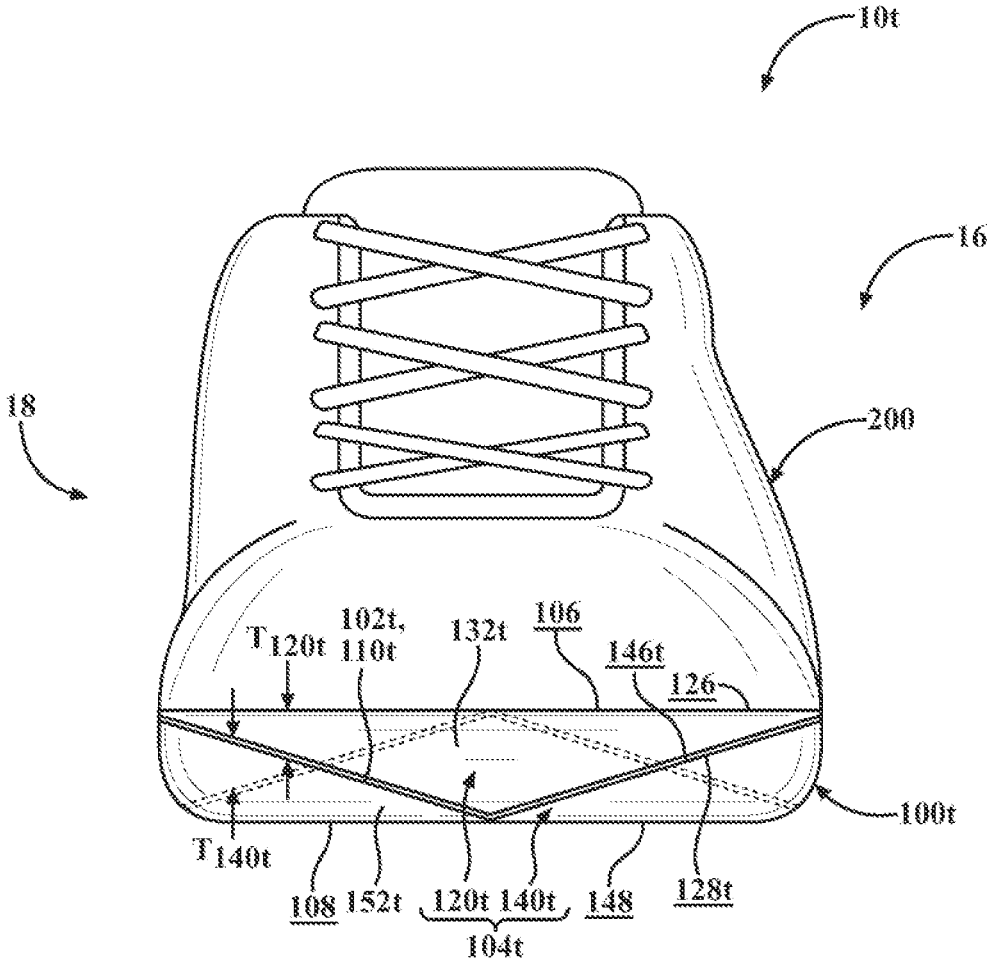
Figure 45:
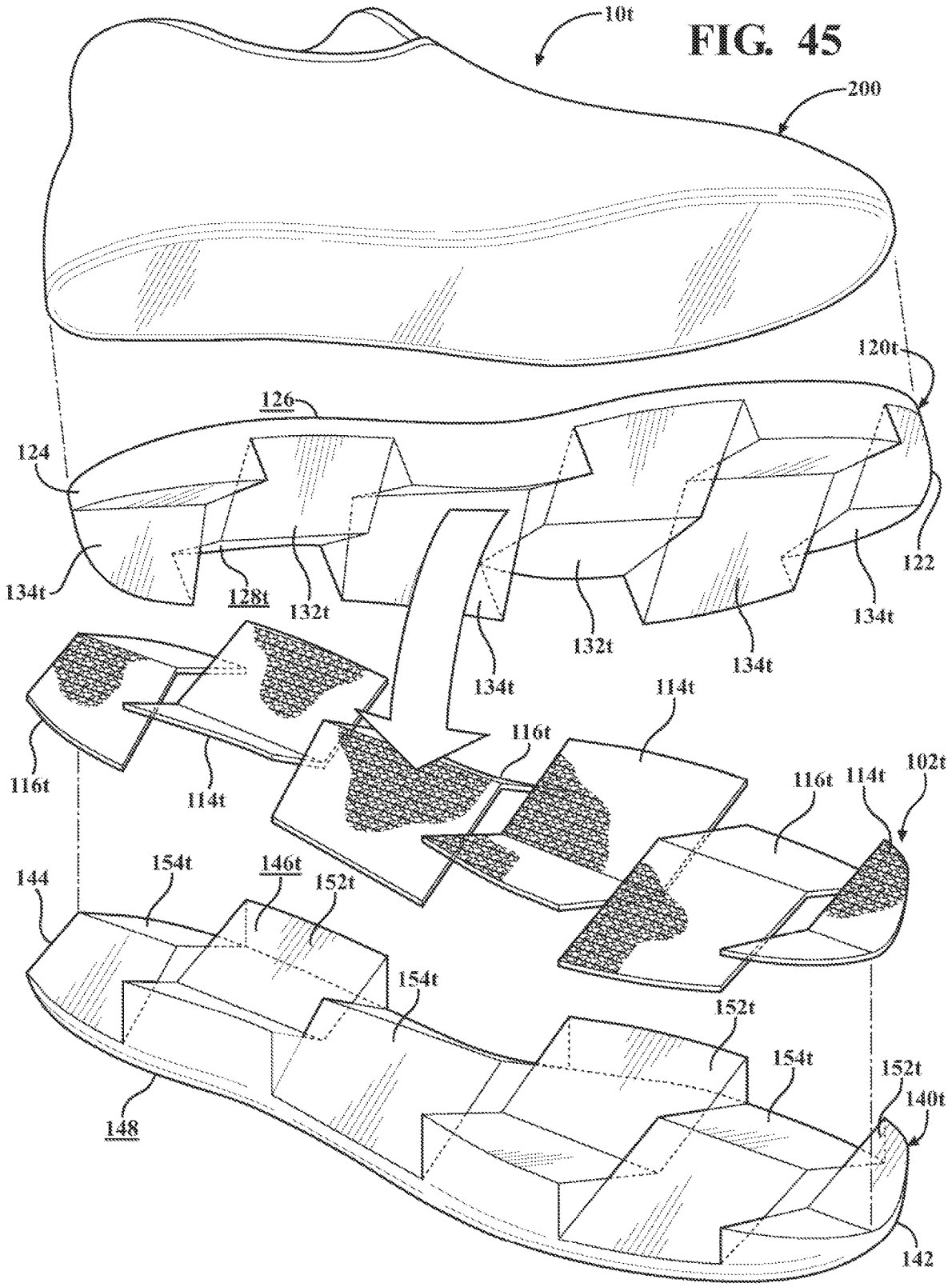

With particular reference to FIGS. 43-45, an article of footwear 10*t* is provided and includes a sole structure 100*t* and the upper 200 attached to the sole structure 100*t*. In view of the substantial similarity in structure and function of the components associated with the article of footwear 10 with respect to the article of footwear 10*t*, like reference numerals are used hereinafter and in the drawings to identify like components, while like reference numerals containing letter extensions are used to identify those components that have been modified.

In the example of FIGS. 43-45, the sole structure 100*t* includes a fabric panel 102*t* and a cushioning member 104*t*. The cushioning member 104*t* includes a first cushioning element 120*t* extending from the anterior end 12 to the posterior end 14 and a second cushioning element 140*t* disposed beneath the first cushioning element 120*t*. As discussed below, the first cushioning element 120*t* and the second cushioning element 140*t* cooperate with the fabric panel 102*t* to form an alternating joint 110*t* extending along the length of the sole structure 100*t*.

The first cushioning element 120*t* extends continuously from the first end 122 at the anterior end 12 to a second end 124 at the posterior end 14. The first cushioning element 120*t* includes a top surface 126 extending along the entire length of the first cushioning element 120*t* and forming the footbed 106 of the sole structure 100*t*. A bottom surface 128*t* is formed on an opposite side of the first cushioning element 120*t* from the top surface 126*t*. Thicknesses $T_{120t}$ of the first cushioning element 120*t* are measured along a direction from the top surface 126 to the bottom surface 128*t*.

The bottom surface 128*t* of the first cushioning element 120*t* includes a plurality of first mating features 132*t* and a plurality of second mating features 134*t* arranged in an alternating series along a length of the first cushioning element 120*t* from the first end 122 to the second end 124. In the illustrated example, the first mating features 132*t* are formed by portions or segments of the first cushioning element 120*t* where the thickness $T_{120r}$ increases constantly and continuously from each of the lateral side 16 and the medial side 18 towards the center, such that the first mating features 132*t* form V-shaped ridges 132*t* along the bottom surface 128*t*. The second mating features 134*t* are formed by portions or segments of the first cushioning element 120*t* where the thickness $T_{120t}$ tapers constantly and continuously from each of the lateral side 16 and the medial side 18 towards the center, such that the second mating features 134*t* form A-shaped or inverted V-shaped receptacles or grooves in the bottom surface 128*t*. In other words, the first mating features 132*t* are defined by planar portions or segments of the bottom surface 128*t* that diverge from the top surface 126 along a direction from the lateral side 16 and the medial side 18 towards the center, while the second mating features 134*t* are defined by planar portions or segments of the bottom surface 128*t* that converge with the top surface 126 along a direction from each of the medial side 18 and the lateral side 16 towards the center.

In the illustrated example, the bottom surface 128*t* includes three (3) of the first mating features 132*t* and three (3) of the second mating features 134*t* alternatingly arranged. With reference to FIG. 43, the first cushioning element 120*t* includes a first pair of the mating features 132*t*, 134*t* disposed in the forefoot region 20, a second pair of the mating features 132*t*, 134*t* disposed in the mid-foot region 22, and a third pair of the mating features 132*t*, 134*t* disposed in the heel region 24. However, in other examples, the quantity and spacing of the mating features 132*t*, 134*t* may be different.

The second cushioning element 140*t* extends continuously from the first end 142 at the anterior end 12 to a second end 144 at the posterior end 14. The second cushioning element 140*t* includes a top surface 146*t* extending along the entire length of the first cushioning element 120*t* and facing the bottom surface 128*t* of the first cushioning element 120*t*. A bottom surface 148 is formed on the opposite side from the top surface 146*t* and forms the ground-engaging surface 108 of the sole structure 100*t*.

The top surface 146*t* of the second cushioning element 140*t* includes a plurality of third mating features 152*t* and a plurality of fourth mating features 154*t* arranged in an alternating series along a length of the second cushioning element 140*t* from the first end 142 to the second end 144. In the illustrated example, the third mating features 152*t* are formed by portions or segments of the second cushioning element 140*r* where the thickness $T_{140r}$ tapers constantly and continuously from each of the lateral side 16 and the medial side 18 towards the center, such that the third mating features 152*t* form V-shaped channels 152*t* along the top surface 146*t*. The fourth mating features 154*t* are formed by portions or segments of the second cushioning element 140*t* where the thickness $T_{140t}$ increases constantly and continuously from each of the lateral side 16 and the medial side 18 towards the center, such that the fourth mating features 154*t* form A-shaped or inverted V-shaped ridges 154*t* on the top surface 146*t*. In other words, the third mating features 152*t* are defined by planar portions or segments of the top surface 146*t* that converge with the bottom surface 148 along a direction from each of the lateral side 16 and the medial side 18 towards the center, while the fourth mating features 154*t* are defined by planar portions or segments of the top surface 146*t* that diverge from the bottom surface 148 along a direction from each of the medial side 18 and the lateral side 16 towards the center.

In the illustrated example, the top surface 146*t* includes three (3) of the third mating features 152*t* and three (3) of the fourth mating features 154*t* alternatingly arranged. With reference to FIG. 43, the second cushioning element 140*t* includes a first pair of the mating features 152*t*, 154*t* disposed in the forefoot region 20, a second pair of the mating features 152*t*, 154*t* disposed in the mid-foot region 22, and a third pair of the mating features 152*t*, 154*t* disposed in the heel region 24. Each pair of the mating features 152*t*, 154*t* interfaces with a corresponding pair of the mating features 132*t*, 134*t* of the first cushioning element 120*t*. In other examples, the quantity and spacing of the mating features 152*t*, 154*t* may be different.

When the sole structure 100*t* is assembled, the mating features 132*t*, 134*t* of the bottom surface 128*t* of the first cushioning element 120*t* mate with and are joined to the mating features 152*t*, 154*t* of the top surface 146*t* of the second cushioning element 140*t* to define the joint 110*t* along the length of the sole structure 100*t*. Here, the mating features 132*t*, 134*t*, 152*t*, 154*t* are formed by planar portions of the surfaces 128*t*, 146*t*, such that adjacent ones of the mating features 132*t*, 134*t*, 152*t*, 154*t* are distinctly formed.

The fabric panel 102*t* is disposed within the joint 110*t* between the bottom surface 128*t* of the first cushioning element 120*t* and the top surface 146*t* of the second cushioning element 140*t*. As best shown in FIG. 45, the fabric panel 102*t* includes a plurality of first portions 114*t* and a plurality of second portions 116*t* alternatingly arranged along the length of the sole structure 100*t*. The first portions 114*t* are configured to be interposed between opposing pairs of the first mating features 132*t* and third mating features 152*t*, while the second portions 116*t* are configured to be interposed between opposing pairs of the second mating features 134*t* and the fourth mating features 154*t*. In this example, the fabric panel 102*t* extends along the entire joint 110*t* from the anterior end 12 to the posterior end 14.

Figure 46:
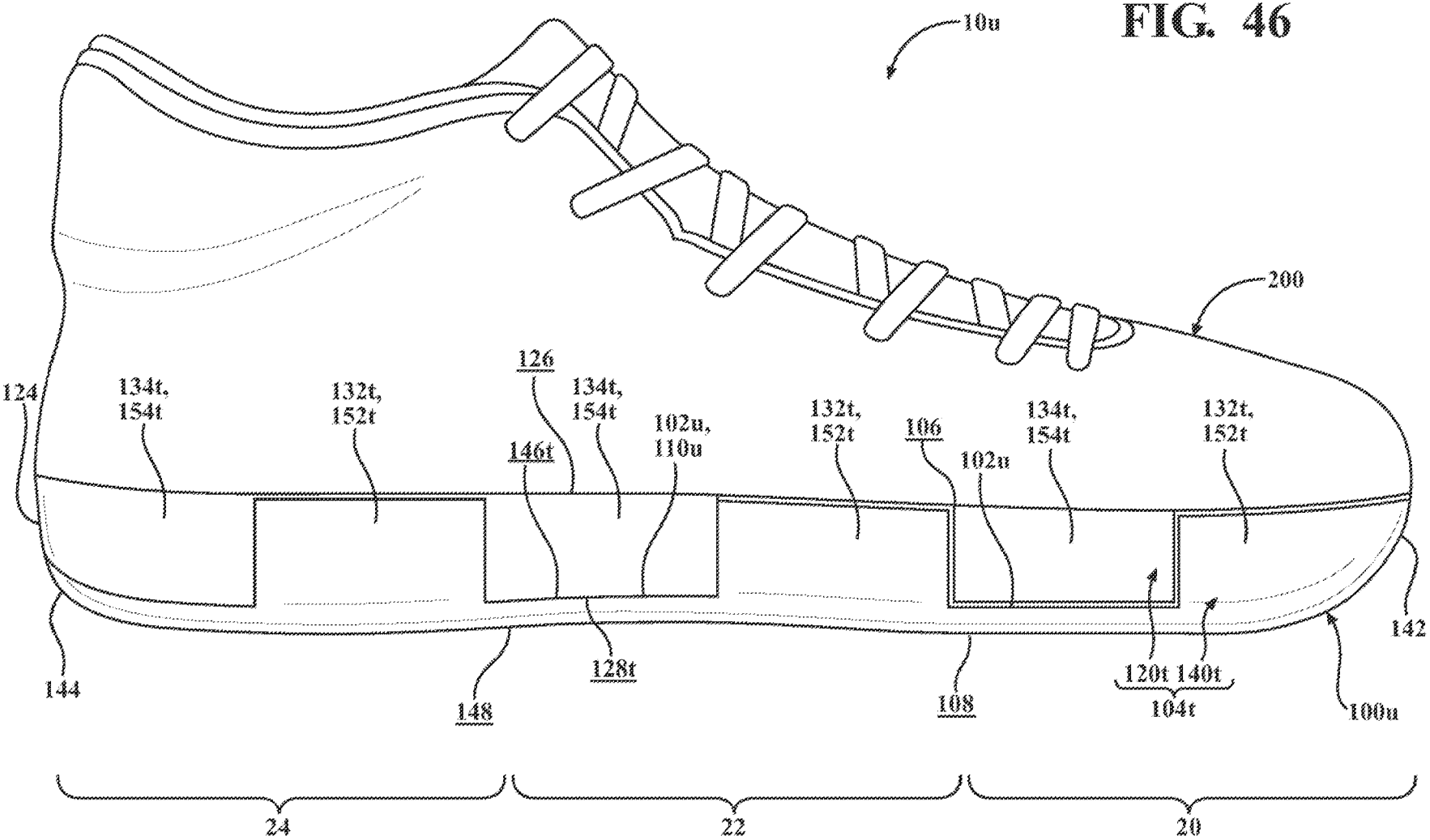
FIGS. 46-48 are views of another example of an article of footwear including a sole structure in accordance with the principles of the present disclosure.
Figure 47:
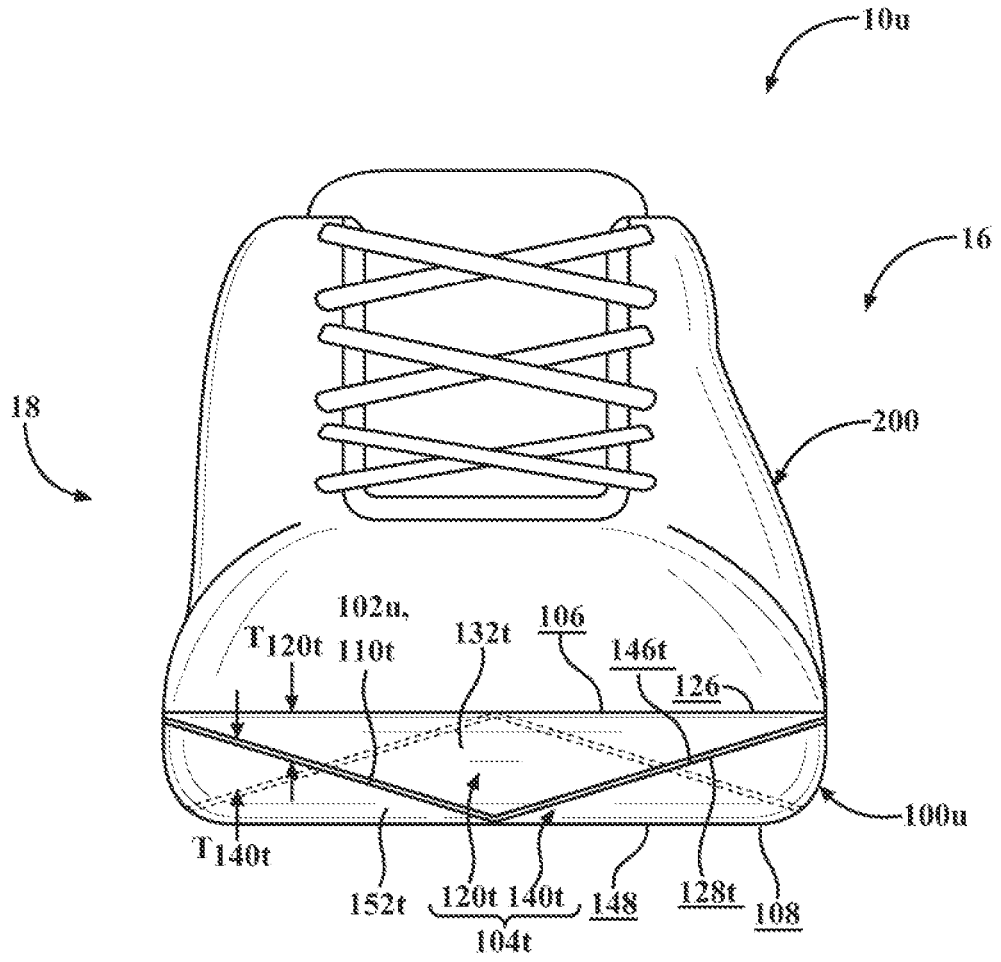
Figure 48:
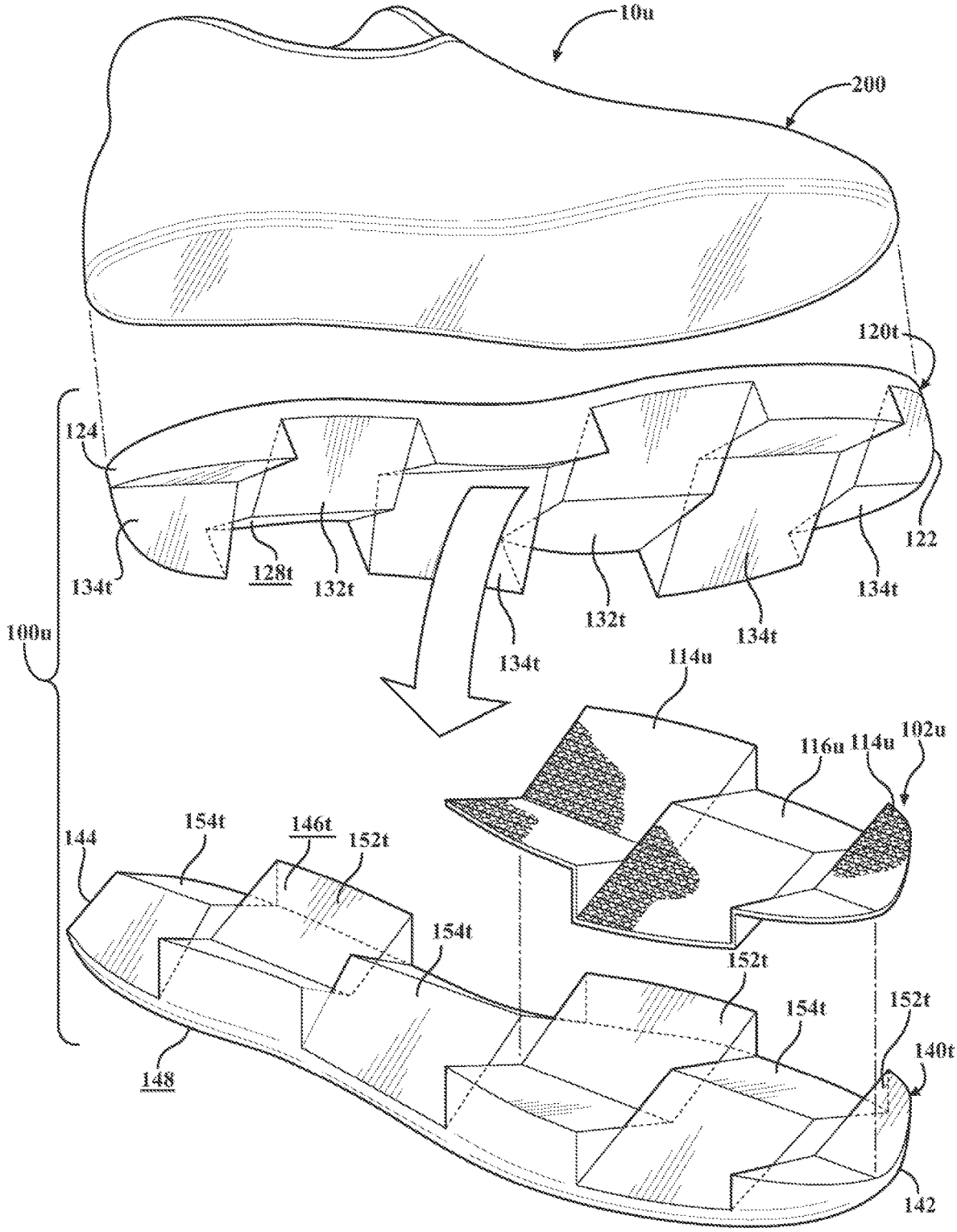

With particular reference to FIGS. 46-48, an article of footwear 10*u* is provided and includes a sole structure 100*u* and the upper 200 attached to the sole structure 100*u*. In view of the substantial similarity in structure and function of the components associated with the article of footwear 10 with respect to the article of footwear 10*u*, like reference numerals are used hereinafter and in the drawings to identify like components, while like reference numerals containing letter extensions are used to identify those components that have been modified.

In the example of FIGS. 46-48, the sole structure 100*u* includes a fabric panel 102*u* and the cushioning member 104*t* described above with respect to FIGS. 43-45. Here, the fabric panel 102*u* extends a partial length of the joint 110*t* from the anterior end 12 to the mid-foot region 22. Accordingly, the fabric panel 102*u* only includes first portions 114*u* and second portions 116*u* corresponding to the first three pairs of mating features 132*t*, 134*t*, 152*t*, 154*t*.

Figure 49:
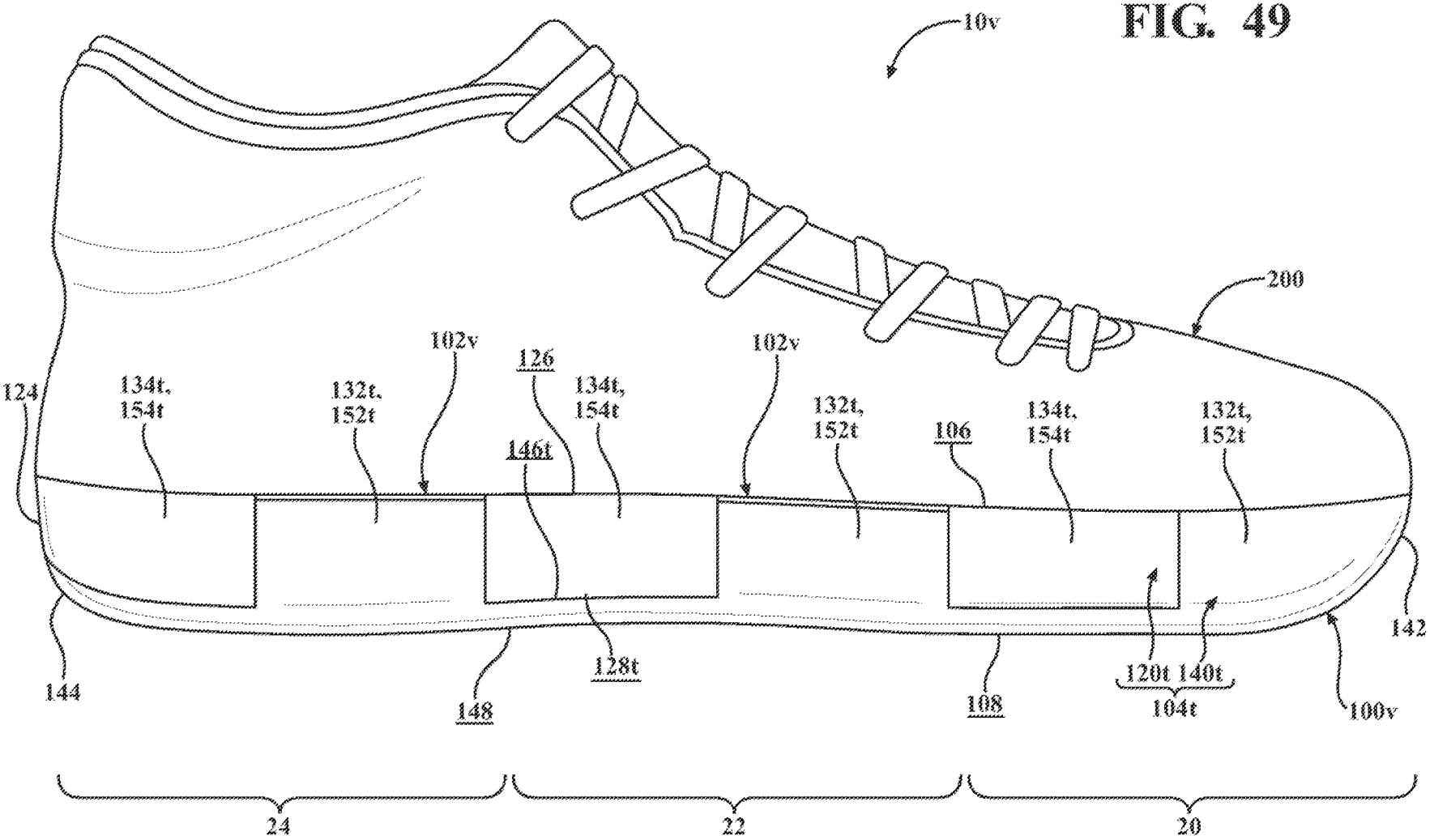
FIGS. 49-51 are views of another example of an article of footwear including a sole structure in accordance with the principles of the present disclosure.
Figure 50:
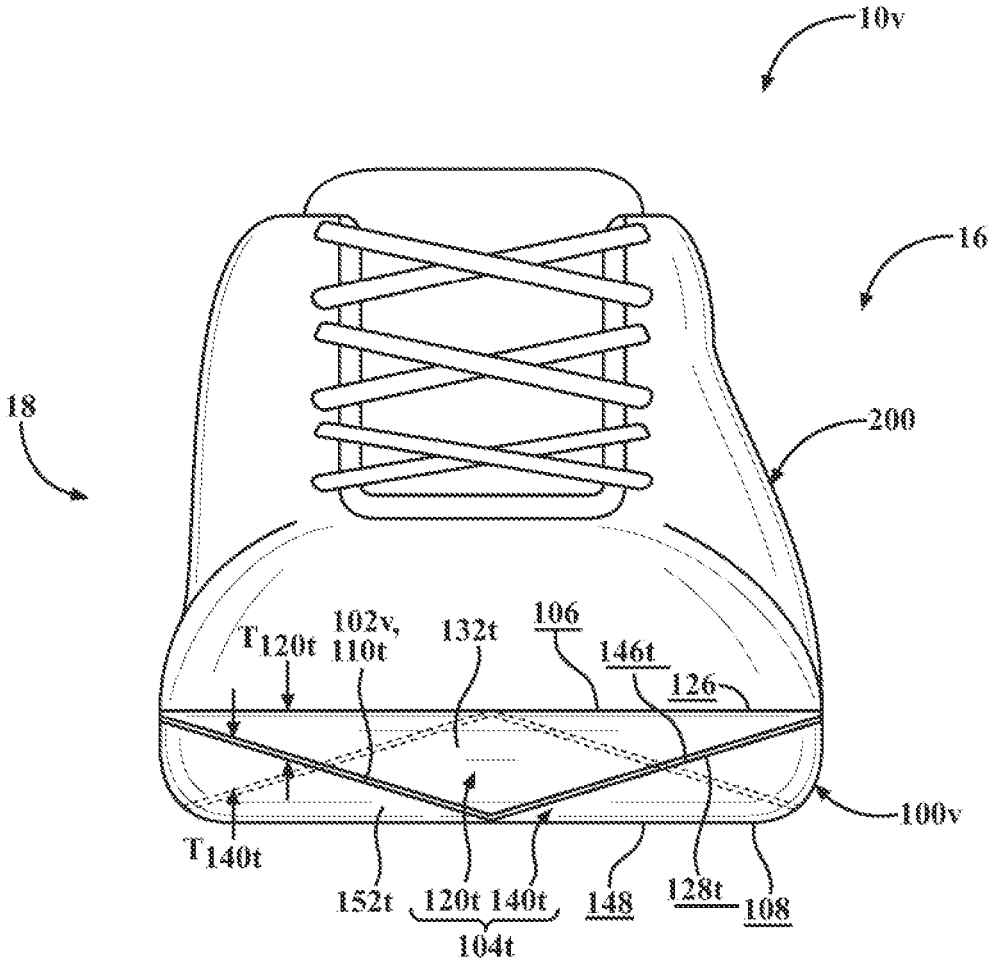
Figure 51:
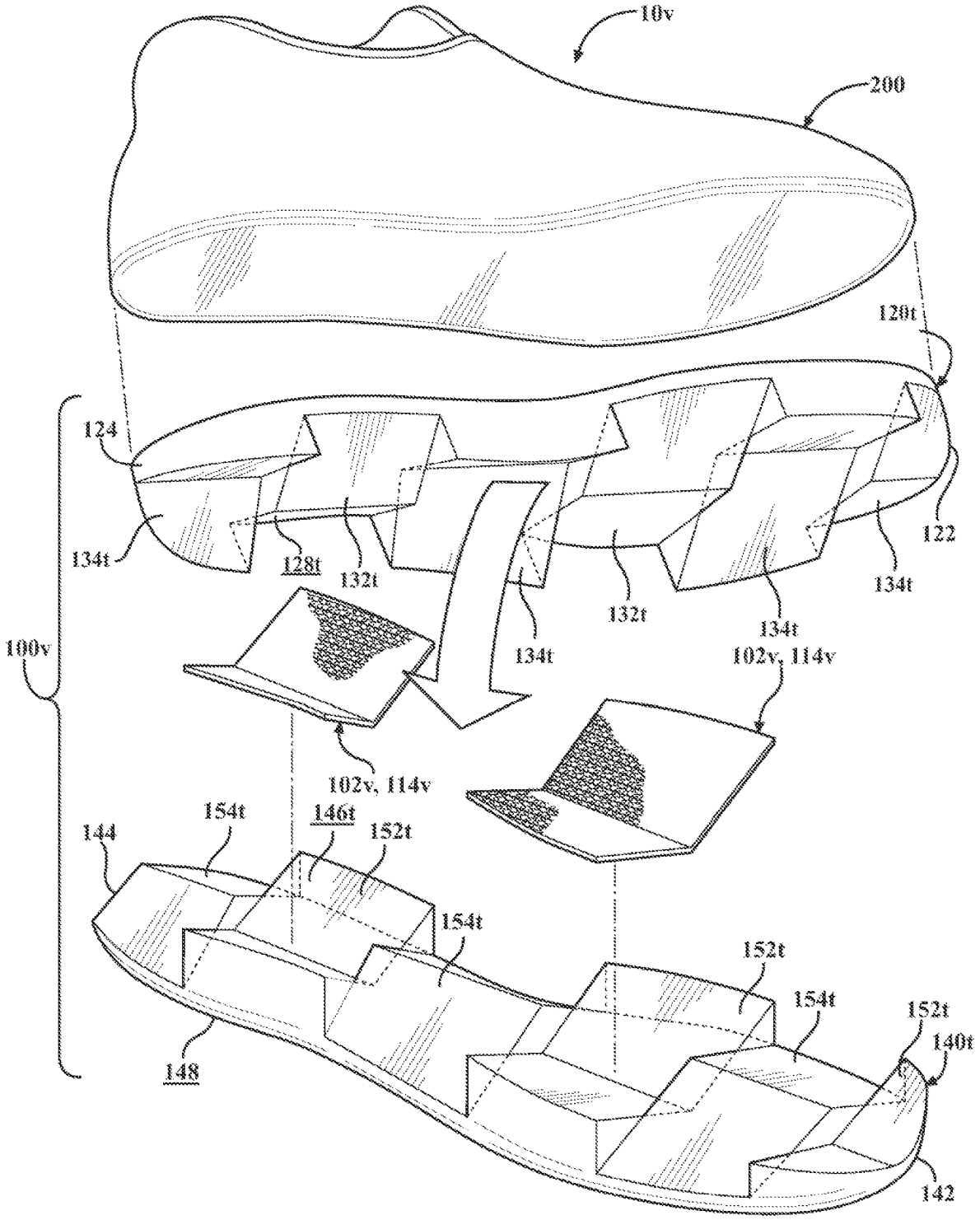

With particular reference to FIGS. 49-51, an article of footwear 10*v* is provided and includes a sole structure 100*v* and the upper 200 attached to the sole structure 100*v*. In view of the substantial similarity in structure and function of the components associated with the article of footwear 10 with respect to the article of footwear 10*v*, like reference numerals are used hereinafter and in the drawings to identify like components, while like reference numerals containing letter extensions are used to identify those components that have been modified.

In the example of FIGS. 49-51, the sole structure 100*v* includes a fragmented fabric panel 102*v* and the cushioning member 104*t* described above with respect to FIGS. 43-45. Here, the fabric panel 102*v* includes two separate portions 114*v* each disposed between opposing pairs of the first and third mating features 132*b*, 152*b*. Accordingly, the first portion 114*v* and the second portion 114*v* of the fabric panel 102*v* are separated by a mated pair of the second and fourth mating features 134*v*, 154*v*.

Figure 52:
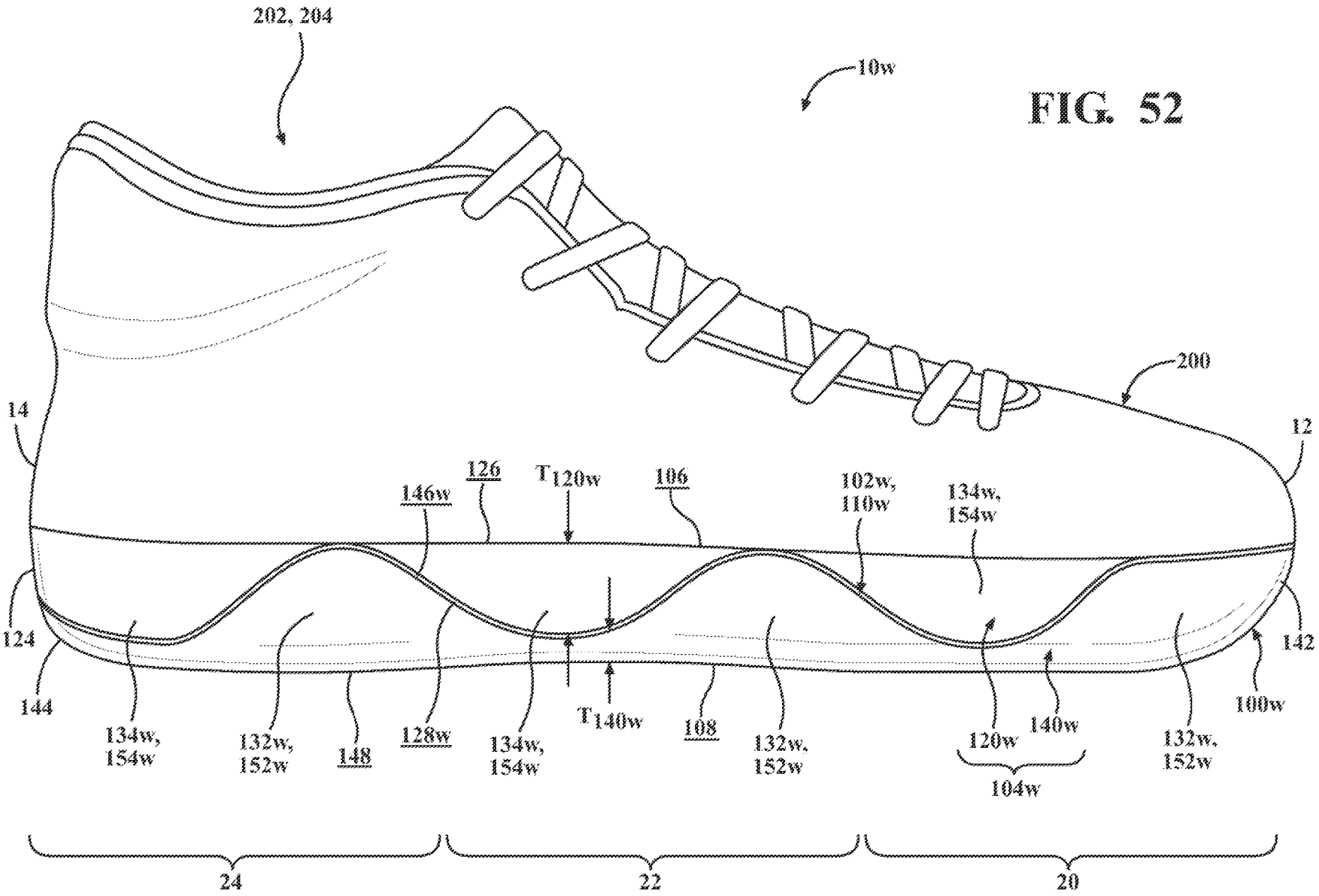
FIGS. 52-54 are views of another example of an article of footwear including a sole structure in accordance with the principles of the present disclosure.
Figure 53:
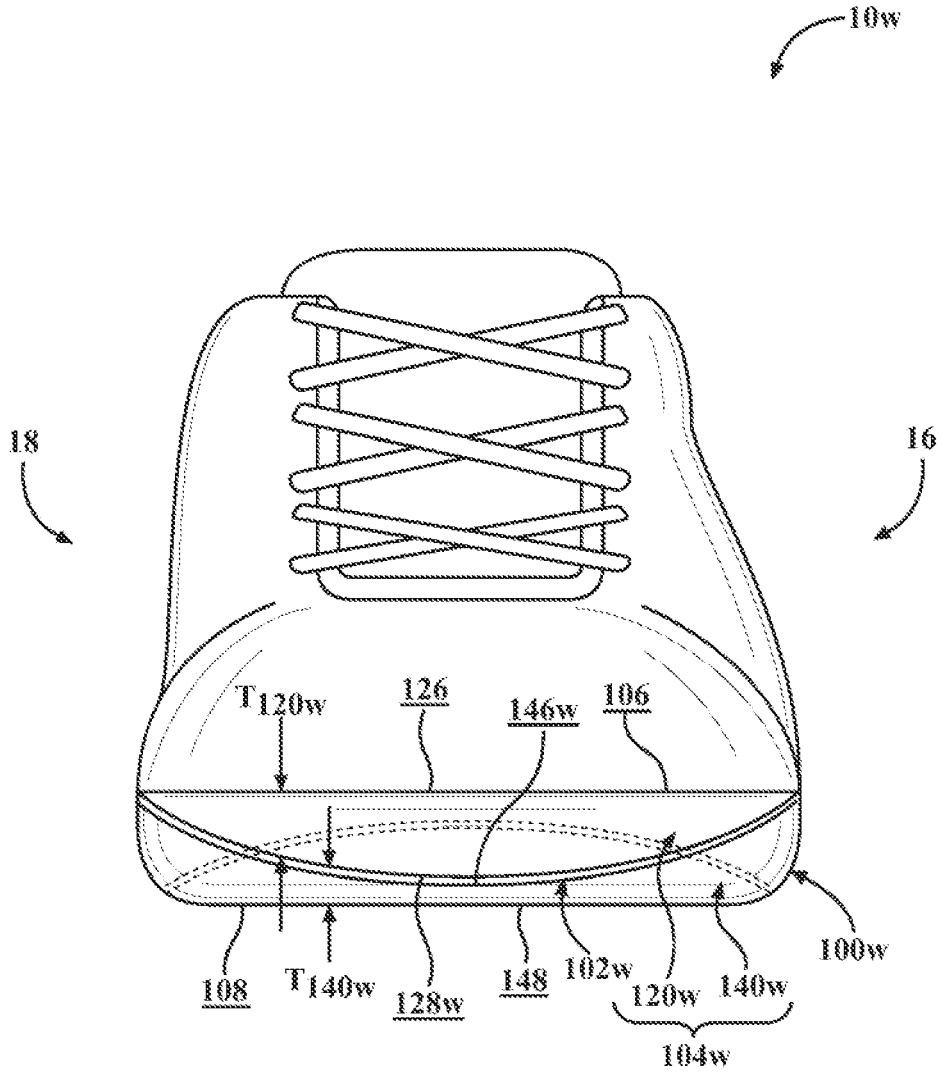
Figure 54:
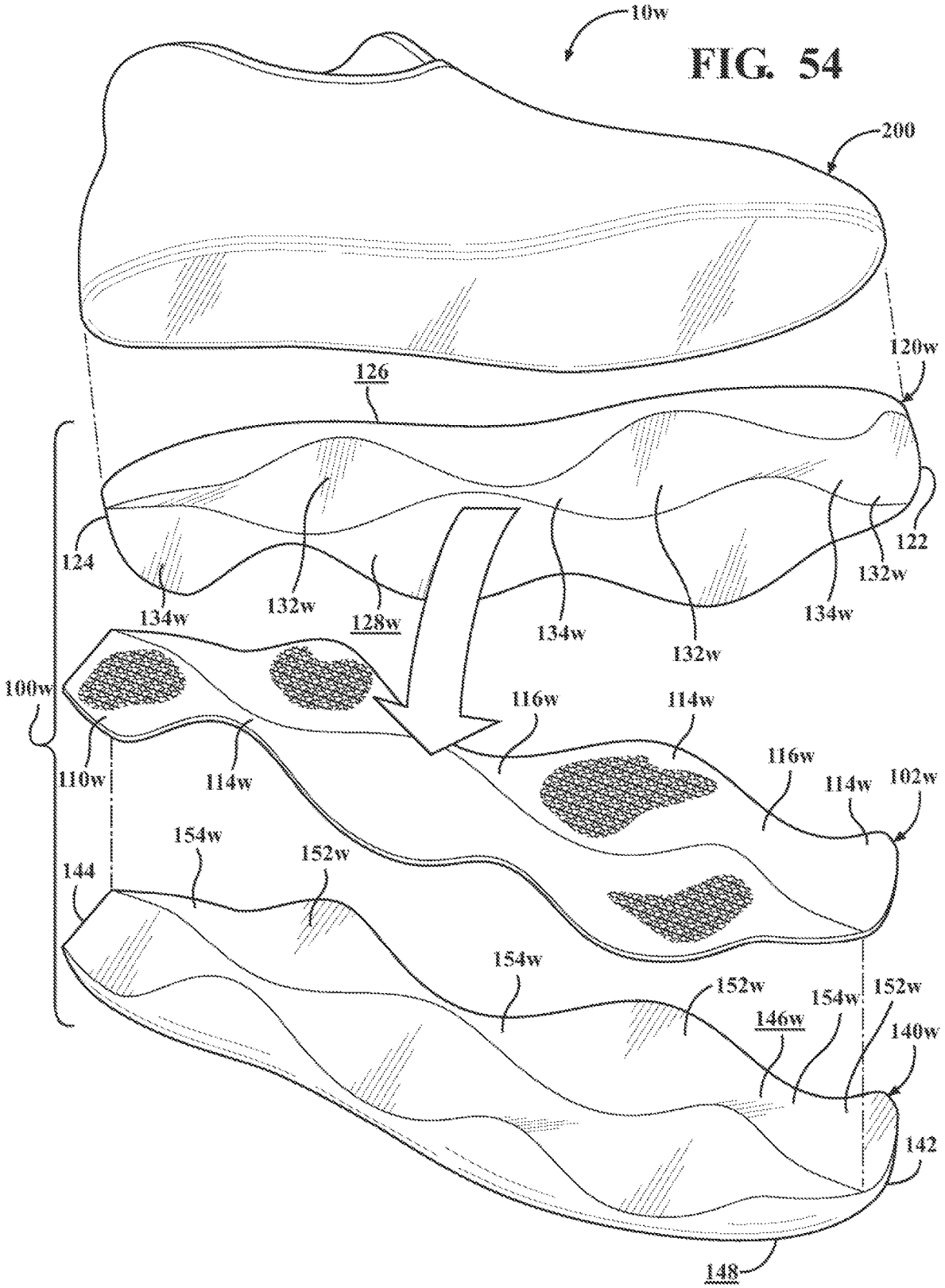

With particular reference to FIGS. 52-54, an article of footwear 10*w* is provided and includes a sole structure 100*w* and the upper 200 attached to the sole structure 100*w*. In view of the substantial similarity in structure and function of the components associated with the article of footwear 10 with respect to the article of footwear 10*w*, like reference numerals are used hereinafter and in the drawings to identify like components while like reference numerals containing letter extensions are used to identify those components that have been modified.

In the example of FIGS. 52-54, the sole structure 100*w* includes a fabric panel 102*w* and a cushioning member 104*w*. The cushioning member 104*w* includes a first cushioning element 120*w* extending from the anterior end 12 to the posterior end 14 and a second cushioning element 140*w* disposed beneath the first cushioning element 120*w*. As discussed below, the first cushioning element 120*w* and the second cushioning element 140*w* cooperate with the fabric panel 102*w* to form an alternating joint 110*w* extending along the length of the sole structure 100*w*.

The first cushioning element 120*w* is substantially similar to the first cushioning element 120*t* discussed above with respect to FIGS. 43-45, where a bottom surface 128*w* of the first cushioning element 120*w* includes an alternating series of first mating features 132*w* and second mating features 134*w* including ridges 132*w* and recesses 134*w*. However, unlike the first cushioning element 120*t*, which includes mating features 132*t*, 134*t* that are distinctly formed by planar surfaces, the mating features 132*w*, 134*w* are formed in a continuous and uninterrupted manner along the length of the first cushioning element 120*w*. Thus, as shown in FIGS. 52-54, the mating features 132*w*, 134*w* form a series of undulations along the length of the first cushioning element 120*w*. Similarly, the second cushioning element 140*w* includes corresponding mating features 152*w*, 154*w* formed as a series of undulations along the length of the second cushioning element 140*w*, which are configured to mate with the undulated mating features 132*w*, 134*w* when the sole structure 100*w* is assembled.

When the sole structure 100*w* is assembled, the mating features 132*w*, 134*w* of the bottom surface 128*w* of the first cushioning element 120*w* mate with and are joined to the mating features 152*w*, 154*w* of the top surface 146*w* of the second cushioning element 140*w* to define the undulated joint 110*w* along the length of the sole structure 100. The fabric panel 102*w* is disposed within the joint 110*w* between the bottom surface 128*w* of the first cushioning element 120*w* and the top surface 146*w* of the second cushioning element 140*w*. As best shown in FIG. 54, the fabric panel 102*w* includes a plurality of first portions 114*w* and a plurality of second portions 116*w* alternatingly arranged along the length of the sole structure 100*w*. The first portions 114*w* are configured to be interposed between opposing pairs of the first mating features 132*w* and the third mating features 152*w*, while the second portions 116*w* are configured to be interposed between opposing pairs of the second mating features 134*w* and the fourth mating features 154*w*. In this example, the fabric panel 102*w* extends along the entire joint 110*w* from the anterior end 12 to the posterior end 14.

As described above, the cushioning elements 120-120*w*, 140-140*w*, 160-160*c* are formed of a resilient polymeric material, such as foam or rubber, to impart properties of cushioning, responsiveness, and energy distribution to the foot of the wearer. As discussed, the cushioning elements 120-120*w*, 140-140*w*, 160-160*c* may be anisotropic, whereby a first portion of the respective cushioning elements 120-120*w*, 140-140*w*, 160-160*c* has different properties than a second portion of the cushioning elements 120-120*w*, 140-140*w*, 160-160*c*.

Example resilient polymeric materials for cushioning elements 120-120*w*, 140-140*w*, 160-160*c* may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., crosslinked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

With continued reference to the figures, the fabric panels 102-102*w* may be formed from a textile. The textile can be formed by manipulating one or more fibers, filaments or yarns, using techniques such as knitting, weaving, braiding, felting, hydroentanglement, etc. Similarly, when one or more cables is included in the sole structure, the cable can be formed from one or more fibers, filaments or yarns using a knitting or braining technique. The filaments and/or fibers used to form the yarns or fibers can comprise a polymeric material such as, for example, a thermoplastic material. An exemplary thermoplastic material may include, for example, a thermoplastic polyurethane, a thermoplastic polyamide, a thermoplastic polyether, a thermoplastic polyester, a thermoplastic polyolefin, any combination thereof, or the like. In some instances, the panel is porous. In some examples, if the panel is a textile, the textile may include a polyester yarn. Furthermore, in other examples, if the panel is a textile including apertures or passages between overlapping or entangled filaments, fibers or yarns, each passage or aperture defining the structure of the textile may be at least 0.5 mm in length in a largest dimension or at least 1.0 mm in length in a largest dimension. In some instances, the panel includes an embroidered textile and has one or more first regions including embroidery and one or more second regions without embroidery or with a lower percentage of embroidered surface area as comparted to the one or more first regions. The embroidery can provide reduced stretch or a "lock down" feature to areas of the panel. In some examples, or in some portions of the upper, the panel may stretch in a single direction. In other examples, or in other portions, the panel may stretch multi-directionally.

The following Clauses provide example configurations for a sole structure and an article of footwear described above.

Clause 1. A sole structure for an article of footwear including an upper, the sole structure comprising a first cushion including a first surface opposing the upper, a second surface disposed on an opposite side of the first cushion than the first surface, and a third surface extending between and connecting the first surface and the second surface, a second cushion including a fourth surface opposing the upper, a fifth surface disposed on an opposite side of the second cushion than the fourth surface, and a sixth surface extending between and connecting the fourth surface and the fifth surface, the sixth surface opposing the third surface to define a joint between the first cushion and the second cushion, and a panel disposed within the joint.

Clause 2. The sole structure of Clause 1, wherein the panel covers an entirety of the third surface and the sixth surface.

Clause 3. The sole structure of Clause 1 or Clause 2, wherein the panel extends along an entire thickness of the first cushion and the second cushion.

Clause 4. The sole structure of any of the preceding Clauses, wherein the first cushion is disposed closer to an anterior end of the sole structure than the second cushion.

Clause 5. The sole structure of Clause 4, wherein the third surface extends from a first end at the first surface to a second end at the second surface, the first end being disposed closer to the anterior end of the sole structure than the second end.

Clause 6. The sole structure of Clause 5, wherein the sixth surface extends from a first end at the fourth surface to a second end at the fifth surface, the first end of the sixth surface being disposed closer to the anterior end of the sole structure than the second end of the sixth surface.

Clause 7. The sole structure of any of the preceding Clauses, wherein the panel extends (i) along the first surface, (ii) along the fourth surface, or (iii) along the fifth surface.

Clause 8. The sole structure of any of the preceding Clauses, wherein the panel extends from the fifth surface in a direction toward the upper.

Clause 9. The sole structure of any of the preceding Clauses, wherein the third surface and the sixth surface are (i) substantially planar or (ii) include a series of steps that mate with one another.

Clause 10. An article of footwear incorporating the sole structure of any of the preceding Clauses.

Clause 11. A sole structure for an article of footwear including an upper, the sole structure comprising an outsole, a first cushion disposed between the upper and the outsole and including a first surface opposing the upper, a second surface disposed on an opposite side of the first cushion than the first surface and opposing the outsole, and a third surface extending (i) between the first surface and the second surface and (ii) from the upper to the outsole, a second cushion disposed between the upper and the outsole and including a fourth surface opposing the upper, a fifth surface disposed on an opposite side of the second cushion than the fourth surface and opposing the outsole, and a sixth surface extending (i) between the fourth surface and the fifth surface and (ii) from the upper to the outsole, the sixth surface opposing the third surface to define a joint between the first cushion and the second cushion, and a panel disposed within the joint.

Clause 12. The sole structure of Clause 11, wherein the panel covers an entirety of the third surface and the sixth surface.

Clause 13. The sole structure of Clause 11 or Clause 12, wherein the panel is formed from a different material than the first cushion and the second cushion.

Clause 14. The sole structure of any of the preceding Clauses, wherein the first cushion and the second cushion are formed from foam and the panel is formed from fabric.

Clause 15. The sole structure of any of the preceding Clauses, wherein the third surface extends from a first end at a junction of the first surface and the upper to a second end at a junction of the second surface and the outsole, the first end being disposed closer to an anterior end of the sole structure than the second end.

Clause 16. The sole structure of Clause 15, wherein the sixth surface extends from a first end at a junction of the fourth surface and the upper to a second end at a junction of the fifth surface and the outsole, the first end of the sixth surface being disposed closer to the anterior end of the sole structure than the second end of the sixth surface.

Clause 17. The sole structure of any of the preceding Clauses, wherein the panel extends (i) along the first surface, (ii) along the fourth surface, or (iii) along the fifth surface.

Clause 18. The sole structure of any of the preceding Clauses, wherein the panel extends from the fifth surface in a direction toward the upper.

Clause 19. The sole structure of any of the preceding Clauses, wherein the third surface and the sixth surface are (i) substantially planar or (ii) include a series of steps that mate with one another.

Clause 20. An article of footwear incorporating the sole structure of any of the preceding Clauses.

The foregoing description of the embodiments has been provided for purposes of illustration and description. It is not intended to be exhaustive or to limit the disclosure. Individual elements or feature of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear including an upper, the sole structure comprising:

a first cushion including a first surface opposing the upper and defining a first portion of a footbed, a second surface disposed on an opposite side of the first cushion than the first surface and defining a first portion of a ground-facing surface, and a third surface extending between and connecting the first surface and the second surface;

a second cushion including a fourth surface opposing the upper and defining a second portion of the footbed, a fifth surface disposed on an opposite side of the second cushion than the fourth surface and defining a second portion of the ground-facing surface, and a sixth surface extending between and connecting the fourth surface and the fifth surface, the sixth surface opposing the third surface to define a joint between the first cushion and the second cushion; and a panel disposed within the joint, extending from the footbed to the ground-facing surface, and including an embroidered textile configured to stretch in at least one direction.

2. The sole structure of claim 1, wherein the panel covers an entirety of the third surface and the sixth surface.

3. The sole structure of claim 1, wherein the panel extends along an entire thickness of the first cushion and the second cushion.

4. The sole structure of claim 1, wherein the first cushion is disposed closer to an anterior end of the sole structure than the second cushion.

5. The sole structure of claim 4, wherein the third surface extends from a first end at the first surface to a second end at the second surface, the first end being disposed closer to the anterior end of the sole structure than the second end.

6. The sole structure of claim 5, wherein the sixth surface extends from a first end at the fourth surface to a second end at the fifth surface, the first end of the sixth surface being disposed closer to the anterior end of the sole structure than the second end of the sixth surface.

7. The sole structure of claim 1, wherein the panel extends (i) along the first surface, (ii) along the fourth surface, or (iii) along the fifth surface.

8. The sole structure of claim 1, wherein the panel extends from the fifth surface in a direction toward the upper.

9. The sole structure of claim 1, wherein the third surface and the sixth surface are (i) substantially planar or (ii) include a series of steps that mate with one another.

10. An article of footwear incorporating the sole structure of claim 1.

11. A sole structure for an article of footwear including an upper, the sole structure comprising:

an outsole;

a first cushion formed from foam, disposed between the upper and the outsole, and including a first surface opposing the upper and defining a first portion of a footbed, a second surface disposed on an opposite side of the first cushion than the first surface and defining a first portion of a ground-facing surface opposing the outsole, and a third surface extending (i) between the first surface and the second surface and (ii) from the upper to the outsole;

a second cushion formed from foam, disposed between the upper and the outsole, and including a fourth surface opposing the upper and defining a second portion of the footbed, a fifth surface disposed on an opposite side of the second cushion than the fourth surface and defining a second portion of the ground-facing surface opposing the outsole, and a sixth surface extending (i) between the fourth surface and the fifth surface and (ii) from the upper to the outsole, the sixth surface opposing the third surface to define a joint between the first cushion and the second cushion; and a panel disposed within the joint, extending from the footbed to the ground-facing surface, and including an embroidered textile material configured to stretch in at least one direction.

12. The sole structure of claim 11, wherein the panel covers an entirety of the third surface and the sixth surface.

13. The sole structure of claim 11, wherein the panel is formed from a different material than the first cushion and the second cushion.

14. The sole structure of claim 11, wherein the third surface extends from a first end at a junction of the first surface and the upper to a second end at a junction of the second surface and the outsole, the first end being disposed closer to an anterior end of the sole structure than the second end.

15. The sole structure of claim 14, wherein the sixth surface extends from a first end at a junction of the fourth surface and the upper to a second end at a junction of the fifth surface and the outsole, the first end of the sixth surface being disposed closer to the anterior end of the sole structure than the second end of the sixth surface.

16. The sole structure of claim 11, wherein the panel extends (i) along the first surface, (ii) along the fourth surface, or (iii) along the fifth surface.

17. The sole structure of claim 11, wherein the panel extends from the fifth surface in a direction toward the upper.

18. The sole structure of claim 11, wherein the third surface and the sixth surface are (i) substantially planar or (ii) include a series of steps that mate with one another.

19. An article of footwear incorporating the sole structure of claim 11.

* * * * *